US006773385B2

(12) United States Patent
Johnson et al.

(10) Patent No.: US 6,773,385 B2
(45) Date of Patent: Aug. 10, 2004

(54) PACKAGING LINER INSERTION APPARATUSES AND METHODS FOR FLEXIBLE CONTAINER LINERS

(75) Inventors: Michael Johnson, Spokane, WA (US); Richard McQuary, Spokane, WA (US); Gordon Langlot, Spokane, WA (US); Larry Horton, Airway Heights, WA (US)

(73) Assignee: R. A. Pearson Company, Spokane, WA (US)

( * ) Notice: Subject to any disclaimer, the term of this patent is extended or adjusted under 35 U.S.C. 154(b) by 0 days.

(21) Appl. No.: 10/347,174

(22) Filed: Jan. 17, 2003

(65) Prior Publication Data

US 2003/0162642 A1 Aug. 28, 2003

Related U.S. Application Data

(63) Continuation-in-part of application No. 10/024,707, filed on Dec. 17, 2001.

(51) Int. Cl.[7] ..... B31B 7/00

(52) U.S. Cl. ..... 493/93; 493/100; 493/217

(58) Field of Search ..... 53/175, 384.1, 53/386.1; 493/93, 95, 100, 101, 907, 217

(56) References Cited

U.S. PATENT DOCUMENTS

| | | | | |
|---|---|---|---|---|
| 3,606,821 A | | 9/1971 | Tsien | |
| 3,796,140 A | | 3/1974 | Adams et al. | |
| 4,035,988 A | | 7/1977 | Daniels | 53/183 |
| 4,083,293 A | | 4/1978 | Goldstein | 93/36.01 |
| 4,142,453 A | | 3/1979 | Gidewall et al. | 93/36.01 |
| 4,280,313 A | | 7/1981 | Akkala et al. | 53/175 |
| 4,489,537 A | | 12/1984 | Gordon et al. | 53/511 |
| 4,522,012 A | | 6/1985 | Nelson | 53/175 |
| 4,676,284 A | * | 6/1987 | DeCrane | 141/114 |
| 4,684,359 A | * | 8/1987 | Herrington | 493/211 |
| 4,687,462 A | | 8/1987 | Rewitzer | 493/100 |
| 4,729,209 A | | 3/1988 | Owensby et al. | 53/434 |
| 4,829,741 A | | 5/1989 | Langen | 53/122 |
| 4,840,016 A | | 6/1989 | Muller, Jr. | 53/459 |
| 4,912,913 A | | 4/1990 | Rundle | 53/583 |
| 4,918,906 A | | 4/1990 | Ako | 53/449 |
| 5,100,370 A | | 3/1992 | Barbour | 493/100 |
| 5,140,801 A | | 8/1992 | Wild | 53/459 |
| 5,279,537 A | | 1/1994 | Lile | 493/100 |
| 5,507,132 A | | 4/1996 | Gwiazdon et al. | 53/469 |
| 5,735,786 A | | 4/1998 | Krueger et al. | 493/101 |
| 5,916,078 A | | 6/1999 | Herrin | 493/93 |
| 5,928,123 A | | 7/1999 | Davis, Jr. | 493/316 |
| 6,066,080 A | * | 5/2000 | Benoit et al. | 493/95 |
| 6,132,350 A | * | 10/2000 | Krueger et al. | 493/101 |
| 6,338,371 B1 | | 1/2002 | Araki et al. | 151/145 |
| 6,374,579 B1 | | 4/2002 | Muller | 53/449 |
| 6,446,365 B1 | | 9/2002 | Sullivan et al. | 371/195 |

FOREIGN PATENT DOCUMENTS

FR 1242225 12/1959

OTHER PUBLICATIONS

1999 Brochure by R. A. Pearson Co., "Model Y1928, Bag Inserter", 2 pages.

* cited by examiner

*Primary Examiner*—Eugene Lee Kim
(74) *Attorney, Agent, or Firm*—Wells St. John P.S.

(57) ABSTRACT

Methods and apparatuses for inserting flexible bags and other liners into open packaging containers. One or more engagement heads engage and position the flexible liners in preparation for their insertion into open containers using an insertion assembly. One or more of the engagement heads are preferably made with vacuum heads that are movable to open the liner for the insertion assembly. A cuffing assembly can be included for cuffing the open end of the liners over the top edges of the open containers. Clamping assemblies can be included on the cuffing assembly to facilitate holding the liners during insertion and cuffing. The use of an engagement assembly, insertion assembly, and cuffing assembly which are independently driven helps to provide greater speed and operational flexibility.

16 Claims, 26 Drawing Sheets

243
244
242
241
233
235
245
234
236
230
281
282
283
289
250
253
262
260
261
252
254
290
275
272
270
312
322
315
301
291
271
303
320
292
310
305
325
304
294
280

PACKAGING LINER INSERTION APPARATUSES AND METHODS FOR FLEXIBLE CONTAINER LINERS

CROSS REFERENCES TO RELATED APPLICATIONS

This application is a continuation-in-part of U.S. patent application Ser. No. 10/024,707, filed on Dec. 17, 2001, which is incorporated by reference entirely hereinto.

TECHNICAL FIELD

This disclosure pertains to machinery and methods for placing flexible bags and liners into packaging containers. It also pertains to cuffing the flexible bags and liners over an edge of the containers, such as cuffing plastic liner bags over the top edges of a cardboard box.

BACKGROUND OF THE INVENTION

This invention arose from the need to more efficiently automate the insertion of flexible liner bags into packaging containers. It is also common to cuff the bags about a top edge of the containers during insertion. Both of these are preferably accomplished at high production rates.

Containers or cartons lined with flexible bags are widely used for packaging a variety of products including food products, electronics and many others. Numerous devices have been developed in an effort to effectively automate these processes. However, these devices continue to have various shortcomings and there remains a need for methods and apparatuses which will more quickly insert and preferably cuff flexible bags into cardboard cartons or other packaging containers.

BRIEF DESCRIPTION OF THE DRAWINGS

Preferred embodiments of the invention are described below with reference to the following accompanying drawings.

FIG. 7 is a side elevational view showing portions of the vacuum engagement assembly utilized in the packaging liner insertion apparatus of FIG. 1.

FIG. 14A is a diagram representing various operational stages used in one process according to the inventions.

FIG. 14B is a diagram representing various operational stages used in one process according to the inventions.

FIG. 16 is a perspective view showing a portion of the alternate preferred cuffing assembly and clamping assembly of FIG. 15.

DETAILED EXPLANATION OF THE INVENTION

The Framework of the Bag Insertion Apparatus

Figure 1:
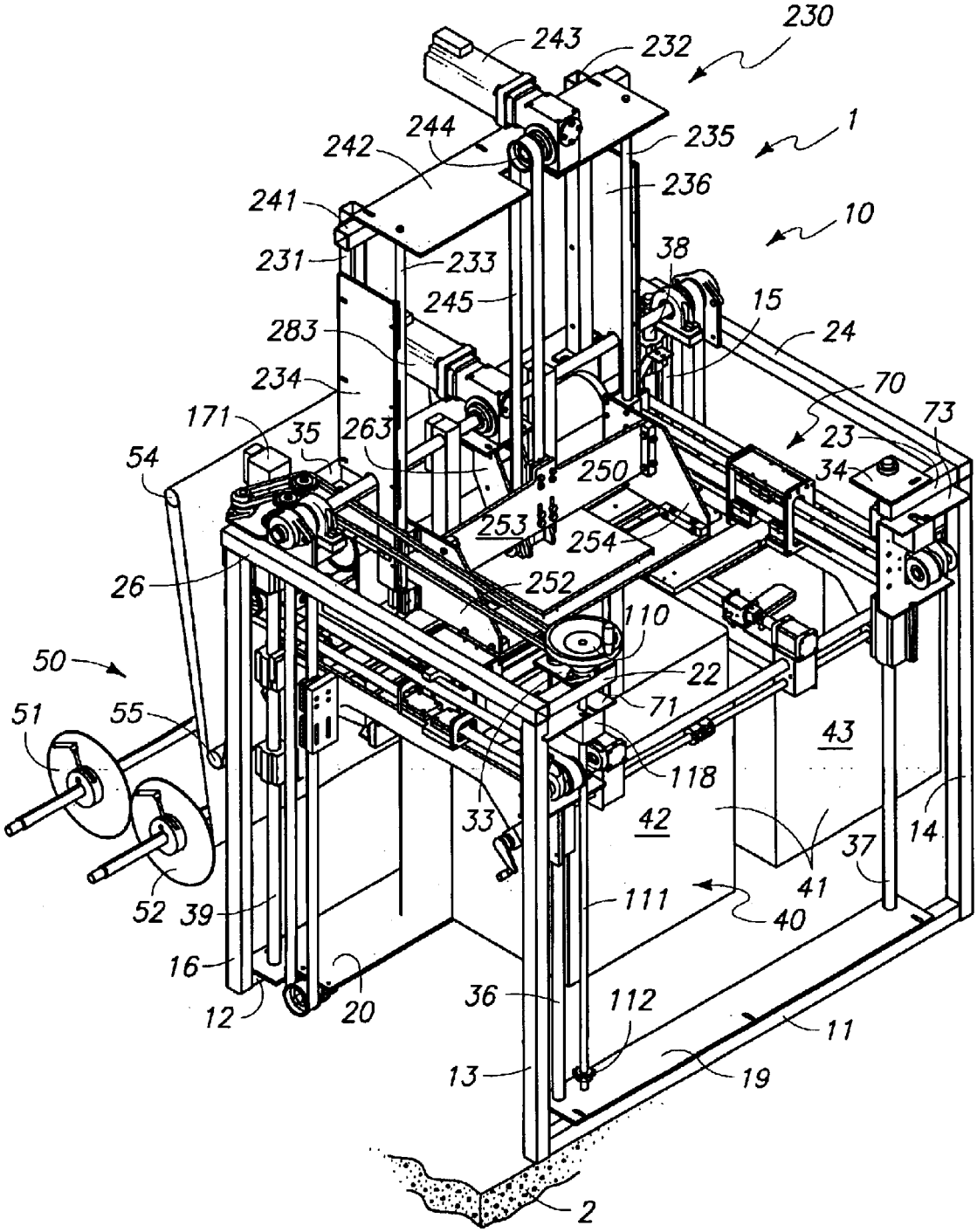
FIG. 1 is a perspective view showing portions of a preferred packaging liner insertion apparatus according to the invention.
Figure 2:
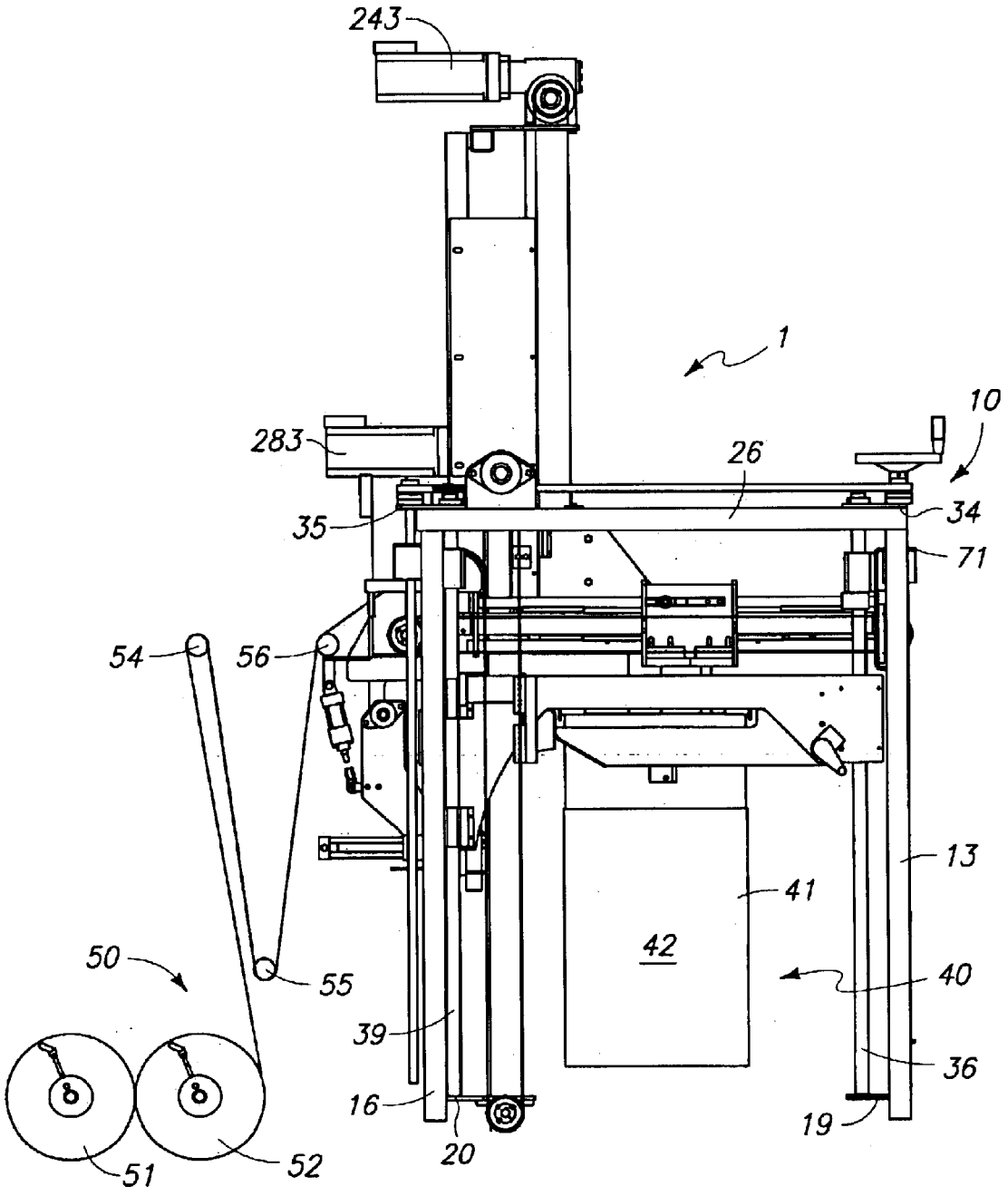
FIG. 2 is a side elevational view of the packaging liner insertion apparatus of FIG. 1.

FIGS. 1 and 2 show a preferred apparatus according to the present invention, which is generally indicated by the reference numeral 1. The apparatus 1 of the present invention has a main framework 10 which rests on a supporting surface 2 as described below.

As shown in FIG. 1, the main framework 10 includes four substantially upright or vertical rigid frame members 13, 14, 15 and 16. Four frame foot plates (not shown) are respectively securely affixed to the lower end of each of the four substantially upright or vertical rigid frame members 13, 14, 15 and 16. These frame foot plates rest on the supporting surface 2, and may be securely attached to the supporting surface 2 using a variety of fasteners or other suitable techniques.

FIG. 1 also shows the main framework 10 includes a first lower horizontal frame member 11 which is located near the front of the apparatus 1, and a second lower horizontal frame member 12 which is located near the back of the apparatus. The first and second vertical frame members 13 and 14 extend upwardly from near the ends of the first lower horizontal frame member 11, and are rigidly secured to the ends of the first lower horizontal frame member 11. Similarly, the third and fourth vertical frame members 15 and 16 extend upwardly from near the ends of the second lower horizontal frame member 12, and are similarly rigidly secured to the ends of the second lower horizontal frame member 12.

FIG. 1 further shows a lower front frame mounting plate 19 that is securely attached to the first lower horizontal frame member 11. A lower rear frame mounting plate 20 is similarly attached to the second lower horizontal frame member 12. Each of these frame mounting plates 19 and 20 serve as a platform or base which may be used to support other components of the apparatus 1 as described below.

The four substantially upright or vertical rigid frame members 13, 14, 15 and 16 of main framework 10 extend upwardly where the upper ends of these frame members are connected to various structures as described below. A first upper frame horizontal member left segment 22 is securely attached near the upper end of the first vertical frame member 13. Similarly, a first upper frame horizontal member right segment 23 is securely attached near the upper end of the second vertical frame member 14.

In FIG. 1, the first upper frame horizontal member left and right segments 22 and 23 are shown extending horizontally cantilevered from the upper ends of the first and second vertical frame members 13 and 14. These members are cantilevered from each side in order to facilitate access.

Figure 3:
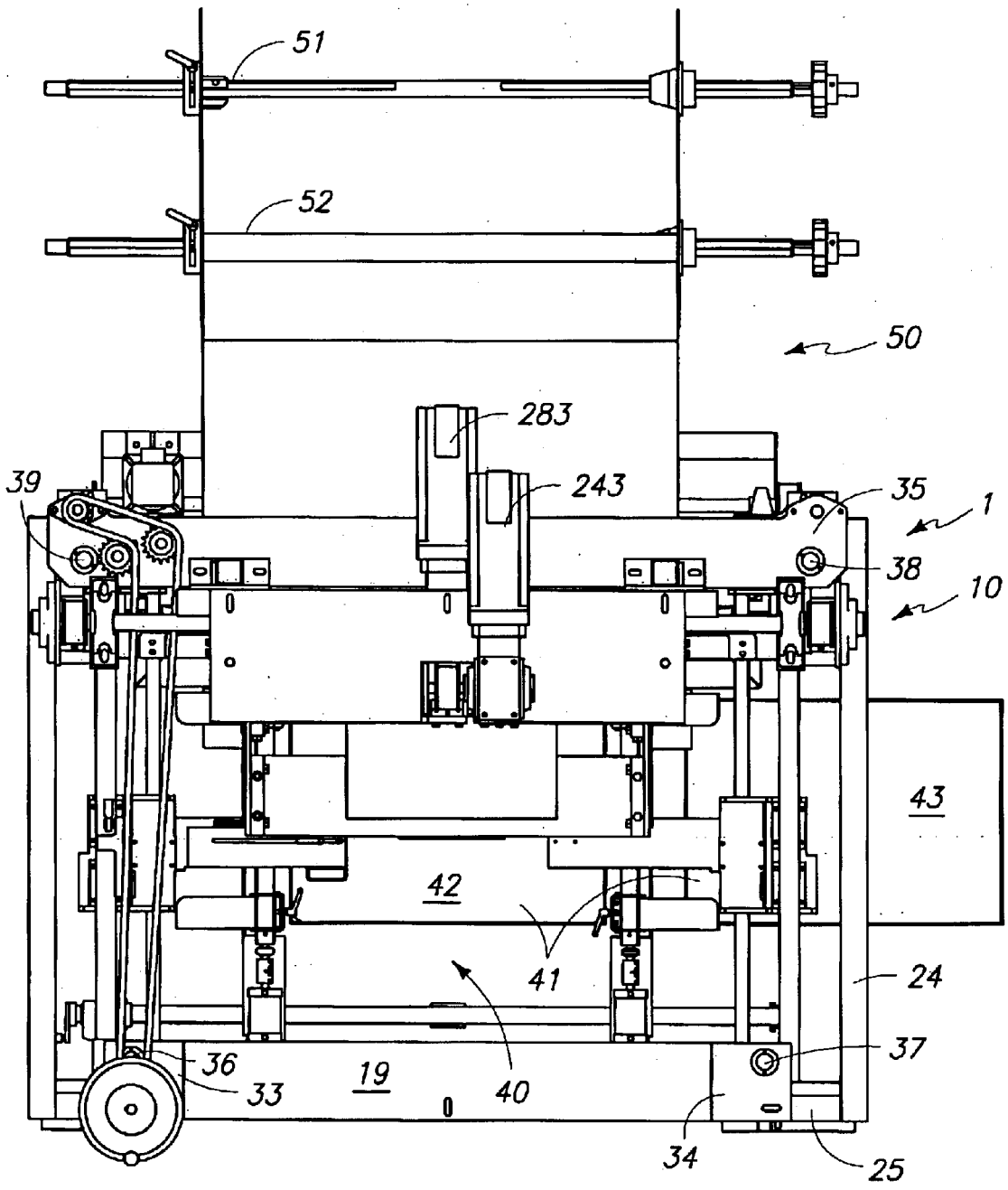
FIG. 3 is a top view of the packaging liner insertion apparatus of FIG. 1.

Referring now to FIGS. 1 and 3, a second upper frame horizontal member 24 spans the distance between the second and third vertical frame members 14 and 15, and is securely fixed to the upper ends thereof. Similarly, a third upper frame horizontal member (not illustrated) extends between the upper ends of the third and fourth vertical frame members 15 and 16, and is securely fixed to the upper ends thereof. A fourth upper frame horizontal member 26 extends between the upper ends of the first and fourth vertical frame members 13 and 16, being similarly securely fixed to the upper ends thereof.

As best seen in FIGS. 1 and 3, an upper front frame mounting plate left segment 33 is securely attached to the upper surface of the first upper frame horizontal member left segment 22. Similarly, an upper front frame mounting plate right segment 34 is securely attached to the upper surface of the first upper frame horizontal member right segment 23.

Still referring to FIGS. 1 and 3, an upper rear frame mounting plate 35 is also shown. The upper rear mounting plate 35 is securely attached to the upper surface of the third upper frame horizontal member (not shown). The upper rear frame mounting plate 35 is best seen in FIG. 3. Each of these upper frame mounting plates 33, 34 and 35 provide a stable mounting surface to which other components may be secured as described below.

Referring now to FIGS. 1 and 2, first frame guide rod 36 is shown to extend vertically between the lower front mounting plate 19 and the upper front mounting plate left segment 33. Similarly, the second frame guide rod 37 is shown to extend vertically between the lower front mounting plate 19 and the upper front mounting plate right segment 34. The third and fourth frame guide rods 38 and 39 extend vertically between the lower rear frame mounting plate 22 and the upper rear frame mounting plate 35. The ends of each of the four frame guide rods being securely attached to the respective mounting plates. These four frame guide rods 36, 37, 38 and 39 provide a slide frame which acts as a means for slidably mounting a sliding vertically moving assembly which includes various components of the apparatus 1 which will be described in greater detail below.

Main framework 10 as described above advantageously defines a container work space which is within the container receiving area. The container receiving area serves for receiving cartons, drums, pails, or other containers which are being positioned adjacent to or within apparatus 1. A more detailed description of the container receiving area follows.

The Container Receiving Area

As best seen in FIGS. 1–4, the first, second, third and fourth vertical frame members 13, 14, 15 and 16 approximately define the four outer edges or corners of a tunnel shaped container or carton receiving area, which is generally indicated by the numeral 40 (FIG. 2). As shown in FIGS. 1–4, packaging cartons or other containers 41 are supplied to the container receiving area 40. This may be accomplished using a conveyor (not shown) or other suitable container supply and/or moving apparatus or techniques.

In FIG. 1, a first packaging container 42 is shown positioned in the container receiving area 40, while a second packaging container 43 is waiting to be moved to the container receiving area 40. This second packaging container 43 will be moved into the container receiving area after the apparatus 1 has completed its insertion of a flexible bag into the first packaging container 42. The open end of the flexible bag is also preferably cuffed over the top edges of the first container 42 before second container 43 is moved into position for insertion of a liner bag.

Additional packaging containers (not shown) will be sequentially moved into the container receiving area 40 one container at a time, as the liner insertion and cuffing process proceeds. In the preferred embodiment, a powered conveyor belt (not shown) or other means of delivering or moving containers, will be utilized to deliver the containers 41 to the container receiving area 40. Such a conveyor may also be utilized to remove the containers 41 from the container receiving area 40 after the liner bags have been installed.

In the preferred embodiment, the main framework 10 is designed to fit over a powered carton or other container conveyor which sequentially delivers the packaging containers 41 to the container receiving area 40. As each container arrives at the container receiving area 40, the apparatus of the present invention 1 will insert a flexible liner bag into the container and may cuff the open end of the flexible bag over the top edges of the open container if cuffing is desired. In the preferred embodiment, the flexible bags which are to be inserted into the containers 41 are supplied and dispensed to the container receiving area 40 by a bag dispenser which will be described in greater detail hereinafter.

The Bag Dispenser

Now referring to FIGS. 1, 2 and 3, the bag dispenser is generally indicated by the numeral 50. Bag dispenser 50 includes a liner or bag inventory and feed mechanism which can be in the form of a series of rolls, rollers, or spools which advantageously function to dispense flexible bags supplied on rolls to the container receiving area 40. The dispenser acts as a liner supply. The flexible bags or other liners are inserted into containers 41. If other configurations for the supplied liner are desired, then modifications may be needed.

The liner dispenser shown includes first and second rolls or spools 51 and 52. The first and second bag rolls 51 and 52 hold a supply of flexible bags or other liners. They also allow the supplied bags to be delivered to the container receiving area 40 for insertion of the flexible bags into containers 41. In the preferred embodiment, the flexible bags are supplied from a roll in which the individual flexible bags are advantageously interconnected end-to-end in a series. These can be divided into individual bags at transverse lines of weakness, such as at perforations. However, in addition to working with pre-perforated, pre-sealed roll stock, other types of flexible bag or other liner stock can be used. One alternative is plain tube stock that is sealed, sealed and cut, or merely cut on site. Such alternative bag or other liner feed material may also require appropriate modification to apparatus 1.

As shown in FIGS. 1, 2 and 3, the first and second bag rolls 51 and 52 are positioned so that they may provide the series of interconnected flexible bags to a first bag feed roller 54, then to a second bag feed roller 55, and finally to a third bag feed roller 56. These flexible bags are then dispensed to the container receiving area 40. The bags are typically fed one at a time with the leading flexible bag on the roll detached and inserted into open packaging container 42. A conventional actuating means (not shown) causes the series of interconnected bags to be controllably advanced, and supplied to the container receiving area 40. This is done at a suitable rate, such as one bag at a time.

In the preferred embodiment, the flexible bags are supplied from a roll in which the individual flexible bags are interconnected end-to-end in a series connected at transverse lines of weakness which form partition or tear lines. When the first flexible bag in the series of bags is dispensed to the container receiving area 40, plural vacuum heads operate to engage the flexible bag. The bag is then opened by separating the two opposing leaves or sides of the bag. The vacuum heads also preferably separate the bag from the series of bags remaining on the roll and feed mechanism. Additionally, these vacuum heads serve to position the flexible bag for insertion into a container positioned in the container receiving area 40. The operation of these vacuum heads is described in greater detail hereinafter.

The Liner Engagement Vacuum Assembly

Now turning to FIGS. 1 and 5–8, the vacuum engagement assembly is generally indicated by the numeral 70. As will be described in detail below, the vacuum assembly 70 serves to engage and position flexible bags which have been dispensed to the container receiving area 40 by the bag dispenser 50. In the preferred embodiment, the vacuum assembly 70 includes at least one, and more preferably at least two movable vacuum heads. In the preferred embodiment, at least one vacuum head is advantageously positioned along each side of the bag. The vacuum heads may be controllably moved to engage a flexible bag which has been supplied by the bag dispenser 50. Two rear vacuum heads assist the movable vacuum heads in engaging the flexible bag between opposing sets of vacuum heads.

Figure 5:
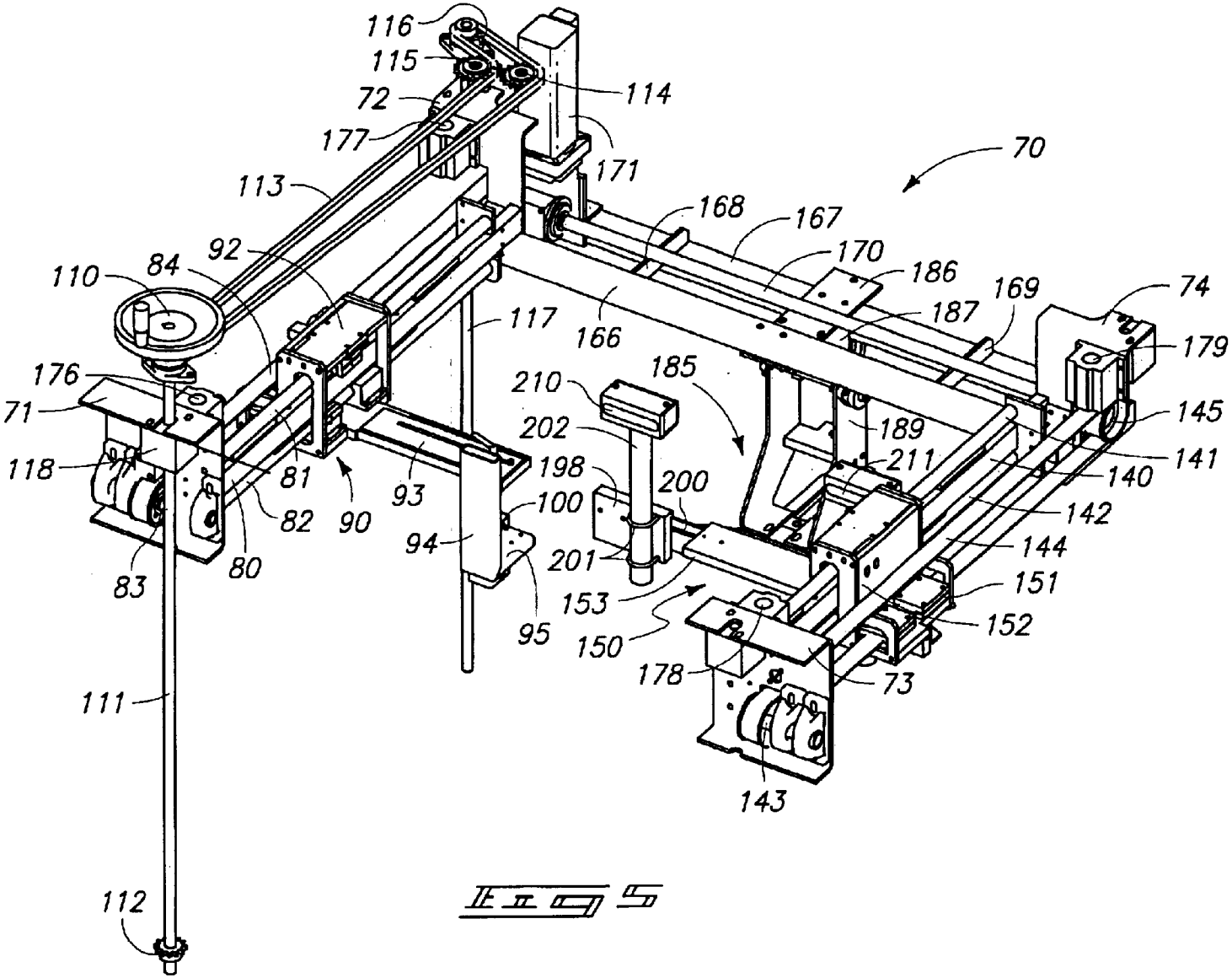
FIG. 5 is a perspective view showing portions of the vacuum engagement assembly utilized in the packaging liner insertion apparatus of FIG. 1.
Figure 8B:
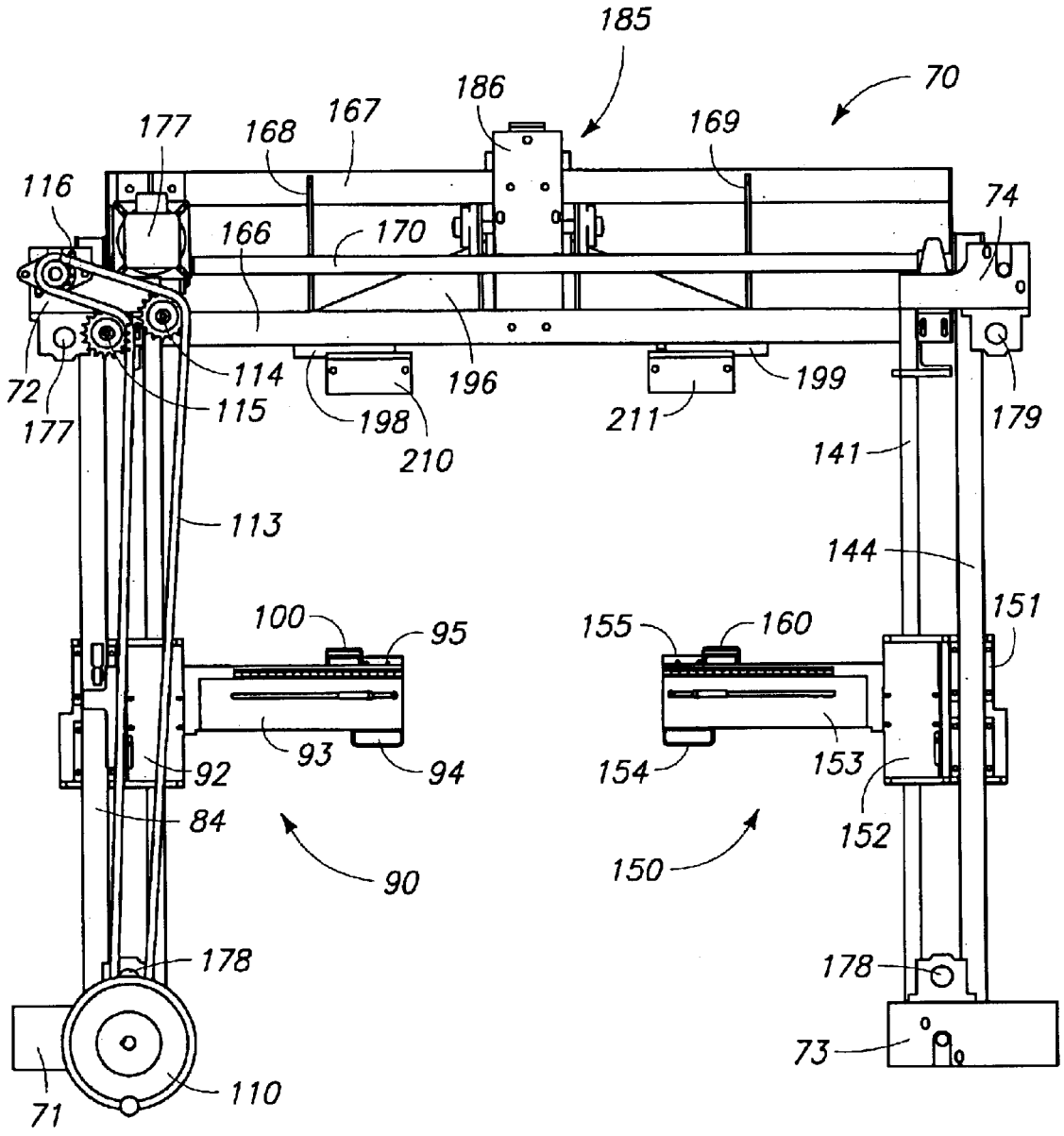
FIG. 8 is a top view showing portions of the vacuum engagement assembly utilized in the packaging liner insertion apparatus of FIG. 1.

As best seen in FIGS. 5 and 8, the basic framework of the vacuum assembly 70 is essentially a "U" shaped structure. This U-shaped framework may be raised or lowered relative to the main framework 10 to accommodate a variety of container sizes. As will be further described below, one movable vacuum head is configured to travel along each side of the "U," while the two rear vacuum heads are positioned near the base of the "U" shaped framework. These two rear vacuum heads may also move to assist in the engagement of the flexible bags, the separation of the flexible bags from the bag supply roll, and the positioning of the flexible bags for insertion into open cartons or containers. Alternatively, the vacuum heads can all be mounted for greater movement, such as for coordinated movement against the bag and then to spread the bag. As shown in this embodiment the rear vacuum heads move a smaller degree than the front heads. The rear heads may also be stationary in some constructions.

Referring again to FIGS. 1 and 5–8, the vacuum assembly 70 has four mounting plates: a front left mounting plate 71, a back left mounting plate 72, a front right mounting plate 73, and a back right mounting plate 74. These four mounting plates 71, 72, 73 and 74 generally define the four outer corners of the vacuum assembly 70.

As shown best in FIG. 5, the front left mounting plate 71 and the back left mounting plate 72 are connected by several structures, including: a left side frame support 80, a top left guide rod 81, and a bottom left guide rod 82. The left side frame support 80 rigidly attaches the front left mounting plate 71 to the back left mounting plate 72. The top left guide rod 81 and a bottom left guide rod 82 are designed to slidably receive the left movable vacuum subassembly which is described in detail below.

As best seen in FIGS. 5 and 7, a front left pulley 83 is also securely attached to the front left mounting plate 71 in such a way that the front left pulley may rotate freely. The front left pulley 83 is operably coupled with a left vacuum drive belt 84 which extends to, and is operably coupled with, a back left pulley 85. The back left pulley 85 is attached to the back left mounting plate 72.

Still referring to FIGS. 5 and 7, the left movable vacuum subassembly is generally designated by the numeral 90. The left movable vacuum subassembly 90 includes a left vacuum drive belt clamp 91 which functions to securely attach the left arm guide 92 to the left vacuum drive belt 84. As best seen in FIG. 5, the left horizontal vacuum mounting segment 93 is affixed to the left arm guide 92, and extends horizontally therefrom. The left vertical vacuum mounting segment 94 is securely connected to the left horizontal vacuum mounting segment 93, and extends downwards therefrom. The left vacuum connector 95 serves to securely couple the left vertical vacuum mounting segment 94 to the movable left vacuum head 100. Together these structures comprise the left movable vacuum subassembly 90. Each part thereof can be connected so as to allow positional adjustment for positioning and aligning the vacuum heads.

When the left vacuum drive belt 84 is put into motion, the attached left vacuum subassembly 90, including the attached movable left vacuum head 100, will move as actuated by the left vacuum drive belt 84. The left movable vacuum subassembly 90 slidably moves along the top left guide rod 81 and the bottom left guide rod 82 as movement of the left vacuum drive belt 84 causes the attached left vacuum subassembly 90 to slidably travel along the left guide rods 81 and 82.

Figure 4:
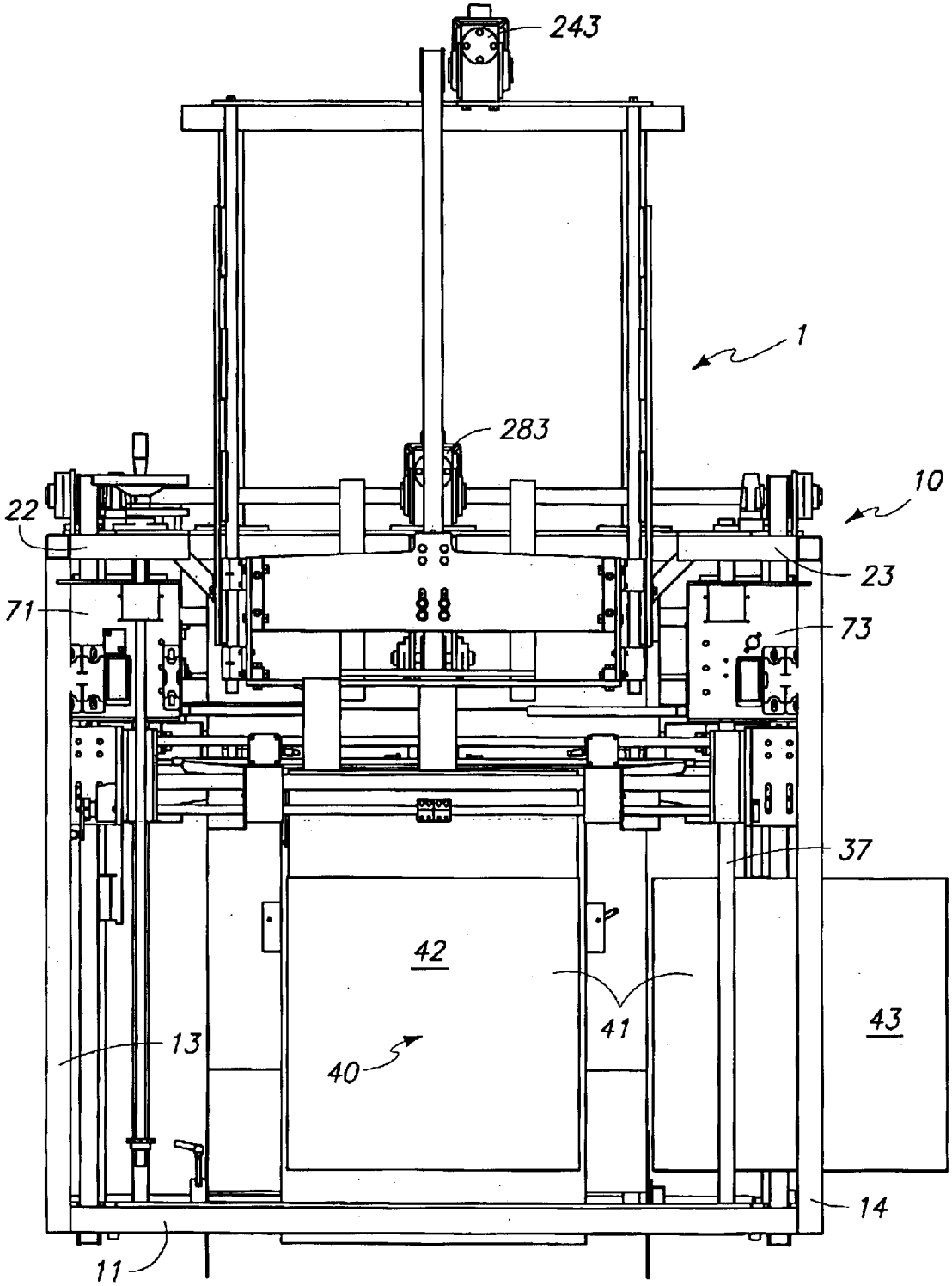
FIG. 4 is a front elevational view of the packaging liner insertion apparatus of FIG. 1.

Referring again to FIGS. 1 and 5–8, the upper adjusting handle 110 is shown positioned above the front left mounting plate 71. The upper adjusting handle 110 is securely connected to the front vacuum assembly adjustment rod 111. As best seen in FIGS. 4 and 5, the front adjustment rod 111 extends downward through the front left mounting plate 71 where it is slidably coupled to allow height adjustment. As shown, the front adjustment rod 111 is threadably coupled with front threadable height coupler 118. The lower end 112 of the front vacuum assembly adjustment rod 111 extends downward toward the lower front frame mounting plate 19.

As shown in FIGS. 5–8, vertical adjustment chain or belt 113 is operably coupled with the upper adjusting handle 110, 50 that turning the upper adjusting handle will cause the vertical adjustment chain 113 to move. As best seen in FIG. 5, the vertical adjustment chain 113 is further operably coupled with a first adjustment sprocket 114, a second adjustment sprocket 115, and a third adjustment sprocket 116. The third adjustment sprocket 116 is securely affixed to the rear vacuum assembly adjustment rod 117. The rear vacuum assembly adjustment rod 117 extends downward through the back left mounting plate 72. It is also movably coupled to allow height adjustment, and threadably couples with rear threadable coupler 119. After passing through the rear threadable coupler 119, the rear vacuum assembly adjustment rod 117 extends further downward toward the lower rear mounting plate 20.

When the upper adjusting handle 110 is manually turned, the attached front vacuum assembly adjustment rod 111 will also turn, and the vertical adjustment chain 113 will also be put in motion. Movement of the vertical adjustment chain 113 will cause the third adjustment sprocket 116 and attached rear vacuum assembly adjustment rod 117 to rotate. Therefore, when the upper adjusting handle 110 is turned, both the front vacuum assembly adjustment rod 111 and rear vacuum assembly adjustment rod 117 will turn simultaneously. By simultaneously turning the front and rear vacuum assembly adjustment rods 111 and 117 which threadably mate with the respective threadable vacuum couplers 118 and 119, the vacuum assembly 70 may be controllably raised or lowered. Thus providing a vertical position operator which can be adjusted to a desired operating height.

As shown best in FIG. 5, the vacuum assembly 70 includes first, second, third and fourth linear bearings 176, 177, 178 and 179 which are located near the four corners of the vacuum assembly 70. These linear bearing are respectively securely affixed to the four mounting plates 71, 72, 73 and 74 which roughly define the four corners of the vacuum assembly 70. The first, second, third and fourth frame guide rods 36, 37, 38 and 39 (FIG. 1) are slidably received within the respective linear bearings at each corner of the vacuum assembly 70 as shown in FIG. 1. As the height of the vacuum assembly 70 is adjusted, the vacuum assembly 70 slidably moves up or down along these four frame guide rods 36, 37, 38 and 39. This vertical adjustment allows the apparatus 1 to accommodate a variety of container sizes, specifically container heights.

Now referring to FIGS. 5 and 8, the front right mounting plate 73 and the back right mounting plate 74 are also connected by several structures, including a right side frame support 140 which securely attaches the front right mounting plate 73 to the back right mounting plate 74. A top right guide rod 141 and a bottom right guide rod 142 also extend between the front right mounting plate 73 and the back right mounting plate 74. These right guide rods 141 and 142 are designed to slidably receive the right movable vacuum subassembly which is described in detail below. As best seen in FIG. 5, a front right pulley 143 is attached to the front right mounting plate 73 so that it may freely rotate. The front right pulley 143 is operably coupled with a right vacuum drive belt 144 which extends to and is operably coupled with a back right pulley 145. As shown in FIG. 5, the back right pulley 145 is attached to the back right mounting plate 74.

Referring again to FIGS. 5 and 8, and referring more to FIG. 8, the right movable vacuum subassembly is generally designated by the numeral 150. The right movable vacuum subassembly 150 includes a right vacuum drive belt clamp 151 which secures the right arm guide 152 to the right vacuum drive belt 141. The right horizontal vacuum mounting segment 153 is securely attached to the right arm guide 152, and extends horizontally therefrom. The right vertical vacuum mounting segment 154 is attached to the right horizontal vacuum mounting segment 153, and extends downwardly therefrom. The right vacuum connector 155 serves to securely couple the right vacuum mounting segment 154 to the movable right vacuum head 160.

Some of the components of the right movable vacuum subassembly are not shown in the fragmentary drawing of FIG. 5, as portions of the right movable vacuum subassembly have been removed to make the underlying structures visible. Therefore, some of these components are best seen in FIG. 8. However, the reader should appreciate that the right movable vacuum subassembly is essentially a mirror image of the left movable vacuum subassembly which is shown in FIG. 5. When the right vacuum drive belt 144 is put in motion, the attached right vacuum subassembly 150 including the attached movable right vacuum head 160 will slidably move along the top and bottom right guide rods 141 and 142.

Referring once again to FIGS. 5–8, the structures which are located at the rear of the U-shaped vacuum assembly which join the right and left halves of the vacuum assembly 70 will now be described. The back left mounting plate 72 and the back right mounting plate 74 are rigidly connected by a first rear cross member 166 and the second rear cross member 167 as shown. These cross members 166 and 167 are best observed in FIGS. 5 and 8. A first cross brace 168, and a second cross brace 169 serve to securely connect and stabilize the first and second rear cross members 166 and 167.

As best shown in FIGS. 5–9, a vacuum assembly drive axle 170 also spans the distance between the back left mounting plate 72 and the back right mounting plate 74 and is securely attached to the back left and back right pulleys 85 and 145. Rotational movement of the vacuum assembly drive axle 170 is driven by the vacuum assembly actuator or vacuum head operator 171 (FIG. 1). In the preferred embodiment, the vacuum assembly actuator 171 is a servomotor. However, in other embodiments pneumatic cylinders or other appropriate actuating means or actuators may be utilized.

The vacuum assembly actuator 171 may be operated to controllably cause the vacuum assembly drive axle 170 to rotate in either clockwise or a counterclockwise directions. Rotation of the vacuum assembly drive axle 170 causes the attached back left and back right pulleys 85 and 145 to rotate similarly. This rotation of the back left and back right pulleys 85 and 145 in turn drives the left and right vacuum drive belts 84 and 144, causing them to be put in motion. As the left and right vacuum drive belts 84 and 144 are controllably driven by the vacuum assembly actuator 171, the left and right movable vacuum assemblies 90 and 150 may be controllably moved along the respective left and right guide rods. The left movable vacuum assembly 90 travels along the top and bottom left guide rods 81 and 82 which are slidably received or otherwise engaged by the left movable vacuum assembly 90. The right movable vacuum assembly 150 travels along the top and bottom right guide rods 141 and 142 which are similarly slidably received or otherwise engaged by the right movable vacuum assembly 150.

Now referring to FIGS. 5–8, the back vacuum subassembly is generally indicated by the numeral 185. As mentioned above, in the preferred embodiment, the vacuum assembly 70 has an approximately U-shaped configuration and subframe as viewed from above. This arrangement allows a translating, movable vacuum head to travel along each side. Two rear vacuum heads are positioned near the base of the U-shaped framework. The back vacuum subassembly 185 including these two rear vacuum heads will be described in detail hereinafter.

Referring to FIGS. 5–8, the top brace 186 of the back vacuum subassembly 185 is securely attached to the first and second rear cross members 166 and 167. The upper body 187 is attached to the lower surface of the top brace 186 and extends downwardly. The lower body 189 is pivotally attached to the upper body 187 at pivot joint 188. This pivotal attachment 188 allows the two rear vacuum heads to pivotally move. The movement facilitates the separation, opening and positioning of the flexible bags. Stationary positioning may also be acceptable. During opening of a liner, the head will retract rearward and downward. The degree of vertical motion will depend in sense and magnitude upon the relative height of the vacuum head 210 compared to pivot 188.

As best seen in FIG. 7, a tilt brace 193 securely attaches the upper body 187 to the rear vacuum assembly tilt actuator 194. The rear vacuum assembly tilt actuator 194 may be controllably extended or contracted to move the rear tilt connector 195, exerting force against the rear tilt connector 195 and causing the lower body 189 to pivot at the pivot joint 188.

Figure 6:
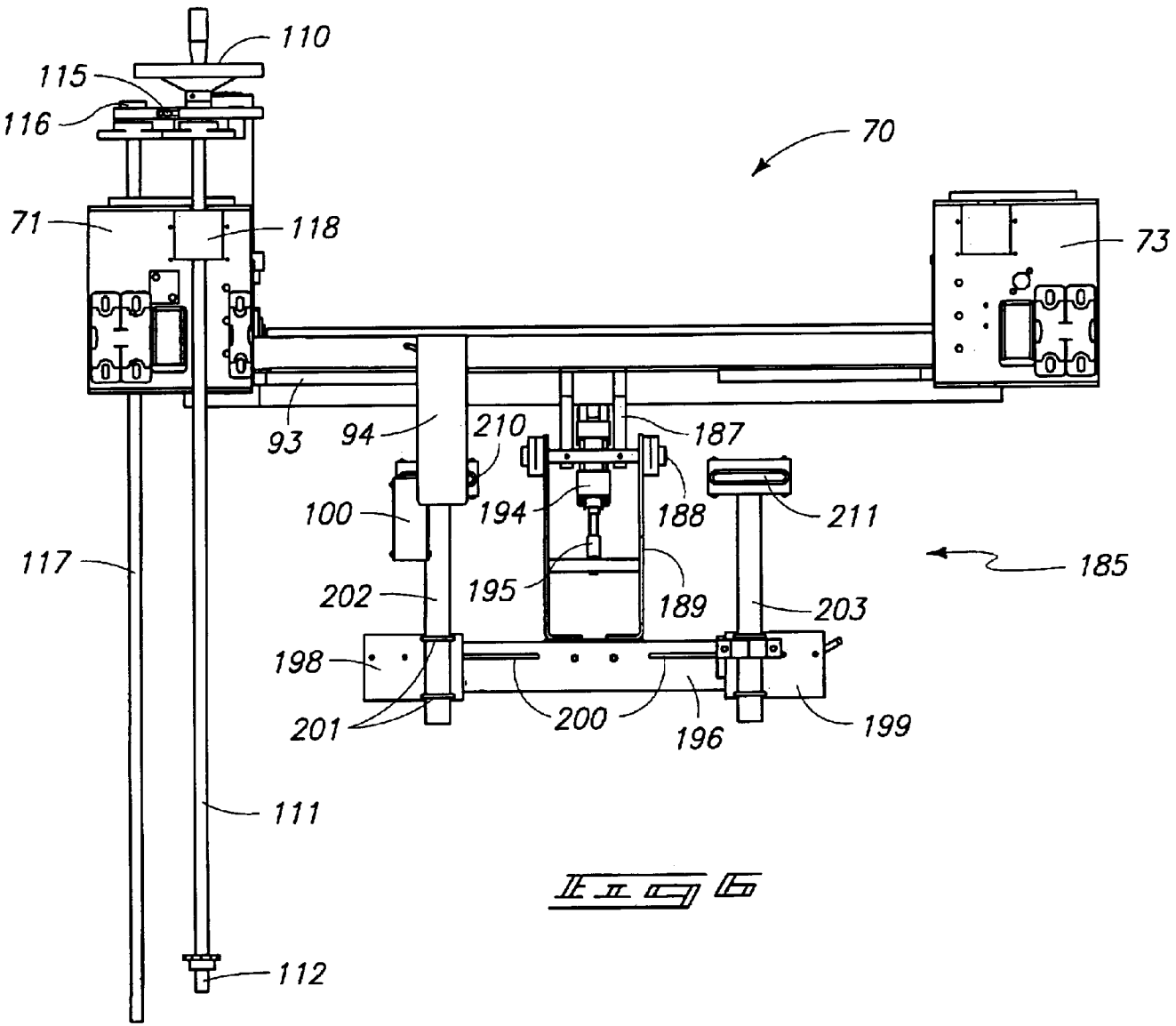
FIG. 6 is a front elevational view showing portions of the vacuum engagement assembly utilized in the packaging liner insertion apparatus of FIG. 1.

Referring now to FIGS. 6 and 7, the lower body 189 is shown to be attached to the rear horizontal vacuum segment 196. As shown in the illustrations, the rear horizontal vacuum segment 196 is also attached to a pneumatic actuator 197. Pneumatic actuator 197 may be controllably extended or retracted to move the left and right rear vacuum heads 210 and 211 forwardly or rearwardly. This facilitates the positioning of the flexible bags which are to be inserted into a container. The left and right rear vacuum head mounting plates 198 and 199 are also attached to the rear horizontal vacuum segment 196.

As best shown in FIG. 6, two horizontal slots 200 are present in the rear horizontal vacuum mounting piece 196. These horizontal slots 200 allow the position of the left and right rear vacuum head mounting plates 198 and 199 to be slidably adjusted and secured at various positions along the rear horizontal vacuum mounting piece 196 to adjust the distance between the rear vacuum heads. Clamps 201 are shown to attach the left and right rear vacuum head mounting plates 198 and 199 to the respective left and right vertical vacuum tubes 202 and 203. As best seen in FIG. 6, the left rear vacuum head 210 is attached to the left vertical vacuum tube 202, while the right rear vacuum head 211 is similarly attached to the right vertical vacuum tube 203.

Referring now to FIG. 7, the operation of the rear vacuum assembly or head tilt actuator 194 is described. When the rear vacuum head tilt actuator 194 is extended or contracted, it will exert force against the tilt actuator connector 195, causing the lower body 189 to pivot at pivot joint 188. This pivotal movement causes the two rear vacuum heads to move. When operator 194 is contracted, the heads move backwards and downwards to facilitate the separation, positioning and opening of the flexible bags which are received in the container receiving area. When operator 194 is extended the heads move in the opposite manner forward and upward to engage a liner.

The Insertion Assembly

Referring now to FIGS. 1, 9, 10 and 11, the insertion assembly is generally indicated by the numeral 230. As shown in the figures, the insertion assembly 230 is securely positioned on top of the main framework 10, and is attached to the upper rear frame mounting plate 35. A left inserter vertical member 231 and a right inserter vertical member 232 extend vertically upward from the upper rear frame mounting plate 35 to which they are securely affixed. A left inserter guide rod 233 is positioned in front of the left inserter vertical member 231, and is securely attached to the left inserter vertical member 231 by a left side plate 234. Similarly, a right inserter guide rod 235 is positioned in front of the right inserter vertical member 232, and is similarly attached to the right inserter vertical member 232 by a right side plate 236.

Figure 11:
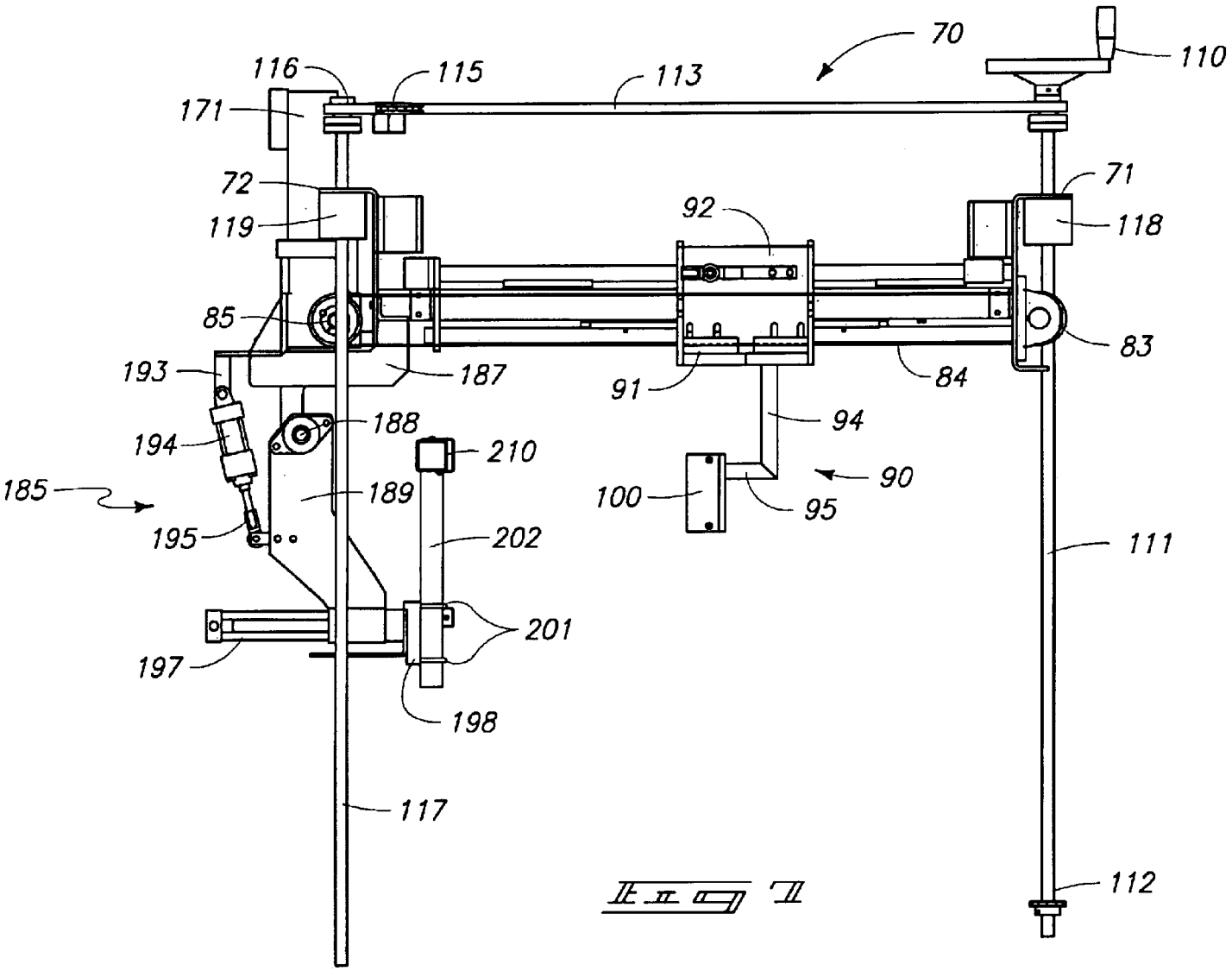
FIG. 11 is a front view showing portions of the packaging liner insertion apparatus of FIG. 1, again emphasizing the cuffing and insertion assemblies.
Figure 9:
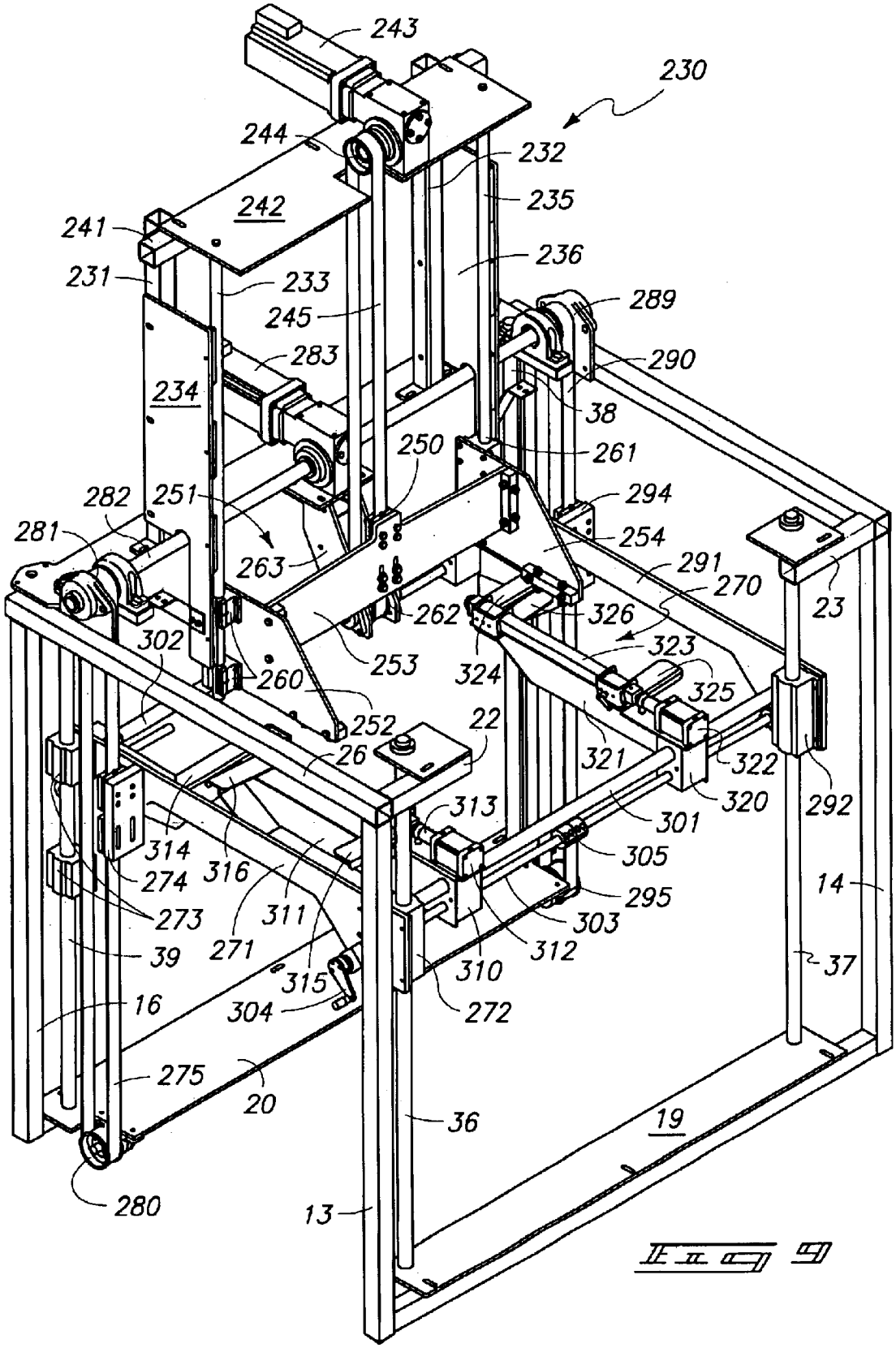
FIG. 9 is a perspective view showing portions of the packaging liner insertion apparatus of FIG. 1, emphasizing the cuffing and insertion assemblies.

Referring to FIGS. 9 and 11, an inserter horizontal member 241 extends between and is securely attached to the upper ends of the left inserter vertical member 231 and a right inserter vertical member 232. As shown best in FIGS. 9 and 12, a top plate 242 covers and is securely affixed to the inserter horizontal member 241. This top plate 242 is also securely attached to the upper ends of the left and right inserter guide rods 233 and 235.

Again referring to FIGS. 1, 9, 10 and 11, an inserter actuator 243 is securely mounted on the top plate 242. In the preferred embodiment, the inserter actuator 242 is a servomotor. However, in other embodiments pneumatic cylinders or other appropriate actuating means may be utilized. The inserter actuator 243 drives a top pulley 244, causing the top inserter pulley 244 to controllably rotate. The inserter actuation mechanism also uses a drive belt 245 which is supported by pulley 244 and lower pulley 262. As shown best in FIGS. 9 and 11, an inserter drive belt clamping device 250 is securely attached to the inserter drive belt 245. The inserter drive belt clamping device 250 is also securely attached to the inserter support body generally indicated by the numeral 251.

Figure 10:
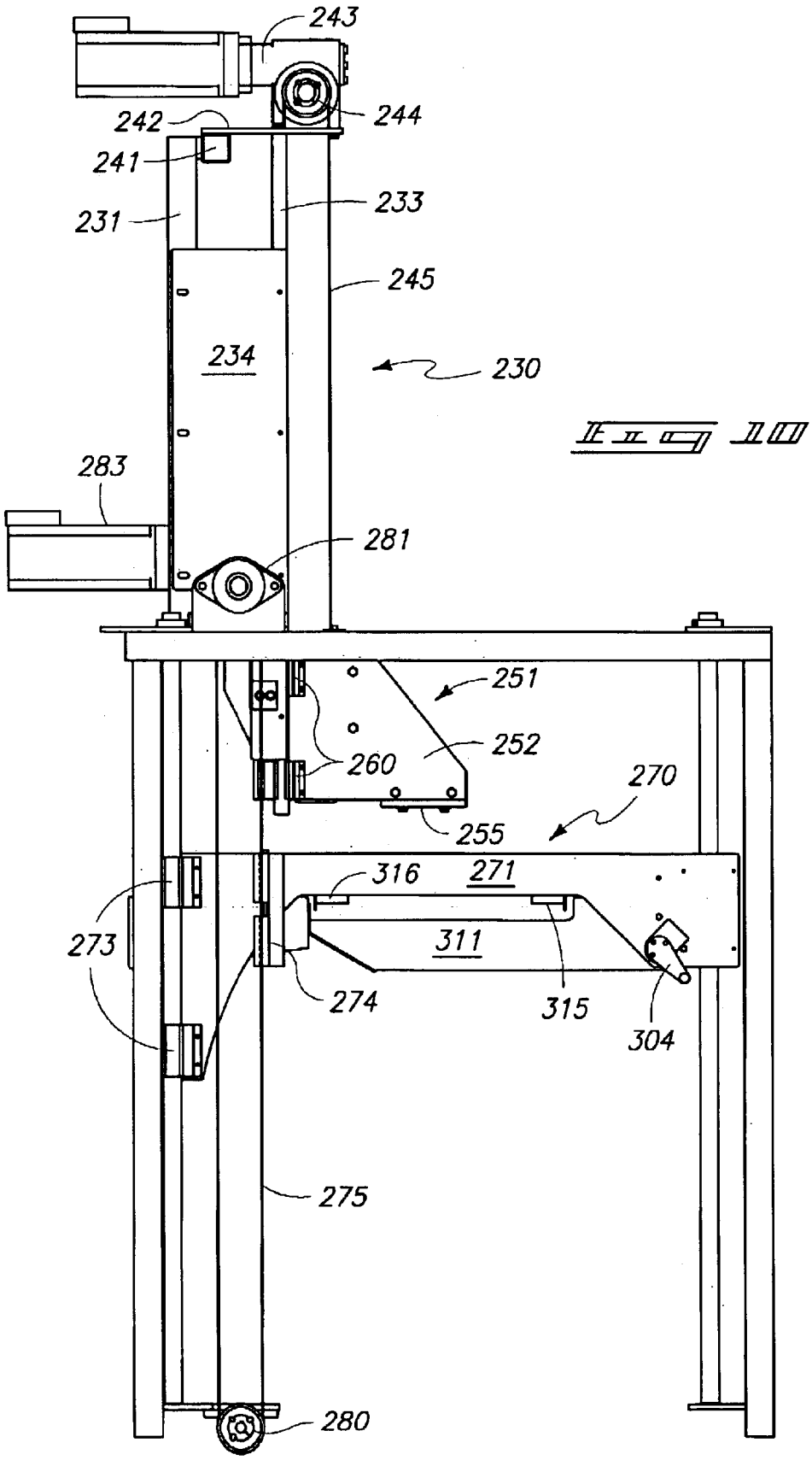
FIG. 10 is a side elevational view of portions of the packaging liner insertion apparatus of FIG. 1, also emphasizing the cuffing and the insertion assemblies.
Figure 11:
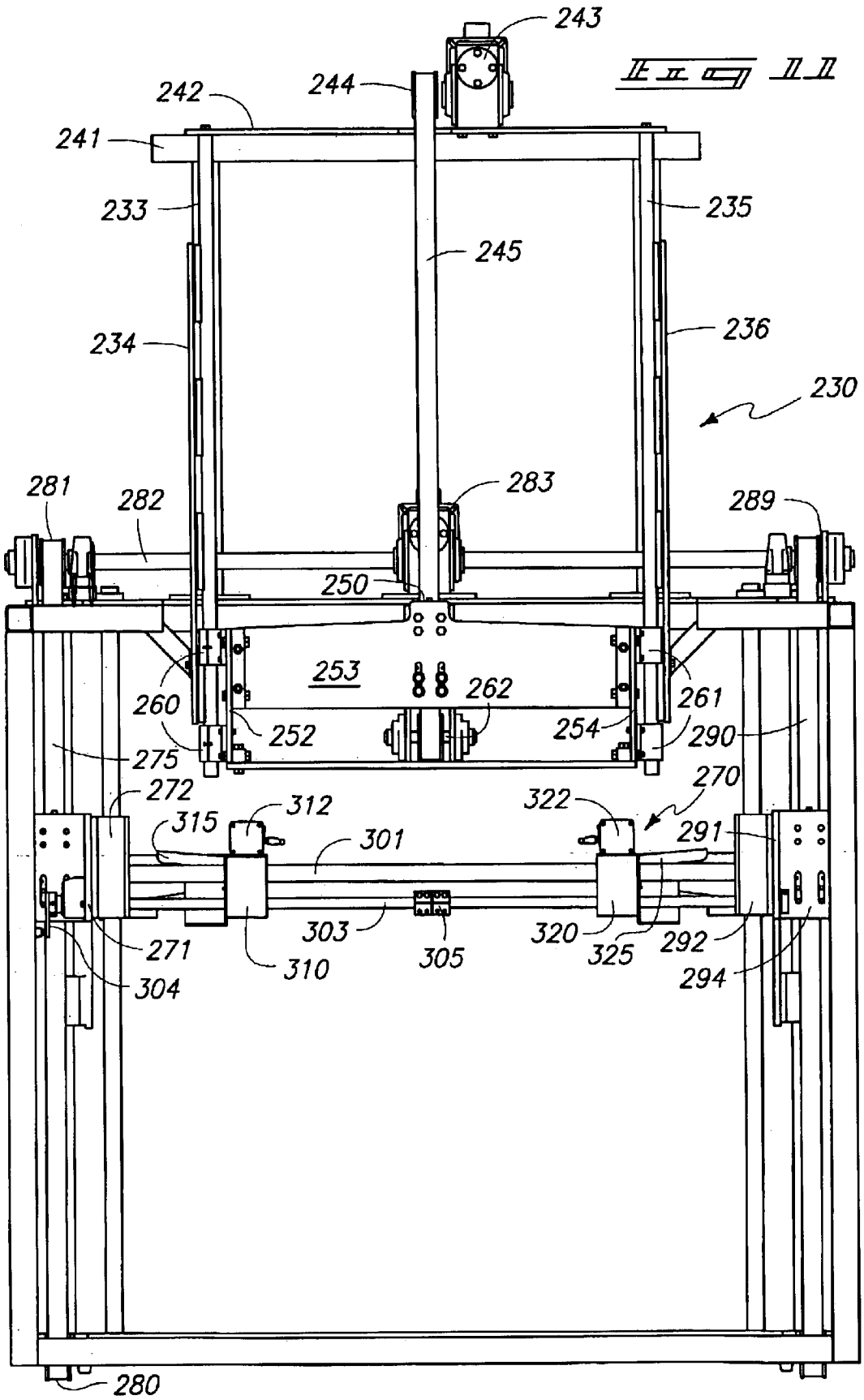

Referring to FIG. 9, the inserter support body 251 includes: a left inserter support piece 252, a back inserter support piece 253, and a right inserter support piece 254 each of which are securely joined to form a unitary inserter support body 251. As shown in FIGS. 9, 10 and 11, left inserter linear bearings 260 are attached to the outside surface of the left inserter support piece 252. These left inserter linear bearings 260 slidably couple with the left inserter guide rod 233. Similarly, as best seen in FIG. 11, right inserter linear bearings 261 are attached to the outer surface of the right inserter support piece 254. The right inserter linear bearings 261 slidably couple with the right inserter guide rod 235.

Referring to FIGS. 9, 10 and 11, the lower end of the inserter drive belt 245 is supported and trained about a lower inserter drive pulley 262. As best seen in FIG. 9, the lower inserter drive pulley 262 is securely attached to lower inserter mounting bracket 263. The lower inserter mounting bracket 263 is securely affixed to the upper rear frame mounting plate 35. The inserter support body 251 is vertically movable and is driven by the inserter actuator 243 using inserter drive belt 245. In the preferred embodiment, the insertion assembly 230 also includes a mandrel 330 (FIG. 13) which is securely attached to the inserter support body 251 at the mandrel mounting surface 255 (FIG. 10).

As the inserter support body 251 and any attached mandrel travel downwardly, the mandrel will engage an opened flexible bag which is to be inserted into a container positioned in the loading position within the container receiving area. A flexible bag being inserted will previously have been engaged and readied for insertion by the vacuum assembly 70. The descending mandrel will enter the flexible bag as the mandrel and inserter support body 251 travel downward. As the mandrel and flexible bag continue to move downward, the flexible bag will be inserted into the container located in the loading position of the container receiving area 40.

The Cuffing Assembly

Referring now to FIGS. 9–12, the cuffing assembly is generally indicated by the numeral 270. The cuffing assembly 270 has a framework which is vertically movable relative to the main framework 10. As shown, the cuffing assembly framework is rectangularly shaped about the container liner loading position. In the preferred embodiment, the cuffing assembly 270 engages the flexible bag which is to be inserted before the insertion assembly 230 moves from the retracted to the extended positions. The cuffing assembly 270 functions to spread the open end of the flexible bag which is to be inserted into the container. It also functions to invert portions of the open end of the flexible bag over the top edges of the container, thereby cuffing the flexible bag over the container walls. In the preferred embodiment, cuffing of the flexible bag occurs nearly simultaneously with the insertion process as the mandrel moves from the retracted to the extended position.

As best seen in FIGS. 9 and 10, the cuffing assembly 270 includes a left side brace 271 to which a left front cuffing assembly linear bearing 272 and left rear cuffing assembly linear bearings 273 are securely attached. The left front cuffing assembly linear bearing 272 matingly and slidably couples with the first frame guide rod 36. The left rear cuffing assembly linear bearings 273 are matingly and slidably coupled with the fourth frame guide rod 39.

Referring to FIGS. 9 and 10, the left side brace 271 is shown to be securely attached to a left cuffing assembly belt clamp 274. The left cuffing assembly belt clamp 274 is tightly clamped to the left cuffing assembly drive belt 275 so that the left side brace 271 will move with the left cuffing assembly drive belt 275. The left cuffing assembly drive belt 275 extends downwardly to the lower left cuffing assembly pulley 280 and upwardly to the upper left cuffing assembly pulley 281.

As shown best in FIGS. 9 and 11, the left cuffing assembly pulley 281 is affixed to the cuffing assembly drive shaft 282. The cuffing assembly drive shaft 282 is driven by cuffing actuator or actuating means 283. In the preferred embodiment, the cuffing actuator 283 is a servomotor. However, in other embodiments a pneumatic operator or other appropriate actuating means may be utilized.

The cuffing assembly actuator 283 and drive shaft 282 also drive the upper right cuffing assembly pulley 289 which is securely affixed to the opposite end of the cuffing assembly drive shaft 282. The upper right cuffing assembly pulley 289 is further operably coupled with the right cuffing assembly drive belt 290.

Referring now to FIG. 9, the cuffing assembly 270 also includes a right side brace 291 to which a right front cuffing assembly linear bearing 292 and right rear cuffing assembly linear bearings (not shown) are securely attached. The right front cuffing assembly linear bearing 292 matingly and slidably couples with the second frame guide rod 37. The right rear cuffing assembly linear bearings (not shown) matingly and slidably couple with the third frame guide rod 38.

As shown in FIG. 9, the right side brace 291 is securely attached to a right cuffing assembly belt clamp 294. The right cuffing assembly belt clamp 294 is securely clamped to the right cuffing assembly drive belt 290. The right cuffing assembly drive belt 290 extends downwardly from the upper right cuffing assembly pulley 289 to the lower right cuffing assembly pulley 295 to which it is operably coupled. The drive belt 290 is trained about and supported by pulleys 289 and 295.

When the cuffing actuator 283 is activated, it will turn the cuffing assembly drive shaft 282, causing it to controllably rotate in either a clockwise or counterclockwise direction. This controllable rotation of the cuffing assembly drive shaft 282 also causes the upper left and right cuffing assembly pulleys 281 and 289 which are affixed to the ends of the cuffing assembly drive shaft 282 to rotate. This rotation of the upper left and right cuffing assembly pulleys 281 and 289 in turn drives the left and right cuffing assembly drive belts 274 and 290, controllably raising or lowering the attached cuffing assembly 270.

Again referring to FIGS. 9–12, the left and right side bars 271 and 291 are advantageously connected by a front cuffing assembly rod 301, and by a rear cuffing assembly rod 302. The left and right side bars 271 and 291 are further connected by a front adjusting rod 303 which passes through the left side brace 271. Front adjusting rod 303 has a cuffing finger adjusting handle 304 located at its end. A cuffing assembly adjusting rod coupling 305 is located near the center of front adjusting rod 303 to couple the rod halves.

Referring again to FIGS. 9–12, a left cuffing finger guide block 310 is shown. The front cuffing assembly rod 301 and the front adjusting rod 303 pass through the left cuffing finger guide block 310. A left cuffing finger guide 311 extends rearwardly from the left cuffing finger guide block 310.

As shown best in FIG. 9, a left rotary actuator 312 is positioned on, and secured to the left cuffing finger guide block 310. A left pivot rod 313 extends from the left rotary actuator 312, eventually coupling with a left support brace 314. The left support brace 314 is adjustably attached to the left side brace 271 so that the position of the left pivot rod 313 may be adjusted horizontally to accommodate a variety of container sizes.

The first and second left cuffing fingers 315 and 316 are attached to pivot with the left pivot rod 313. Rotary actuator 312 is activated to pivot rod 313 and pivot the first and second left cuffing fingers 315 and 316. The cuffing fingers move between a first position which facilitates the initial placement of the flexible bag into the container in the container receiving area, and a second position in which the cuffing fingers are adapted to spread the open end of the flexible bag to facilitate cuffing the bag over the top edges of the container.

Referring again to FIGS. 9–12, a right cuffing finger guide block 320 is also shown. The front cuffing assembly rod 301 and the front adjusting rod 303 pass through the right cuffing finger guide block 320. A right cuffing finger guide 321 extends rearwardly from the right cuffing finger guide block 320 as shown. As shown best in FIG. 9, a right rotary actuator 322 is positioned on, and secured to the right cuffing finger guide block 320. A right pivot rod 323 extends from the right rotary actuator 322, eventually coupling with a right support brace 324. The right support brace 324 is adjustably attached to the right side brace 291 so that the position of the right pivot rod 323 may be adjusted horizontally to accommodate a variety of container sizes.

Figure 12:
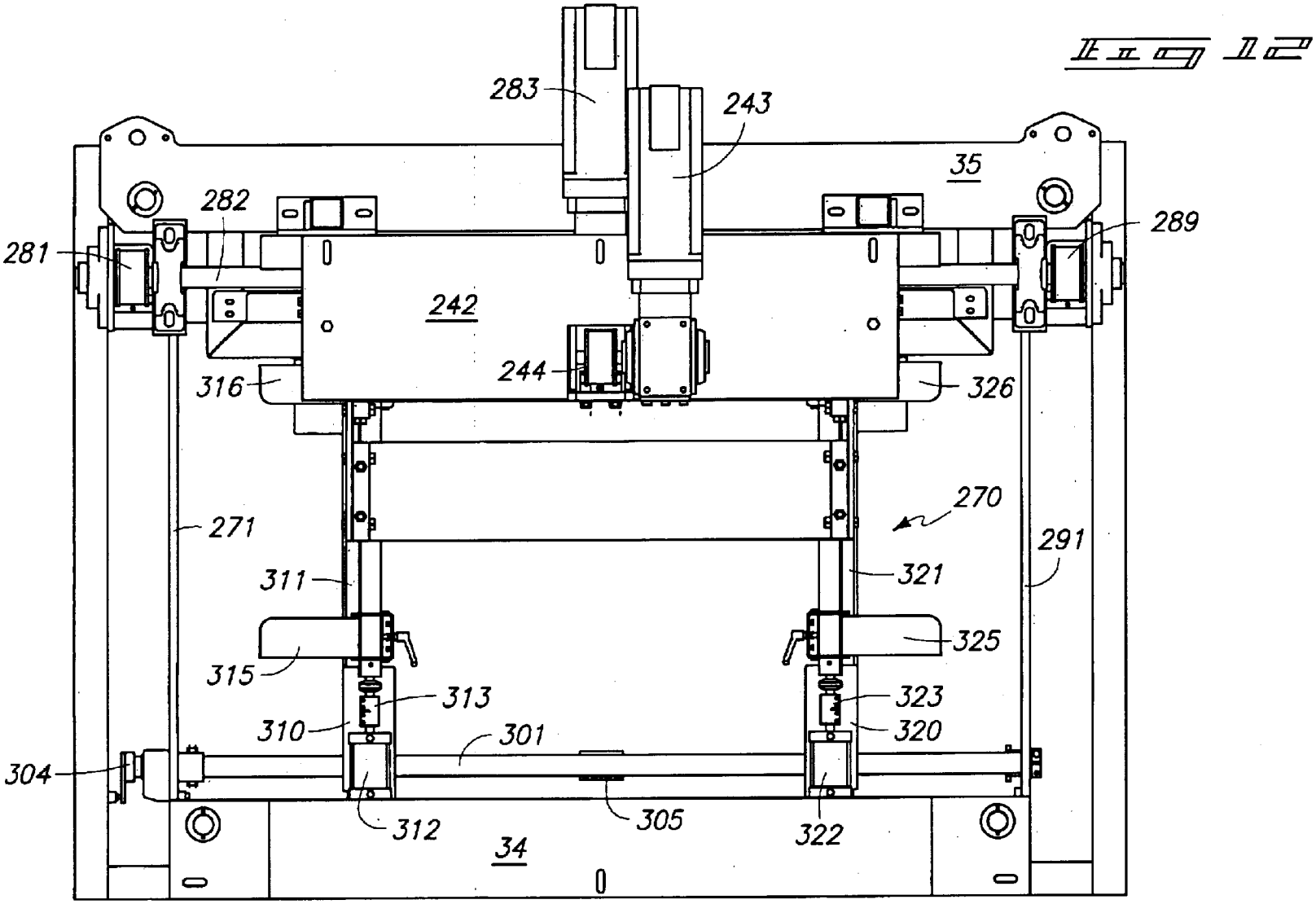
FIG. 12 is a top view showing portions of the packaging liner insertion apparatus, emphasizing the cuffing assembly.

Referring still to FIGS. 9 and 12, the first and second right cuffing fingers 325 and 326 are attached to the right pivot rod 323. When right rotary actuator 322 is activated, the right pivot rod 323 will controllably rotate to move the first and second right cuffing fingers 325 and 326 between a first position which facilitates the initial placement of the flexible bag for insertion into the container in the container receiving area, and a second position in which the cuffing fingers are adapted to spread the open end of the flexible bag to facilitate cuffing the bag over the top edges of the container.

Referring now to FIGS. 9 and 11, the horizontal spacing adjustment of the cuffing fingers is described hereinafter. As shown, the cuffing finger adjusting handle is positioned on the left side of apparatus 1. When the cuffing finger adjusting handle 304 is manually turned, the front adjusting rod 303 turns. Threaded followers within unit 310 and 320 cause the unit to move inward and outward in opposite directions as the cuffing finger adjusting handle 304 is turned. Coupling 305 couples two halves of shaft 303 together. This adjustment mechanism adjusts the horizontal distance separating the first and second left cuffing fingers 315 and 316 from the first and second right cuffing fingers 325 and 326. By adjusting this distance, the cuffing assembly 270 may be adjusted to accommodate a variety of container sizes.

The Mandrel

Figure 13:
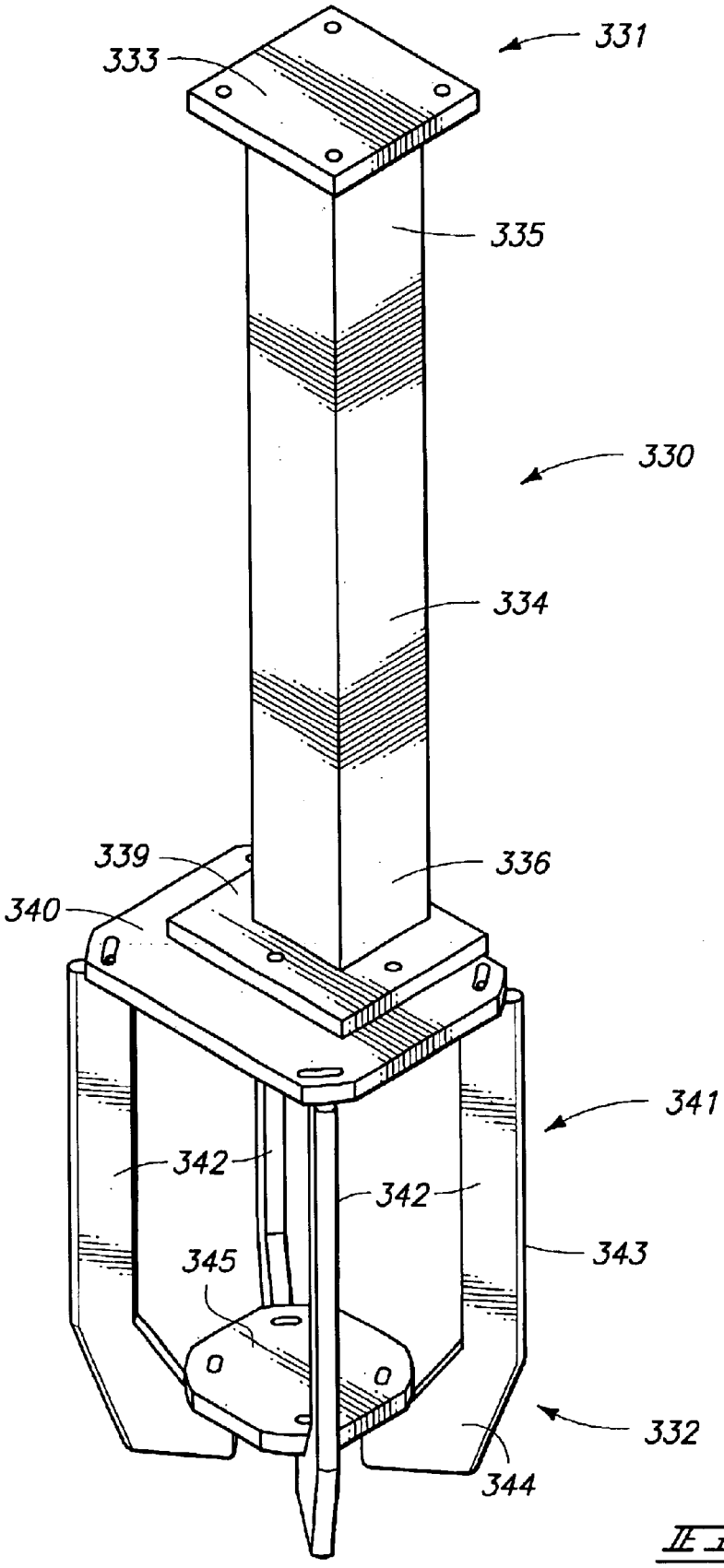
FIG. 13 is a perspective view showing a mandrel utilized with the packaging liner insertion apparatus of FIG. 1.
Figure 11:
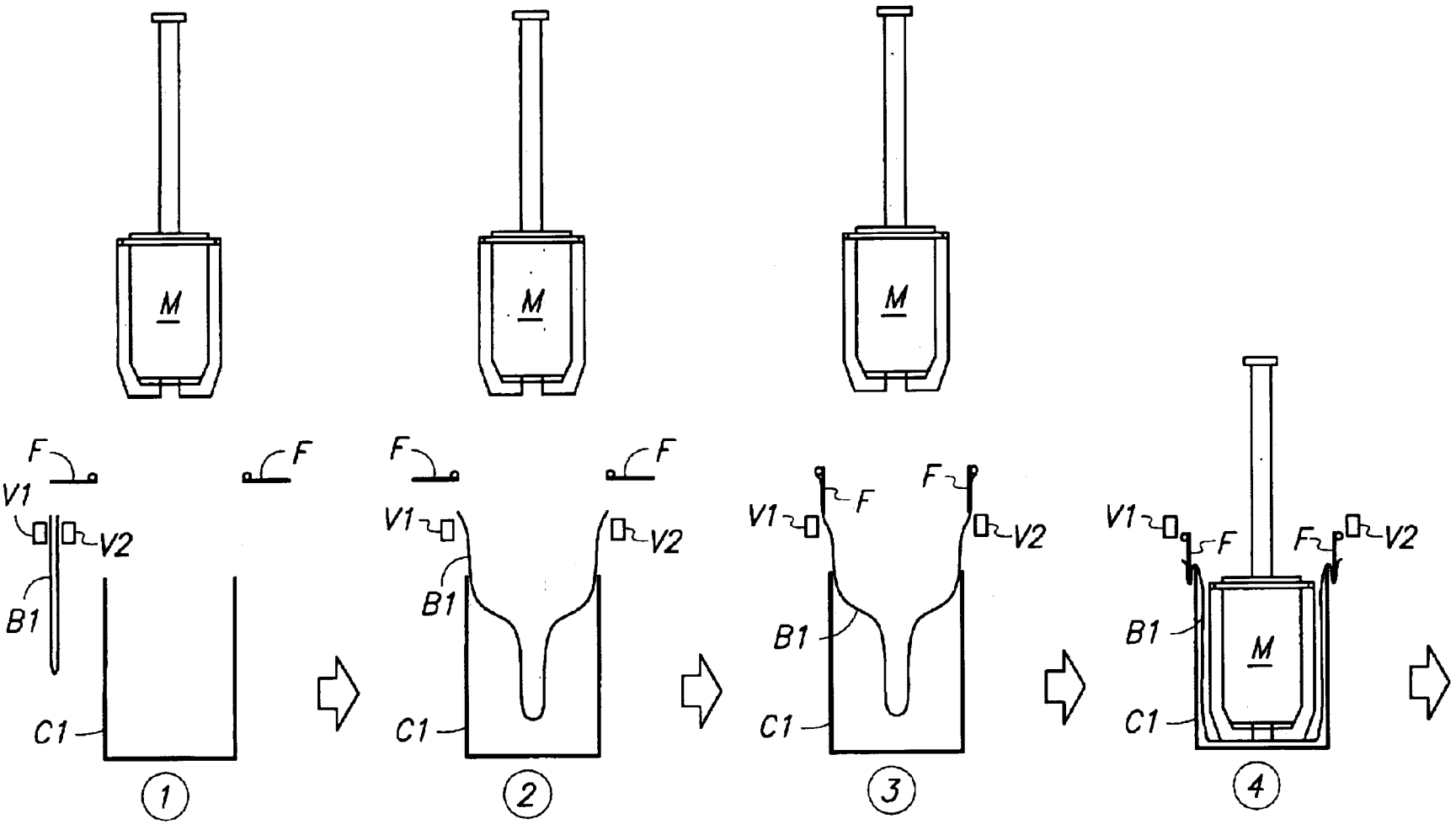
Figure 11:
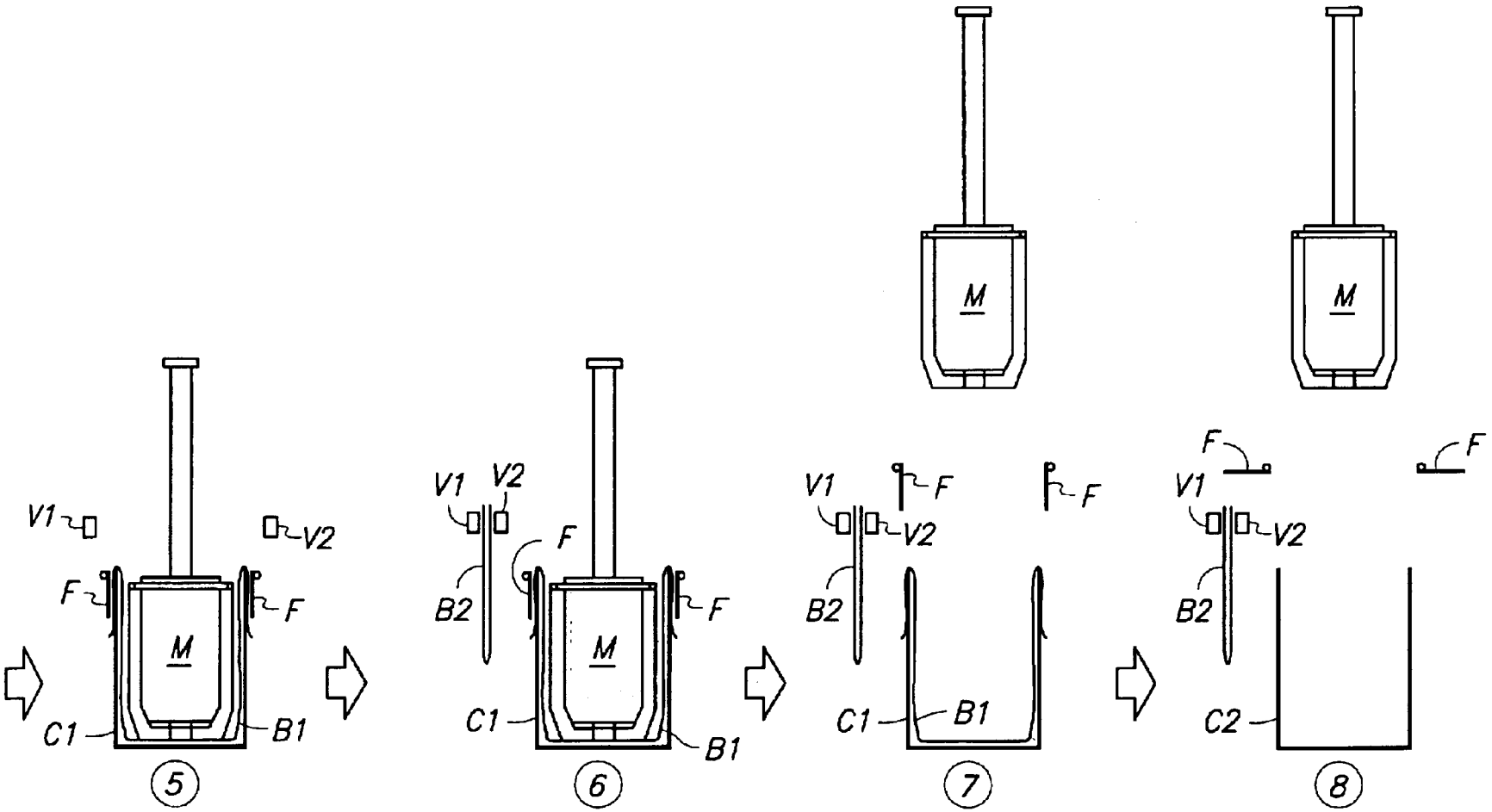

Now referring to FIGS. 1, 10 and 13, in a preferred embodiment, the apparatus of the present invention 1 includes a mandrel generally indicated by the numeral 330. Mandrel 330 has a mounting end 331 and an insertion end 332. A mandrel mounting plate 333 is positioned at the mounting end 331 of mandrel 330. The mounting plate 333 functions to securely attach the mandrel 330 to the mandrel mounting surface 255 of the inserter support body 251 (FIG. 10).

Referring now to FIG. 13, a mandrel support member 334 having first and a second ends 335 and 336 is shown. The first end 335 of the mandrel support member 334 is rigidly affixed to the mounting plate 333 and extends therefrom. The second end 336 of the mandrel support member 334 is securely affixed to the lower mandrel mounting plate 339. The lower mandrel mounting plate 339 is securely attached to the upper surface of the mandrel head plate 340.

Still referring to FIG. 13, in a preferred embodiment, the mandrel head 341 is constructed from a plurality of diagonal plates 342 which are adapted to individually angle into the corners of the receiving cartons 41 (FIG. 1). Each of the diagonal plates has a vertical portion 343 and an angled or tapered lead portion 344. Each of the angled lead portions 344 are advantageously secured to a central block 345, which is positioned near the insertion end 332 of mandrel 330.

In addition to the preferred embodiment described above, to accommodate a variety of packaging needs, mandrels of various shapes and sizes may be attached to the inserter support body 251. For example, other embodiments may utilize mandrels of various shapes to achieve the required fit for effective bag placement in cartons, drums, pails and other containers. In special applications, a custom made mandrel may be constructed and utilized. The particulars will vary depending on the size and shape of the container, and the size and shape of the bag or other liner which is to be inserted into the container. In one embodiment, a mandrel which discharges air to facilitate placement of the flexible bag into a container may be utilized. In other embodiments, a bullet shaped mandrel or bullet mandrel which discharges air as it enters the flexible bag may be utilized. Other mandrels can also be used, including other mandrels which discharge air or other suitable fluids.

Overview of the Process

Turning now to FIGS. 14A and 14B, simplified diagrammatic representation of a preferred method according to the present invention is shown. The method of inserting flexible bags into packaging cartons or other containers preferably includes one or more in combination of the steps: supplying cartons or containers to a container receiving area; dispensing flexible bags from a bag dispenser to a position adjacent to the container receiving area for insertion of the flexible bags into the containers; moving at least one moveable vacuum head to the bag dispenser to engage a flexible bag; engaging the flexible bag with the at least one movable vacuum head so that the flexible bag may be positioned for insertion into the container positioned in the container receiving area; moving the at least one movable vacuum head to position the flexible bag for insertion into the container positioned in the container receiving area; inserting the flexible bag into the container positioned in the container receiving area using an insertion apparatus having a mandrel; and moving the at least one movable vacuum head to the bag dispenser and into engagement with a subsequent flexible bag supplied by the bag dispenser while the mandrel is in an extended position having inserted the flexible bag into the container positioned within the container receiving area.

In a preferred embodiment, the method includes moving two movable vacuum heads to engage a flexible bag supplied by the bag dispenser, and utilizing two rear or relatively small movement vacuum heads to assist the greater moveable vacuum heads in engaging the flexible bag, separating the flexible bag from the supply role, and positioning the flexible bag for insertion into a container. However, other embodiments may include utilizing one or more movable vacuum head, and utilizing one or more rear or relatively small movement vacuum heads.

For the sake of clarity, the simplified diagrammatic representation of FIGS. 14A and 14B show only one movable vacuum head, and only one rear or relatively small movement vacuum head. This should be understood to show single heads or the more preferred plural heads at one or both sides and front or back locations. The diagrams illustrate the method at select locations. As shown, the method is illustrated at eight preferred steps numbered 1–8, for convenience. Each of the steps described below refers to FIGS. 14A and 14B.

Step 1 shows a container C1 which has been supplied to the container receiving area. The top end of the container C1 is open so that a flexible bag B1 may be inserted into the container C1, and the open end of the flexible bag B1 cuffed over the top edges of the container C1. The diagram also shows a rear vacuum head V1 and a significantly movable opening vacuum head V2 which is relocated to open the bag or liner. As shown in the diagram, the vacuum heads V1 and V2 have engaged the flexible bag B1 which has been supplied by the bag dispenser (not shown) so that they may position and open the flexible bag B1. The positioning and opening is preferably performed as a precursor to inserting the bag or liner into the open container C1.

The step 1 diagram also shows a mandrel M in the retracted position above the container C1. As shown, the mandrel M is axially aligned with the open container C1 below. Further, the diagram shows the preferred cuffing fingers F in a first position. In such first position the cuffing fingers are retracted to allow opening of the bag to facilitate initial insertion of the flexible bag B1 into the container C1.

Step 2 shows that the movable vacuum head V2 has moved from the left to the right performing a separating step relative to head V1 to effect an opening of the bag or liner. When opened, the flexible bag B1 is positioned and ready for insertion into container C1 positioned below in the working position of the receiving area. As shown, rear vacuum head V1 has moved to assist in positioning the flexible bag B1 for insertion into the container C1. The diagram also shows mandrel M which is still in the retracted position above container C1. Still further, this diagram shows that the cuffing fingers F still in the first position or retracted position.

Step 3 shows cuffing fingers F rotated or otherwise moved to a second position. In the second position the cuffing fingers are moved bringing them to contact with the bag or liner, preferably along the upper reaches and adjacent the bag opening. In such position the cuffing fingers F are positioned to effect spreading the open end of the flexible bag B1. This spreading and positioning facilitates passing the mandrel thereby. This is also done in preparation for inverting the open end of the flexible bag B1 over the top edges of the container C1. The diagram also shows the mandrel M which is still in the retracted position above the container C1. As shown, the mandrel M is axially positioned in a position approximately aligned with the open container C1 below. Vacuum plenums V1 and V2 disengage from the bag by relieving vacuum pressures applied in a controlled manner. This is preferably done after the cuffing fingers have been rotated into the engaged position shown in step 3.

Step 4 shows the cuffing fingers F in a second engaging position in which the cuffing fingers F are adapted to not only spread the open end of the flexible bag B1 but are also descending or otherwise moving toward the container to start inverting the open end of the flexible bag B1 over the top edges of container C1. As shown in the drawing, the cuffing fingers F are moving downward and toward the container, as they cuff the flexible bag B1 over the top edges of the container C1.

The Step 4 diagram also shows mandrel M moving from the retracted position of Step 3 to an extended inserting position, moving downward to insert the flexible bag B1 into container C1 below. The inserting and cuffing of the flexible bag B1 occur simultaneously or nearly simultaneously.

Step 5 of FIG. 14B shows mandrel M in a fully extended position and the flexible bag B1 is fully inserted into container C1. The cuffing fingers F are also extended toward the container in a fully downward position as illustrated.

After the mandrel has been inserted or otherwise moved sufficiently into the container then the vacuum heads can begin being repositioned for operation upon the next bag or liner being processed. As shown, the vacuum heads V1 and V2 begin to return to their initial position so that a subsequent flexible bag B2 may be engaged after the mandrel has been inserted into the container.

Step 6 also shows the mandrel M in the fully extended position with the flexible bag B1 fully inserted into container C1. The cuffing fingers F still retain the edges of the bag. The vacuum heads V1 and V2 have returned to their initial locations and have engaged a subsequent flexible bag B2 which was supplied by the bag dispenser (not shown).

Step 7 shows the mandrel M, which has returned to its retracted position above the container C1. The vacuum heads V1 and V2 are in their initial locations and have engaged a subsequent flexible bag B2 supplied by the bag dispenser (not shown). As shown, the cuffing fingers F are now retracted from container C1 and begin to return to their first or retracted position.

Step 8 shows second or a subsequent container C2 which has been supplied to the container receiving area working position. The top end of the subsequent container C2 is open so that a flexible bag B2 may be inserted into the container C2 in a fashion the same or similar to the process described for placing a bag or liner in container C1. The open end of the flexible bag B2 may also be cuffed over the top edges of the container C2 in a similar fashion. The diagram also shows a rear vacuum head V1 and a movable vacuum head V2. As shown in the diagram, the two vacuum heads V1 and V2 have engaged the flexible bag B2 which has been supplied by the bag dispenser (not shown) so that they may position and open the flexible bag B2 for insertion into the open container C2. The diagram also shows mandrel M in the retracted position above the container C2. As shown, the mandrel M is axially aligned with the open container C2 below. Further, the diagram shows the cuffing fingers F in the first position to facilitate initial insertion of the flexible bag B2 into the container C2.

At this point a complete cycle has been completed. As shown, step 8 is similar to step 1. However, now a subsequent flexible bag B2 is to be inserted and cuffed in a subsequent container C2. This process may be sequentially repeated so that a plurality of flexible bags may be inserted into a plurality of containers and cuffed. As described above, the containers may be supplied to the container receiving area by a conventional conveyor belt or any other suitable means.

Clamping Assembly

Figure 15:
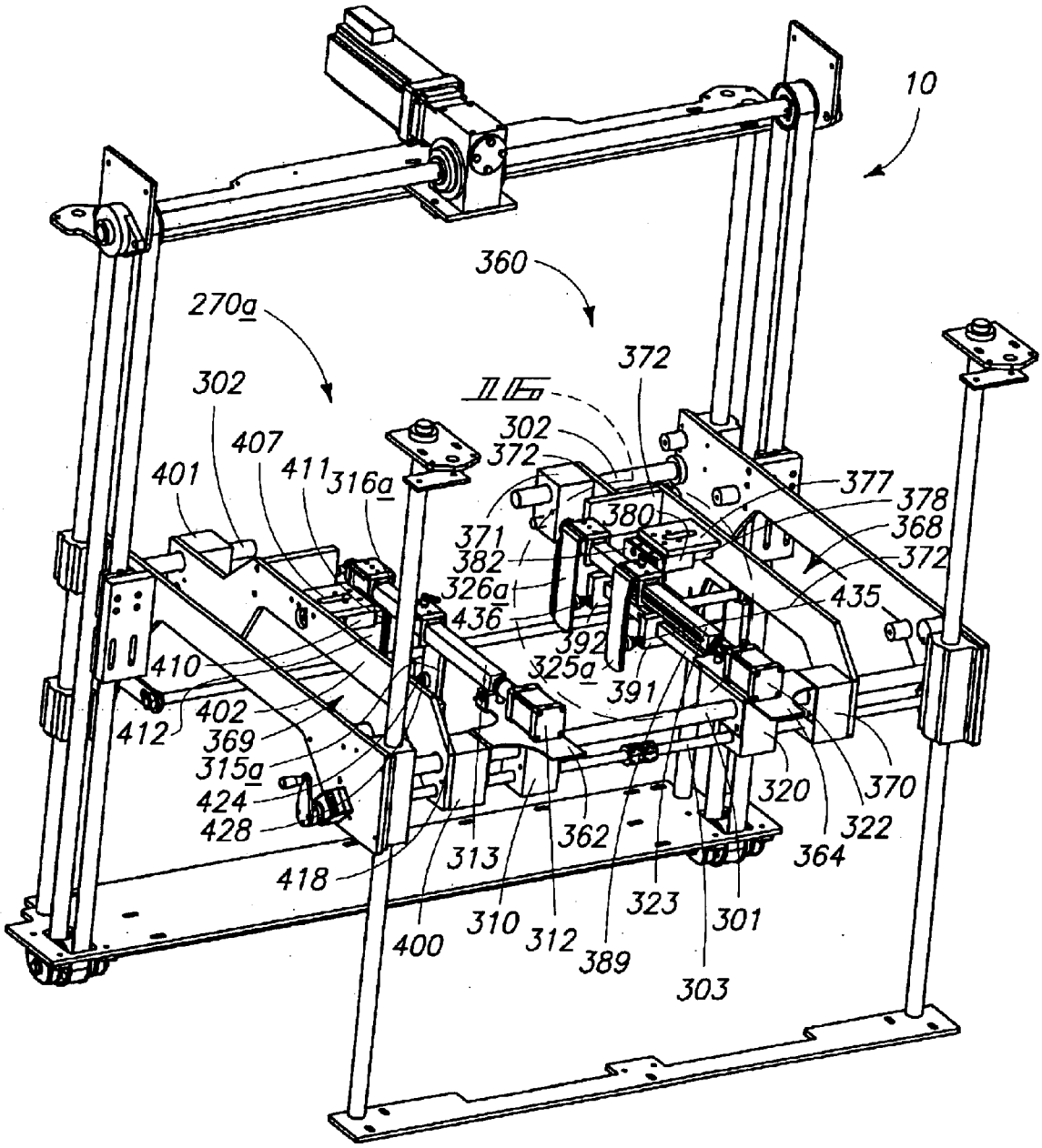
FIG. 15 is a perspective view showing portions of a preferred packaging liner insertion apparatus according to the invention, emphasizing an alternate preferred cuffing assembly and clamping assembly.
Figure 11:
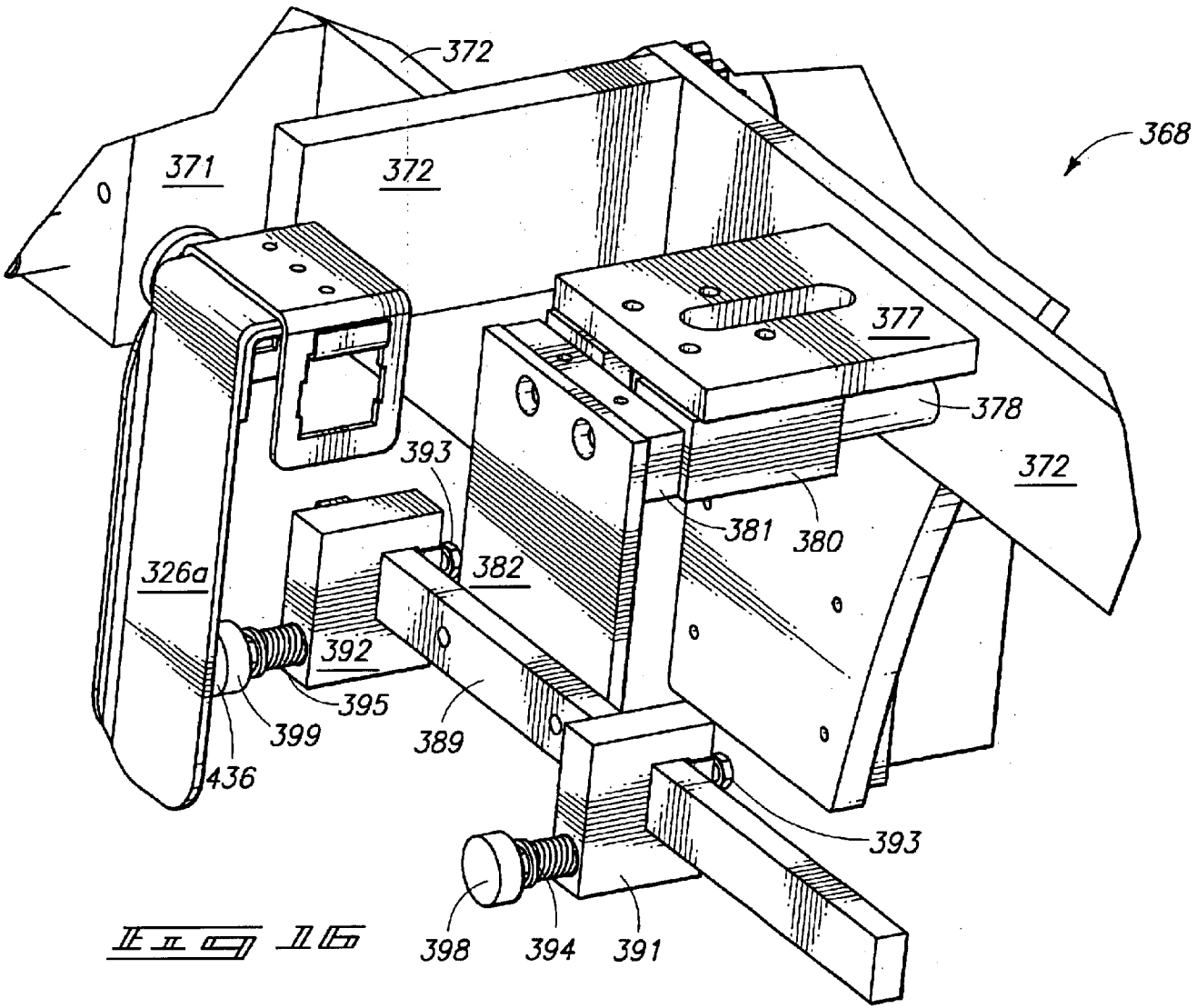

Referring to FIGS. 15–16, an alternate preferred embodiment is set forth. Like numbers from the first described embodiment are utilized where appropriate, with differences being indicated with the suffix "a" or with different numerals. In the alternate preferred embodiment, the packaging insertion apparatus utilizes a clamping assembly generally indicated by the numeral 360. FIG. 15 shows the location of the clamping assembly 360 in relation to both a cuffing assembly 270*a* and to the main framework 10. The following paragraphs describe the aspects of the alternate preferred embodiment which differ from the first described embodiment.

The cuffing assembly 270*a* of the alternate preferred embodiment depicted in FIGS. 15–16 is similar to the cuffing assembly of the first described embodiment in that the cuffing assembly 270*a* functions to spread the open end of a flexible bag which is to be inserted into the container, and to invert the open end of the flexible bag over the top edge of a container, thereby cuffing the flexible bag when such operation is desired. However, unlike the previously described embodiment, here the cuffing assembly 270*a* cooperates with clamping assembly 360 to controllably clamp the bag or liner, such as along marginal portions of the open end of the flexible bag to facilitate insertion and/or cuffing of the flexible bag or liner into or onto the container.

Referring to FIG. 15, the left rotary actuator 312 is positioned on left connection plate 362, which is secured to left cuffing finger guide block 310. A left pivot rod 313 extends rearwardly from the left rotary actuator 312. As best shown in FIG. 15, the first and second left cuffing fingers 315*a* and 316*a* are attached to the left pivot rod 313. When left rotary actuator 312 is activated, the left pivot rod 313 will controllably rotate to move the first and second left cuffing fingers 315*a* and 316*a*. The cuffing fingers 315*a* and 316*a* move between a first position which may be used to facilitate the placement of the flexible bag into the container in the container receiving area, and a second position in which the cuffing fingers 315*a* and 316*a* are adapted to spread the open end of the flexible bag to facilitate positioning, opening, inserting and cuffing the bag over the top edges of the container.

Referring again to FIG. 15, a right rotary actuator 322 is positioned on right connection plate 364, which is secured to the right cuffing finger guide block 320. A right pivot rod 323 extends rearwardly from the right rotary actuator 322. The first and second right cuffing fingers 325*a* and 326*a* are attached to the right pivot rod 323. When right rotary actuator 322 is activated, the right pivot rod 323 will controllably rotate to move the first and second right cuffing fingers 325*a* and 326*a* between a first position which facilitates the placement of the flexible bag into the container in the container receiving area, and a second position in which the cuffing fingers are adapted to spread the open end of the flexible bag to facilitate cuffing the bag over the top edges of the container.

The cuffing assembly 270*a* cooperates with the clamping assembly 360 to controllably clamp the open end of the flexible bag to facilitate positioning, opening, inserting and/or cuffing the flexible bag into or onto the container. As shown in FIG. 15, the clamping assembly 360 includes both a right clamping assembly 368 and a left clamping assembly 369. FIG. 16 provides an enlarged fragmentary view of a portion of the right clamping assembly 368.

Referring to FIGS. 15 and 16, the right clamping assembly 368 includes a right-front guide block 370 through which the front cuffing assembly rod 301 and the front adjusting rod 303 pass, a right-rear guide block 371 through which the rear cuffing assembly rod 302 passes, and a right brace member 372 which extends between the right-front guide block 370 and the right-rear guide block 371. The right brace member 372 is securely affixed to the right-front and right-rear guide blocks 370 and 371. A right attachment plate 377 and right slide rods 378 (only one of the two right slide rods are shown) are securely attached to the right brace member 372, and extend inwardly therefrom.

Referring again to FIGS. 15 and 16, the right slide rods 378 are matingly and slidably received by the right clamping operator or clamping actuator 380 which allow the slide rods to be controllably moved therein. As best seen in FIG. 16, a right base plate 381 attaches the right clamping operator 380 to a right vertical clamping plate 382. The right vertical clamping plate 382 extends downwardly from the right base plate 381 where it is securely attached to a right clamping pad or contact positioning member 389. First and second right clamping blocks 391 and 392 are adjustably secured to the right clamping pad positioning member 389, and can be slidably moved along the length of the right clamping pad positioning member 389 to be secured in various locations. Fasteners 393 secure the first and second right clamping blocks 391 and 392 into position. The first and second right clamping blocks 391 and 392 are positioned and secured to right clamping pad positioning member 389 so that the first and second right clamping blocks 391 and 392 are aligned with the first and second right cuffing fingers 325*a* and 326*a* when the cuffing fingers are in a suitable position.

First and second right springs 394 and 395 extend respectively from the first and second right clamping blocks 391 and 392. First and second right clamping pads 398 and 399 are secured respectively to the first and second right springs 394 and 395. Springs 394, 395 provide yielding or elastic mechanical engagement between the contacts formed by clamping pads 398 and 399 relative to the cuffing fingers.

As shown in FIG. 15, the clamping assembly 360 also advantageously includes a left clamping assembly 369. The left clamping assembly 369 is essentially a mirror image of the right clamping assembly 368 described above. The left clamping assembly 369 includes a left-front guide block 400 which engages and preferably passes the front cuffing assembly guide rod 301. The front adjusting rod 303 also may pass therethrough. It further preferably includes a left-rear guide block 401 through which the rear cuffing assembly rod 302 passes, and a left brace member 402 which extends between the left-front guide block 400 and the left-rear guide block 401. As shown in FIG. 15, the left brace member 402 is securely affixed to the left-front and left-rear guide blocks 400 and 401. A left attachment plate 407 and left slide rods (not shown) are securely attached to the left brace member 402, and extend inwardly therefrom similar to the complementary structure on the opposite side described above.

Referring again to FIG. 15, the left slide rods (not shown) are matingly slidably received by the left clamping operator or actuating means 410 which can be controllably moved in synchrony or other appropriately controlled action similar to the right slide rods 378. A left base plate 411 attaches the left clamping operator 410 to a left vertical clamping plate 412. The left vertical clamping plate 412 extends downwardly from the left base plate 411 where it is securely attached to a left clamping pad positioning member 418. First and second left clamping blocks (not shown) are adjustably secured to the left clamping pad positioning member 418, and can be slidably moved along the length of the left clamping pad positioning member 418 to be secured in various locations similar to the right clamping assembly. Left fasteners (not shown) secure the first and second left clamping blocks (not shown) into position. The first and second left clamping blocks are positioned and secured to left clamping pad positioning member 418 so that the first and second left cuffing fingers 315*a* and 316*a* will be aligned respectively with the first and second left clamping blocks when the cuffing fingers are in a suitable position to provide a coordinated clamping position therewith. First and second left springs (only the first left spring 424 is shown) extend respectively from the first and second left clamping blocks. First and second left clamping pads (only the first left clamping pad 428 is shown) are secured respectively to the first and second left springs.

To understand the operation of the clamping assembly 360, it is important to realize that in the alternate preferred embodiment depicted in FIGS. 15 and 16, the clamping assembly 360 and the cuffing assembly 270*a* cooperate and are moved up and down together and the clamping assembly may be connected thereto and be considered a part of the cuffing assembly. The clamping assembly is used to controllably clamp the open end of a flexible bag or other liner. Furthermore, the right and left clamping assemblies 368 and 369 are mirror images of each other and operate in the same fashion. For the sake of simplicity, the operation of the clamping assembly 360 will be described in detail below with reference to the right clamping assembly 368, as the details of right clamping assembly 368 are more clearly shown in FIGS. 15 and 16 than are those of the left clamping assembly 369. However the left clamping assembly 369 operates in the same fashion.

The following paragraphs describe the operation of the right clamping assembly 368 with reference to FIGS. 15 and 16. As described above, the right clamping assembly 368 includes right slide rods 378 which are engaged and operated by the right clamping operator or actuating means 380. The right clamping operator 380 receives a controlled air supply which causes the right clamping operator 380 to be controllably moved along with right slide rods 378. Such parts act by moving inwardly into a clamping position, or outwardly into a non-clamping or released position. As the right clamping operator 380 is controllably moved along the right slide rods 378, the attached structures, including the first and second right clamping pads 398 and 399, move with the right clamping operator 380. Therefore, when the right clamping operator 380 is controllably moved inwardly along the right slide rods 378 into the clamping position, the first and second right clamping pads 398 and 399 also move inwardly into the clamping position, where the right clamping assembly 368 and the cuffing assembly 270*a* can cooperate to controllably clamp the liner, such as at the open end of a flexible bag. FIGS. 15 and 16 show the right clamping assembly 368 in a retracted position from which it can be actuated into a clamping position.

To facilitate clamping, the first and second right cuffing fingers 325*a* and 326*a* will also be moved into the clamping position as shown in FIGS. 15 and 16 to clamp the open end of a flexible bag. Both the first and second right cuffing fingers 325*a* and 326*a* are shown in FIG. 15, but only the second right cuffing finger 326*a* is shown in the fragmentary view of FIG. 16 so that other aspects of the right clamping assembly 368 can be seen in such drawing. The first and second right cuffing fingers 325*a* and 326*a* have first and second right clamping pad receiving or contact surfaces 435 and 436 formed respectively on their outwardly facing surfaces as shown. The first right clamping pad receiving surface 435 will come into apposition with the first right clamping pads 398, while the second right clamping pad receiving surface 436 will come into apposition with the second right clamping pads 399 when the right clamping assembly 368 is placed in the clamping position relative thereto.

To move the cuffing assembly 270*a* to the position for clamping, the right rotary cuffing finger actuator 322 is activated, causing the first and second right cuffing fingers 325*a* and 326*a* to controllably rotate or otherwise move into such position. In the clamping position, the open end of a flexible bag (not shown) is controllably clamped between the first right clamping pad surface 435 of the first right cuffing finger 325*a* and the first right clamping pad 398 of the right clamping assembly 368. The open end of the flexible bag (not shown) is also controllably clamped between the second right clamping pad surface 436 of the second right cuffing finger 326*a* and the second right clamping pad 399 of the right clamping assembly 368. In this way, the right clamping assembly 368 and the cuffing assembly 270*a* cooperate to controllably clamp the open end of the flexible bag in one or more, preferably plural, clamping positions.

In the alternate preferred embodiment depicted in FIGS. 15 and 16, it is important to understand the while the right clamping assembly 368 is clamping one side of the open end of the flexible bag, the left clamping assembly 369 is similarly clamping the other or substantially opposite side of the open end of the flexible bag or liner. This allows both sides of the flexible bag to be simultaneously controllably clamped to facilitate positioning, opening, inserting and cuffing of the flexible bag into a receiving container.

Vacuum Heads

FIGS. 17–20 show a second preferred embodiment vacuum head. Like numbers from the first described embodiment of FIGS. 1–14 are utilized where appropriate, with differences being indicated with the suffix "a" or with different numerals. As previously discussed with reference to FIGS. 1–14, the vacuum assembly 70 includes a left and right movable vacuum heads 100 and 160. The left and right movable vacuum heads 100 and 160 are controllably moved to engage the flexible bag which has been supplied by the bag dispenser 50. The two rear vacuum heads 210 and 211, which may be movable or stationary, assist the left and right movable vacuum heads 100 and 160 in engaging the flexible bag between opposing vacuum heads. Any or all of the vacuum heads 100, 160, 210 and 211 can be replaced with vacuum heads according to the second preferred embodiment which is described in detail below.

Figure 17:
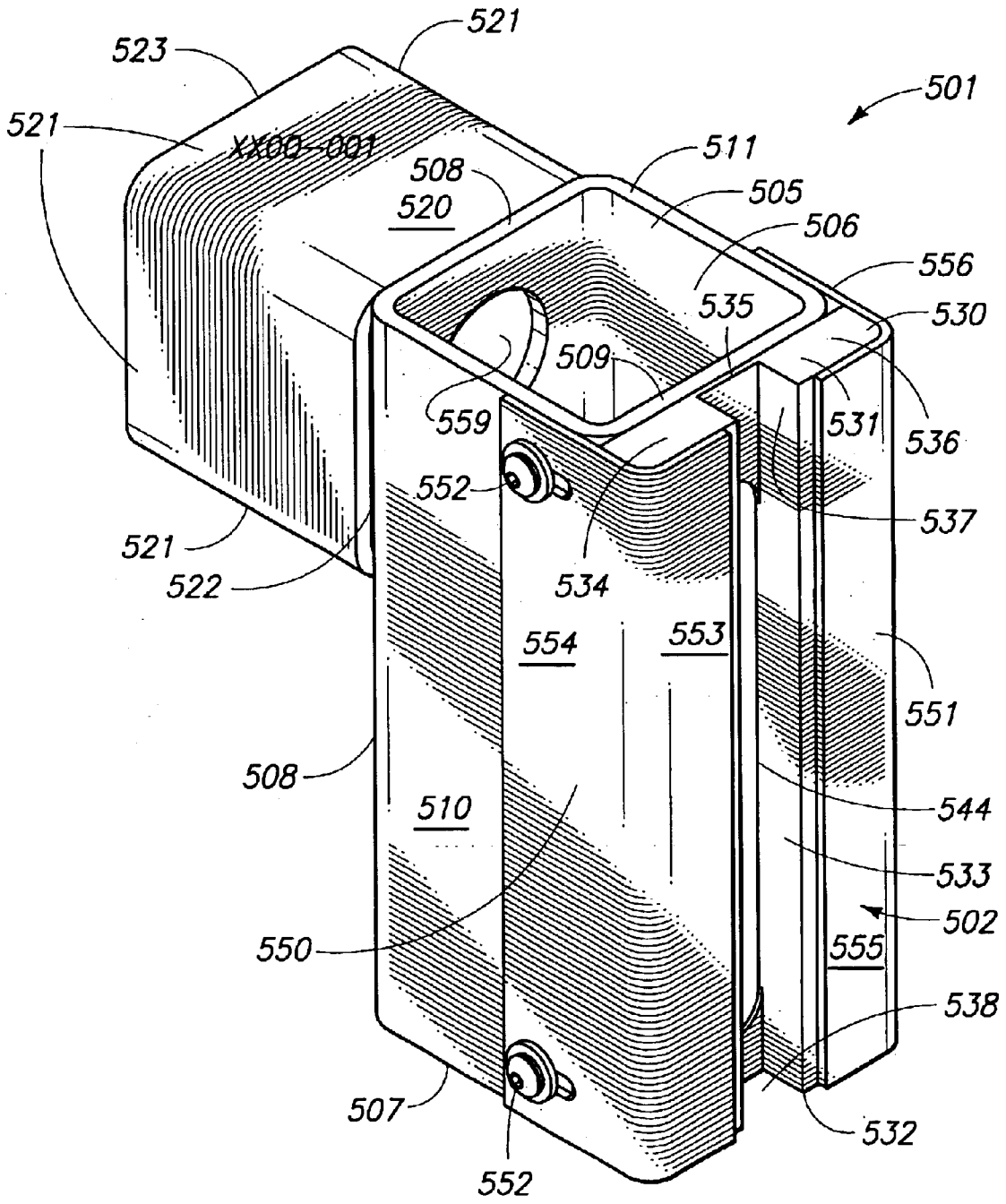
FIG. 17 is a perspective view showing a preferred vacuum head for engaging and handling flexible films and bags made therefrom according to the invention.
Figure 18B:
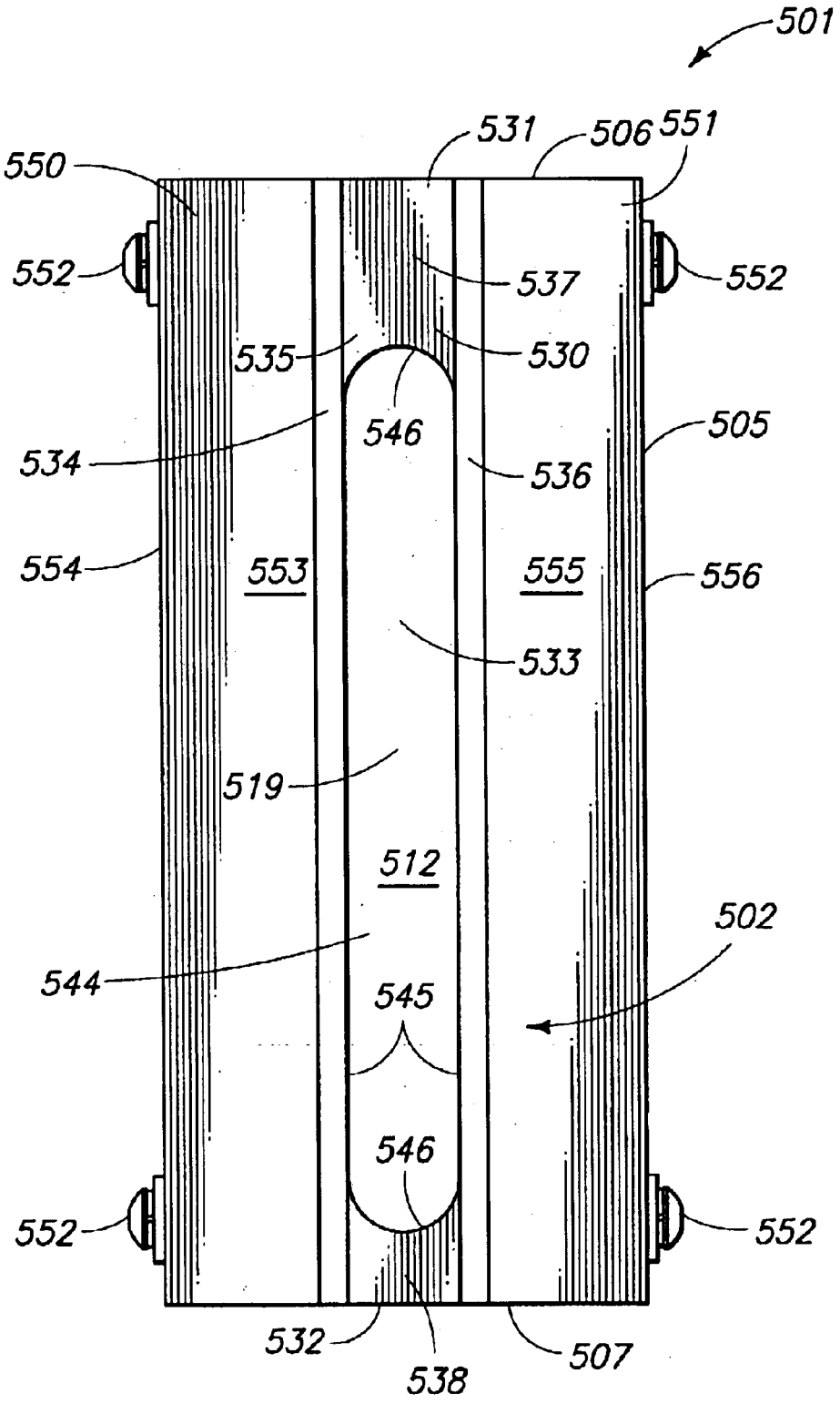
FIG. 18 is a front elevational view of the vacuum head of FIG. 17.
Figure 19:
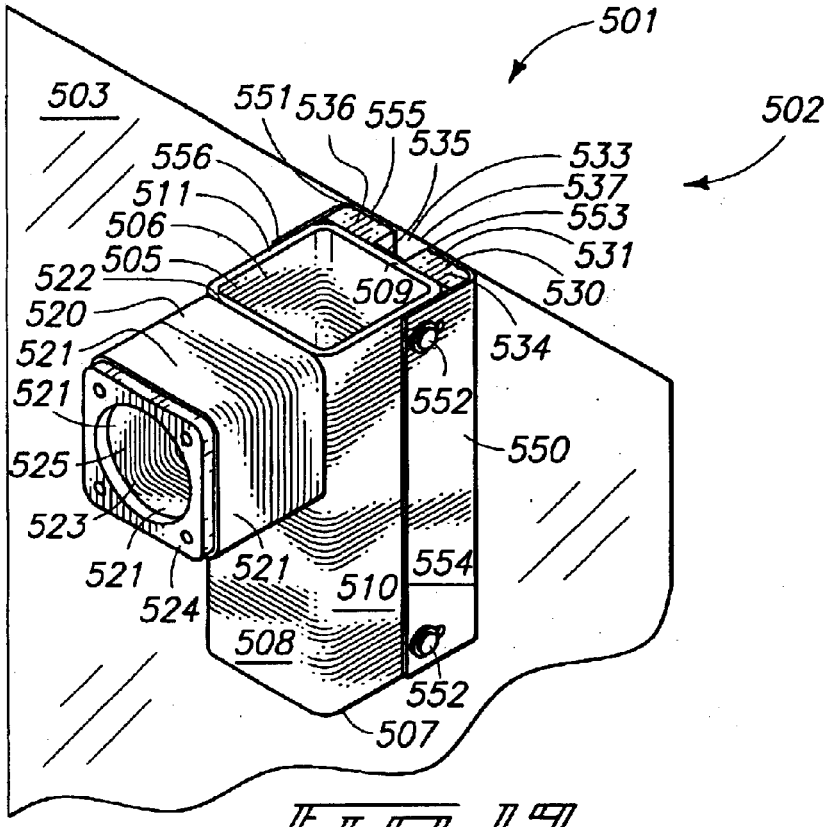
FIG. 19 is a perspective view of the vacuum head of FIG. 17 engaging a flexible film or bag.

FIGS. 17–20 show a second preferred embodiment vacuum head, which is generally indicated by the numeral 501. The vacuum head 501 has an engagement face 502 for engaging a flexible film and bag or liner made therefrom 503 (FIG. 19). The vacuum head 501 includes a vacuum head body 505. The vacuum head body 505 includes at top wall 506, a bottom wall 507, a rear wall 508, a front wall 509, and a pair of opposing first and second side walls 510 and 511, which together define a central cavity 512 (FIG. 18). The central cavity 512 is essentially a rectangular void which is defined by the walls 506, 507, 508, 509, 510 and 511 of the vacuum head body 505 as described above. The rear wall 508 includes a rear wall aperture 559 which provides an opening to the central cavity 512. Similarly, the front wall 509 includes a front wall aperture 519 which provides an opening into the central cavity 512 (FIG. 18).

Figure 20:
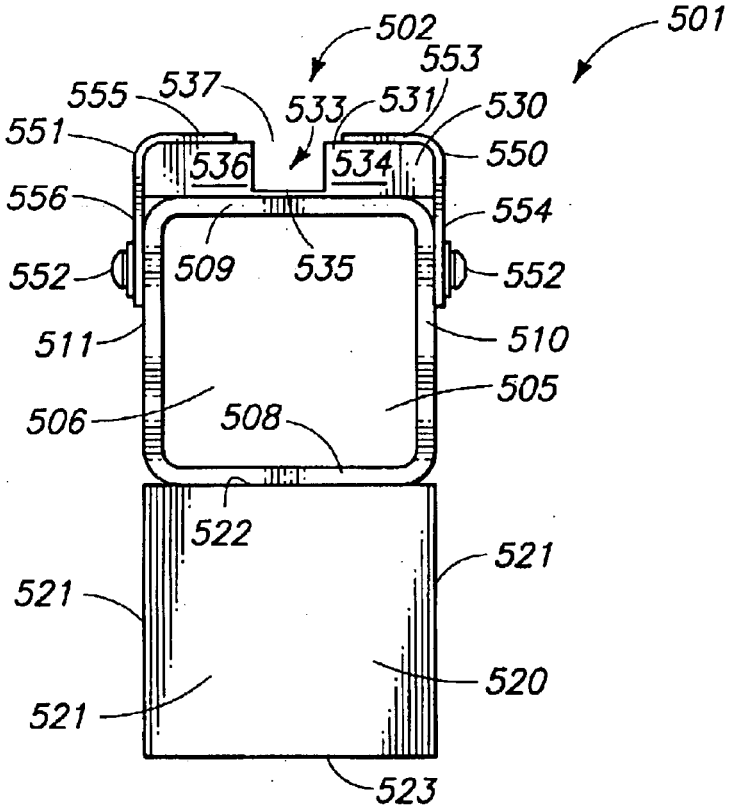
FIG. 20 is a top view of the vacuum head of FIG. 17.

As shown in FIGS. 17, 19 and 20, a vacuum conduit 520 is securely attached to the rear wall 508 of the vacuum head body 505 about the rear wall aperture 559. Vacuum conduit 520 includes four side walls 521, an open front face 522, and an open rear face 523. As best seen in FIG. 19, a vacuum conduit attachment plate 524 is attached to the open rear face 523 of the vacuum conduit 520. The vacuum conduit attachment plate 524 includes a vacuum receiving aperture 525 to which a vacuum source (not shown) may be attached. As described above with reference to FIGS. 1–14, the vacuum source to left and right rear vacuum heads 210 and 211 is provided respectively by the left rear and right rear vacuum tubes 202 and 203. Similarly, the vacuum source to the movable left and movable right vacuum heads 100 and 160 is provided respectively by the left and right vacuum connectors 95 and 155.

Referring again to FIGS. 17–20, a face member 530 is affixed to the front wall 509 of the vacuum head body 505. The face member 530 has a first end 531 and a second end 532. The face member serves to form and define a vacuum engagement opening in the form of vacuum aperture or opening. The vacuum aperture may be in the form of a slot 533 extend vertically across the face member 530, extending from the first end 531 to the second end 532. Alternatively, the opening may extend only a portion of the face. Slot 533 effectively divides the face member 530 into a first face member portion 534, a slot portion 535, and a second face member portion 536. As best seen in FIGS. 17 and 18, slot 533 may advantageously extend vertically across the entire face member 530 so that the slot 533 has first and second slot ends 537 and 538 which are open at the first and second ends 531 and 532 of the face member 530. End 538 may alternatively be closed.

The face member may also be used to define aperture 544 which is located adjacent to and aligned with the front wall aperture 519, thereby providing an opening into the central cavity 512 of the vacuum head body 505. As best seen in FIG. 18, the face member aperture 544 is an elongated opening having straight side edges 545 and rounded top and bottom edges 546.

As shown in FIGS. 17–20, first and second attachment plates 550 and 551 are securely attached to the vacuum head body 505 with fasteners 552. This first attachment plate 550 includes a first engagement surface 553 which covers a portion of the first face member portion 534, and is directed toward a flexible film or bag which is to be engaged, and a first side surface 554. The second attachment plate 551 includes a second engagement surface 555 which covers a portion of the second face member portion 536, and is directed toward a flexible film or bag which is to be engaged, and a second side surface 556. The first and second attachment plates 550 and 551 serve to securely hold the face member 530 against the front wall 509 of the vacuum head body 505. The vacuum engagement opening formed by slot 533 is exposed between the first engagement surface 553 and the second engagement surface 555 at the engagement face 502.

Referring to FIGS. 17–20, an air pathway extends through the vacuum head 501 so that vacuum pressure may be communicated to slot 533 from vacuum conduit or source connected at opening 523. A first portion of the air pathway extends from the open rear face 523 of the vacuum conduit 520, through the vacuum conduit 520, and to the open front face 522 of the vacuum conduit 520. Here, the open front face 522 of the vacuum conduit 520 and the rear wall aperture 559 of the vacuum head body 505 are coupled in fluid flowing relation. A second portion of the air pathway extends from the rear wall aperture 559, through the vacuum head body 505, and to the front wall aperture 519. Here, the front wall aperture 519 and the slot 533 are coupled in fluid flowing relation. Therefore, when a vacuum source is attached to the vacuum receiving aperture 525 and vacuum pressure is applied, the vacuum pressure will be communicated through the air passageway, and to the slot 533. A similar air passageway is present in each of the vacuum heads described below.

As shown in FIGS. 17–20, the vacuum head 501 for engaging a flexible film or bag includes an engagement face 502 for engaging the flexible film or bag 503. The engagement face 502 includes at least one slot 533 having at least one slot end 537 which is open, and wherein vacuum pressure is communicated to the at least one slot 533. When the engagement face 502 is brought into apposition with a flexible film 503 (FIG. 19) and vacuum pressure is communicated to the at least one slot 533, the vacuum pressure causes the flexible film to be grasped within the at least one slot 533 on the engagement face 502. As shown in FIGS. 17–20, vacuum head 501 has two slot ends 537 and 538 which are open at the first and second ends 531 and 532 of the face member 530. Such open slot ends 537 and 538 facilitate more efficient engagement of the flexible film or bag made therefrom 503 by decreasing puckering of the flexible film or bag at the point of engagement, thereby improving the seal formed between the vacuum engagement face 502 and the flexible film or bag which has been engaged. It is important to understand that any or all of the vacuum heads 100, 160, 210 and 211 can be replaced with vacuum heads utilizing the design of the second preferred embodiment vacuum head 501.

Figure 21:
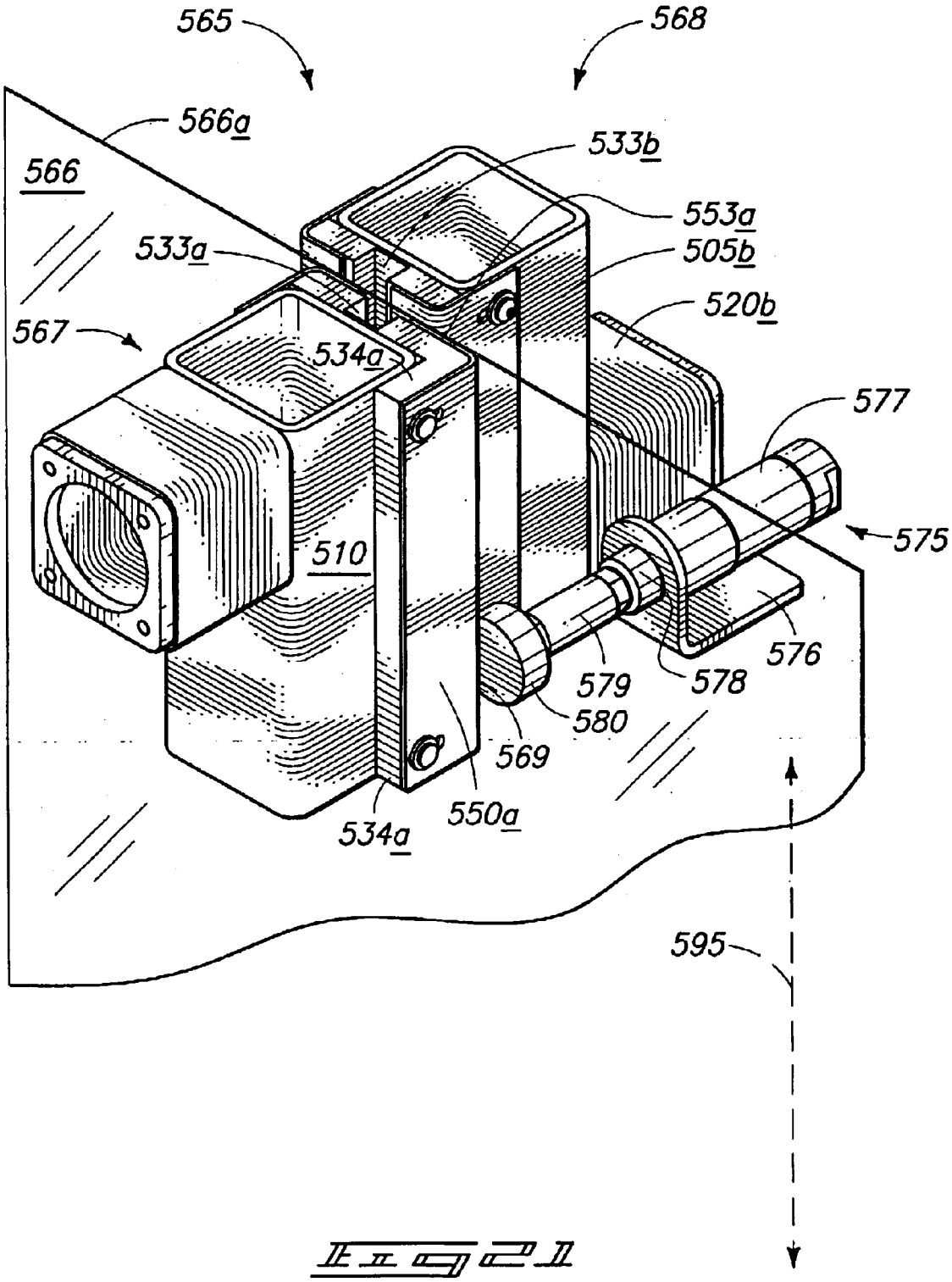
FIG. 21 is a perspective view showing an alternate preferred embodiment showing two vacuum heads in preparation for engaging opposing sides of a flexible bag.
Figure 22:
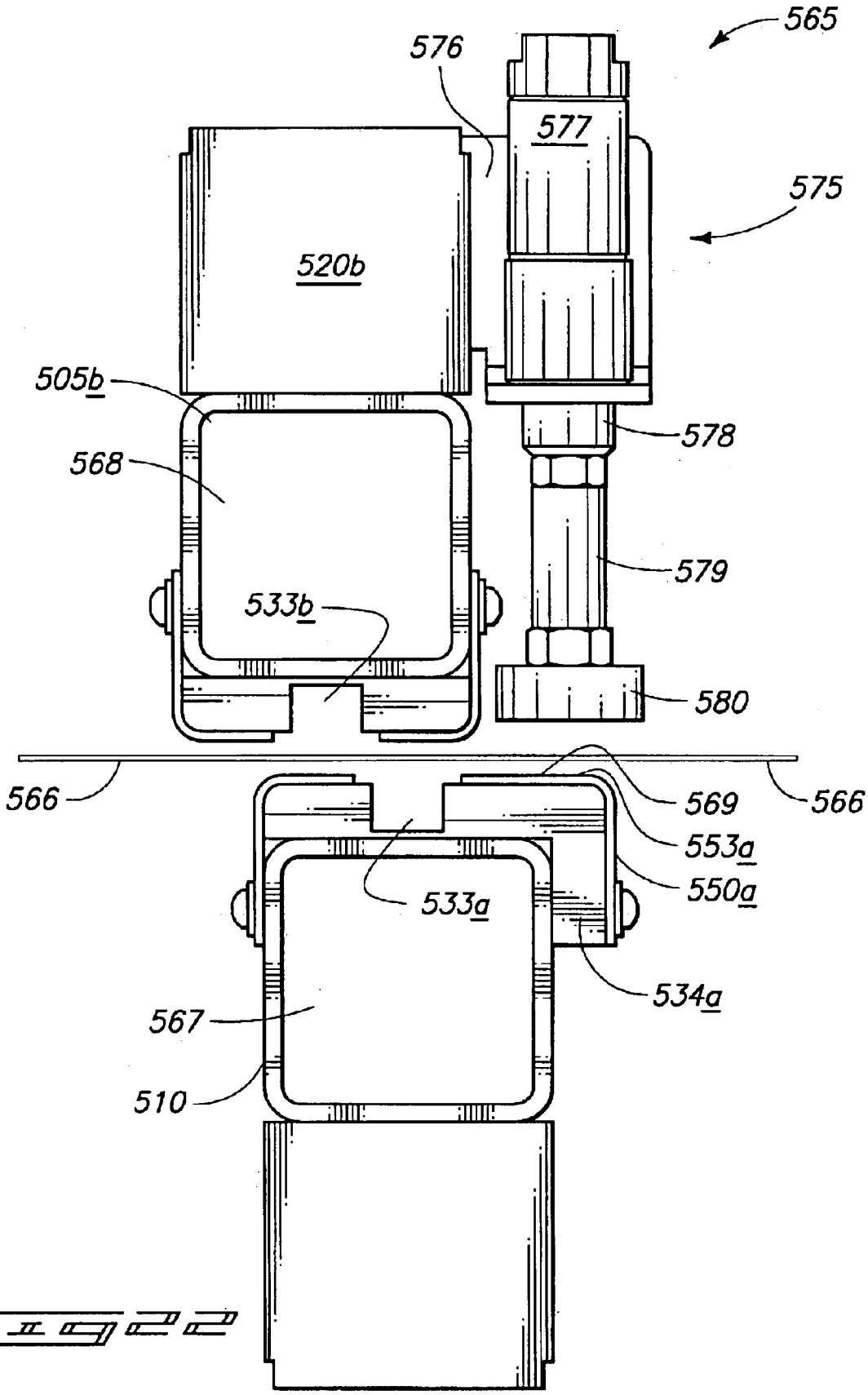
FIG. 22 is a top view showing the two of the vacuum heads of FIG. 21 in proximity to opposing sides of a flexible bag, such as in preparation to engage therewith.

Referring now to FIGS. 21 and 22, third preferred embodiment vacuum head assembly is set forth. FIGS. 21 and 22 show a pair of vacuum heads 565 for engaging opposing sides of a flexible bag 566 which is to be opened. The perforation line 566*a* is adjacent thereto. Perforation line 566*a* extends between two adjoining bags prior to separation. The pair of vacuum heads 565 includes a first vacuum head 567 and a second vacuum head 568. In the depicted embodiment, the first and second vacuum heads 567 and 568 may be used in place of the moveable left vacuum head 100 and left rear vacuum head 210 which were described previously with reference to FIGS. 1–14. First and second vacuum heads 567 and 568 are similar to the vacuum head 501 shown in FIGS. 17–20 and described above. However, because this third preferred embodiment vacuum head assembly utilizes at least two vacuum heads which operate in cooperation some differences exist. In describing the third preferred embodiment vacuum head assembly, like numbers from the second described vacuum head embodiment (FIGS. 17–20) are utilized where appropriate, with differences being indicated with the suffix "a", suffix "b", or with different numerals. The suffix "a" will be used to describe differences in the first vacuum head 567, while the suffix "b" will be used to describe differences in the second vacuum head 568.

Referring now to FIGS. 21 and 22, the first vacuum head 567 and the second vacuum head 568 are shown engaging opposing sides of a flexible bag 566 which is to be opened. The first vacuum head 567 is similar to vacuum head 501 described previously with reference to FIGS. 17–20. However, the first face member portion 534*a* is enlarged, and wraps around to cover a portion of the first side wall 510. Similarly, the first attachment plate 550*a* is also enlarged so that is will cover the first face member portion 534*a* as shown. By utilizing a larger first face member portion 534*a* and a larger first attachment plate 550*a*, a wider first engagement surface 553*a* is provided. A portion of the first engagement surface 553*a* is used as an engagement pad receiving area 569. Slot 533*a* is oriented in a substantially upstanding orientation parallel to major axis 595.

Still referring to FIGS. 21 and 22, the second vacuum head 568 is shown. The second vacuum head 568 is also similar to vacuum head 501 described previously with reference to FIGS. 17–20. However, the orientation of the second vacuum head 568 is inverted in relation to the vacuum head 501 which shown in FIGS. 17–20. Therefore, vacuum plenum 520*b* exits from the lower portion of the vacuum head body 505*b*.

An engagement or gripper assembly generally indicated by the numeral 575 is attached to the vacuum plenum 520*b* by bracket 576 for engaging the bag and allowing or facilitating separation along a perforation line typically preformed between adjacent bags. The bag is gripped and then relative movement between the bags joined at the perforation line is performed. This can be done using the dispenser by moving the dispenser feed backward or by other suitable relative movement, such as by moving the engagement heads, or both. The engagement or gripper 575 includes a body portion with pneumatic or electric actuator 577, a bracket attachment portion 578, and a neck portion 579. An engagement pad or contact 580 is affixed to the neck portion 579. Slot 533*b* is oriented in a substantially upstanding orientation parallel to major axis 595.

When the first and second vacuum heads 567 and 568 have moved into or very near engagement with opposing sides of the flexible bag 566, the engagement pad 580 and the engagement pad receiving area 569 will contact the opposing sides of the flexible bag 566 thereby allowing the gripper 575 to grip the bag therebetween.

Figure 23:
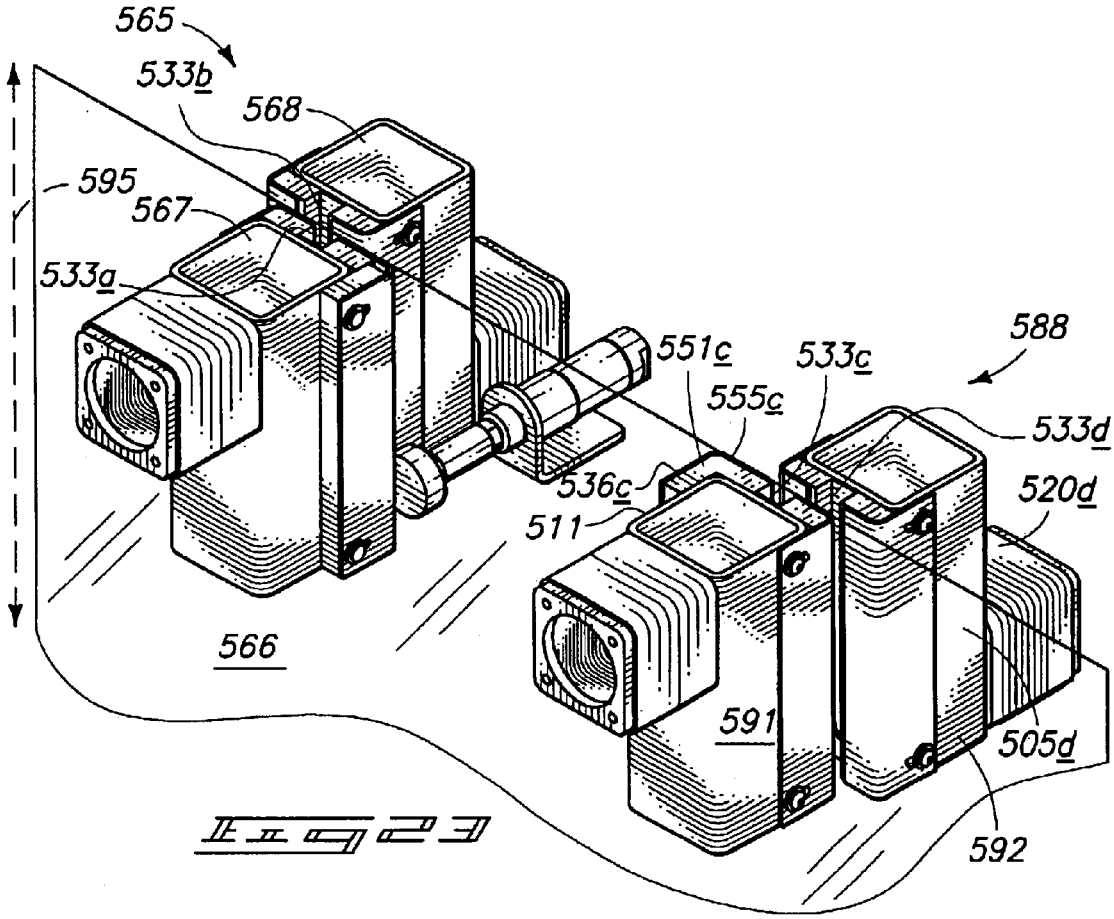
FIG. 23 is an perspective view showing an alternate preferred embodiment wherein there are two pairs of the vacuum heads in preparation for engaging opposing sides of a flexible bag.
Figure 24:
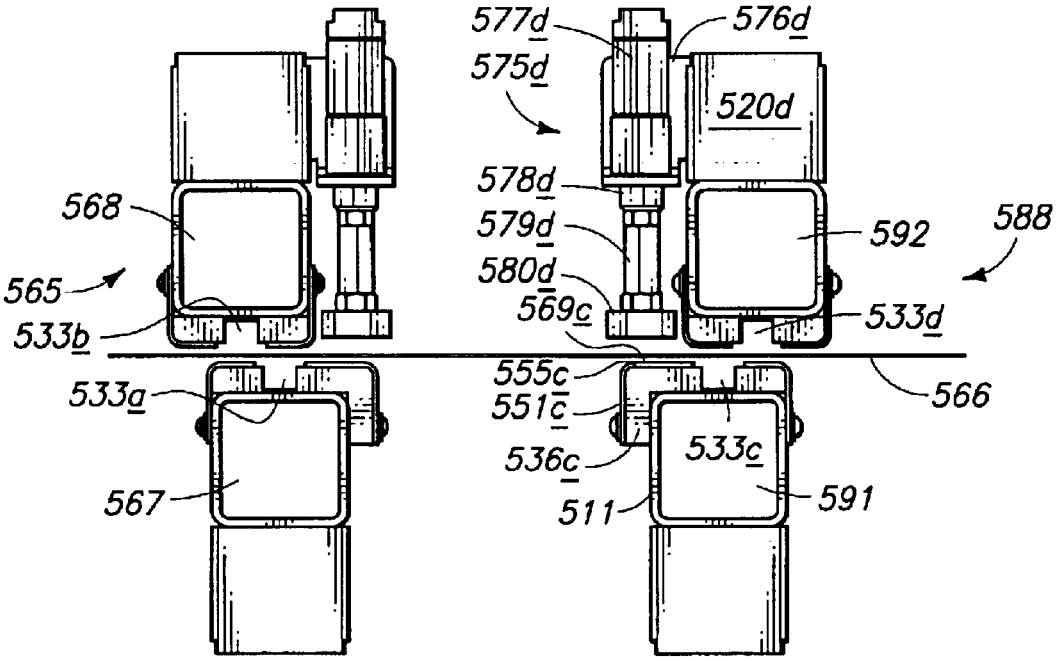
FIG. 24 is a top view showing the two pairs of the vacuum heads of FIG. 23 in proximity to opposing sides of a flexible bag, such as in preparation to engage therewith.

FIGS. 23 and 24 show the first pair of vacuum heads 565, which includes the first and second vacuum heads 567 and 568 which were described previously with reference to FIGS. 21 and 22. The first pair of vacuum heads 565 are unchanged from FIGS. 21 and 22, and therefore the previous description of the first pair of vacuum heads 565 is still apposite. However, now a second pairs of vacuum heads 588 has been added to work in cooperation with the first pair of vacuum heads 565. The second pair of vacuum heads 588 are similar to the first pair of vacuum heads 565. The second pair of vacuum heads 588 may be used in place of the moveable right vacuum head 160 and the right rear vacuum head 211 which were previously described with reference to FIGS. 1–14. As shown, these two pairs of vacuum heads 565 and 588 engage the flexible bag 566 at different locations to facilitate engaging and handling of the flexible bag 566.

When referring to FIGS. 23 and 24, like numbers from the third preferred embodiment vacuum head assembly are used in reference to the first pair of vacuum heads 565 which remains unchanged. When referring to the second pair of vacuum heads 588 like numbers from the third preferred embodiment vacuum head assembly are utilized where appropriate, with differences being indicated with the suffix "c", suffix "d", or with different numerals. The suffix "c" will be used to describe differences in the third vacuum head 591, while the suffix "d" will be used to describe differences in the fourth vacuum head 592.

The third vacuum head 591 is similar to vacuum head 501 described previously with reference to FIGS. 17–20. As shown, in the third vacuum head 591, the second face member portion 536*c* is enlarged, and wraps around to cover a portion of the second side wall 511. Similarly, the second attachment plate 551*c* is also enlarged so that is will cover the second face member portion 536*c* as shown. By utilizing a larger second face member portion 536*c* and a larger second attachment plate 551*c*, a wider second engagement surface 555*c* is provided. A portion of the second engagement surface 555*c* is used an engagement pad receiving area 569*c*. Slot 533*c* is oriented in a substantially upstanding orientation parallel to major axis 595.

Still referring to FIGS. 23 and 24, the fourth vacuum head 592 is shown. The fourth vacuum head 592 is also similar to vacuum head 501 described previously with reference to FIGS. 17–20. As seen in FIGS. 23 and 24, the orientation of the fourth vacuum head 592 is inverted in relation to the vacuum head 501 which was shown in FIGS. 17–20. Therefore, vacuum plenum 520*d* exits from the lower portion of the vacuum head body 505*d*. An engagement or gripper assembly generally indicated by the numeral 575*d* is attached to the vacuum plenum 520*d* by brace 576*d*. The engagement or gripper assembly 575*d* includes a body portion 577*d*, a brace attachment portion 578*d*, and a neck portion 579*d*. An engagement pad 580*d* is affixed to the neck portion 579*b*. Slot 533*d* is oriented in a substantially upstanding orientation parallel to major axis 595.

Referring to FIGS. 21–24, it is important to understand the positional relationship and orientation of the opposing vacuum heads relative to each other as they engage opposing sides of the flexible bag 566. This is best understood by referring to a single pair of vacuum heads as shown in FIGS. 21 and 22. Referring to FIGS. 21 and 22, when the first and second vacuum heads 567 and 568 are engaging the flexible bag 566, the first and second vacuum heads 567 and 568 are each vertically oriented parallel to a major vertical axis 595 (shown in phantom lines in FIG. 21), therefore slots 533*a* and 533*b* are oriented in a substantially upstanding orientation. As shown in FIG. 23, when more that one pair of opposing vacuum heads are utilized, each slot 533*a*, 533*b*, 533*c*, and 533*d* are in a substantially upstanding orientation.

As best seen in FIGS. 21 and 22, the first and second vacuum heads 567 and 568 are also advantageously misaligned, such as by laterally offset relative to each other. Therefore, when the first and second vacuum heads 567 and 568 are engaging the opposing sides of the flexible bag 566 which is to be opened, the slot 533*a* of the first vacuum head 567 and the slot 533*b* of the second vacuum head 568 are also slightly laterally offset relative to each other. When vacuum pressure is communicated to slots 533*a* of the first vacuum head and to slot 533*b* of the second vacuum head, the vacuum pressure caused the opposing sides of the flexible bag 566 to be grasped respectively within the slots as described below. As shown in FIG. 23, when more that one pair of opposing vacuum heads are utilized, slots 533*a* and 533*b* of one pair of opposing vacuum heads, and slots 533*c* and 533*d* of the other pair of opposing vacuum heads are each slightly laterally offset relative to each other.

Figure 25:
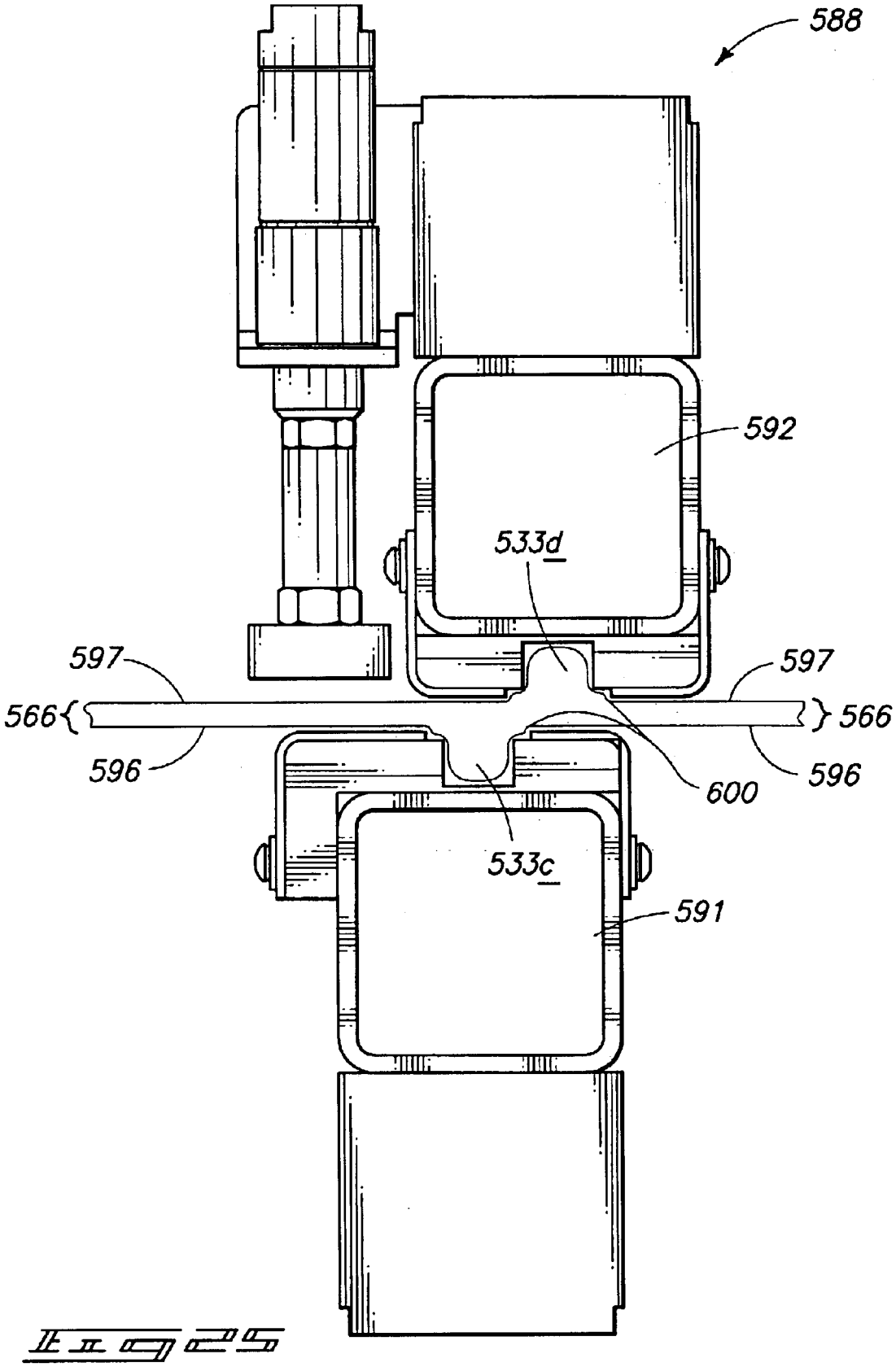
FIG. 25 is a top view showing one pair of vacuum engagement heads engaging the opposing sides of a flexible bag.

FIG. 25, depicts a pair of opposing vacuum heads and describes the way in which opposing sides of a flexible bag are grasped within the respective slots of each vacuum heads. Although a flexible bag or film is similarly grasped within the slot of any of the vacuum heads described with reference to FIGS. 17–24, such will be described in detail with reference to FIG. 25 which shows the pair of vacuum heads 588 which were previously described with reference to FIGS. 23 and 24.

The pair of vacuum heads 588 includes third vacuum head 591 and fourth vacuum head 592. Also shown is a flexible bag 566 which has a first side or leaf 596 and a second side or leaf 597 which oppose each other. As shown in FIG. 25, the third and fourth vacuum heads 591 and 592 have been moved toward each other and into engagement with the opposing sides 596 and 597 of the flexible bag 566. When vacuum pressure is communicated to slot 533*c* and 533*d*, the opposing sides 596 and 597 of the flexible bag 566 are grasped within the respective slots 533*c* and 533*d* as shown. Side 596 is grasped within slot 533*c*, and side 597 is grasped within slot 533*d*. As shown in FIG. 25, a wrinkle 600 forms in the flexible film or flexible bag 566 as it is grasped within the respective slots 533*c* and 533*d*.

Figure 26:
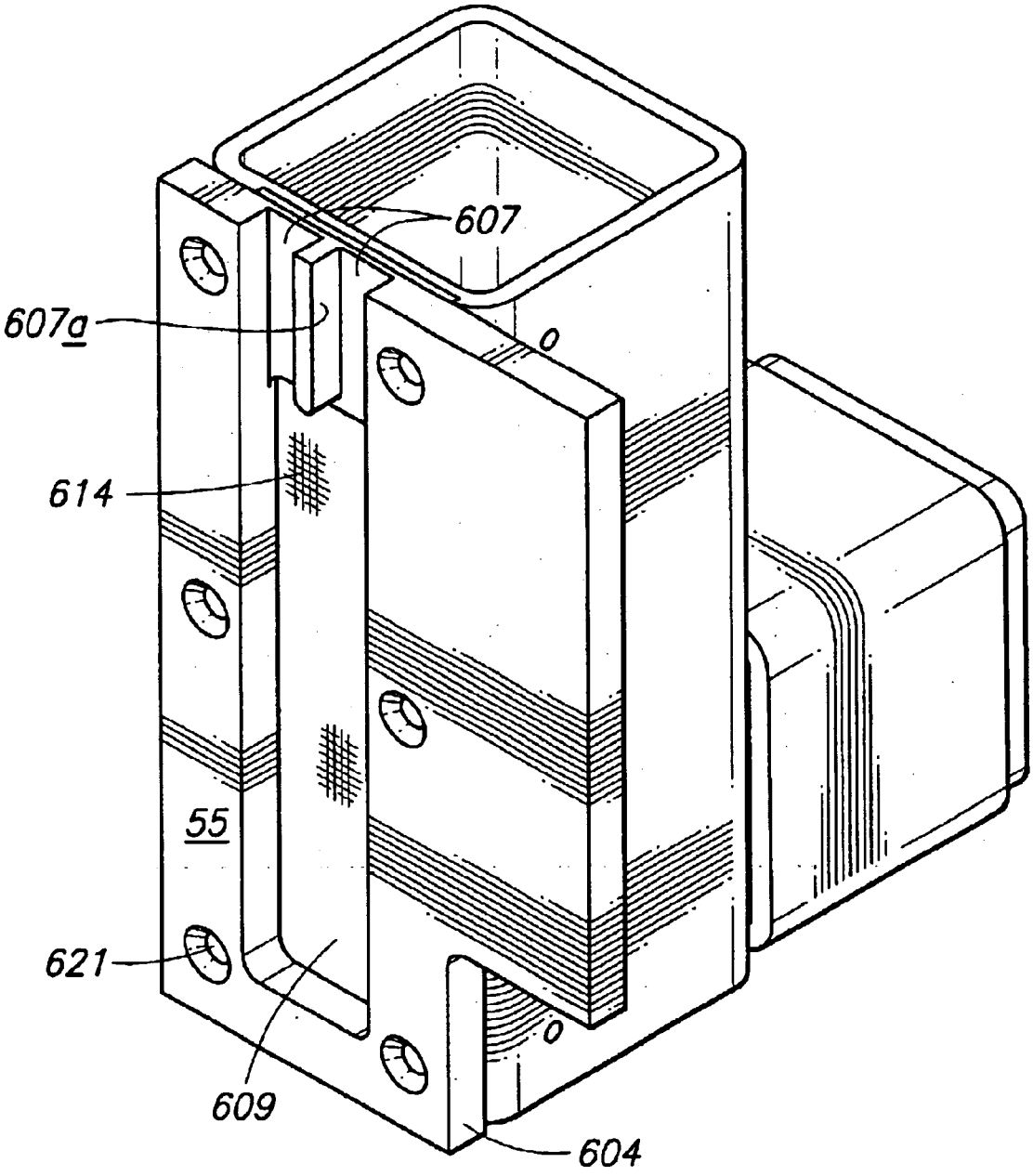
FIG. 26 is a perspective view showing an alternative construction vacuum head in accordance with another form of the invention.
Figure 27:
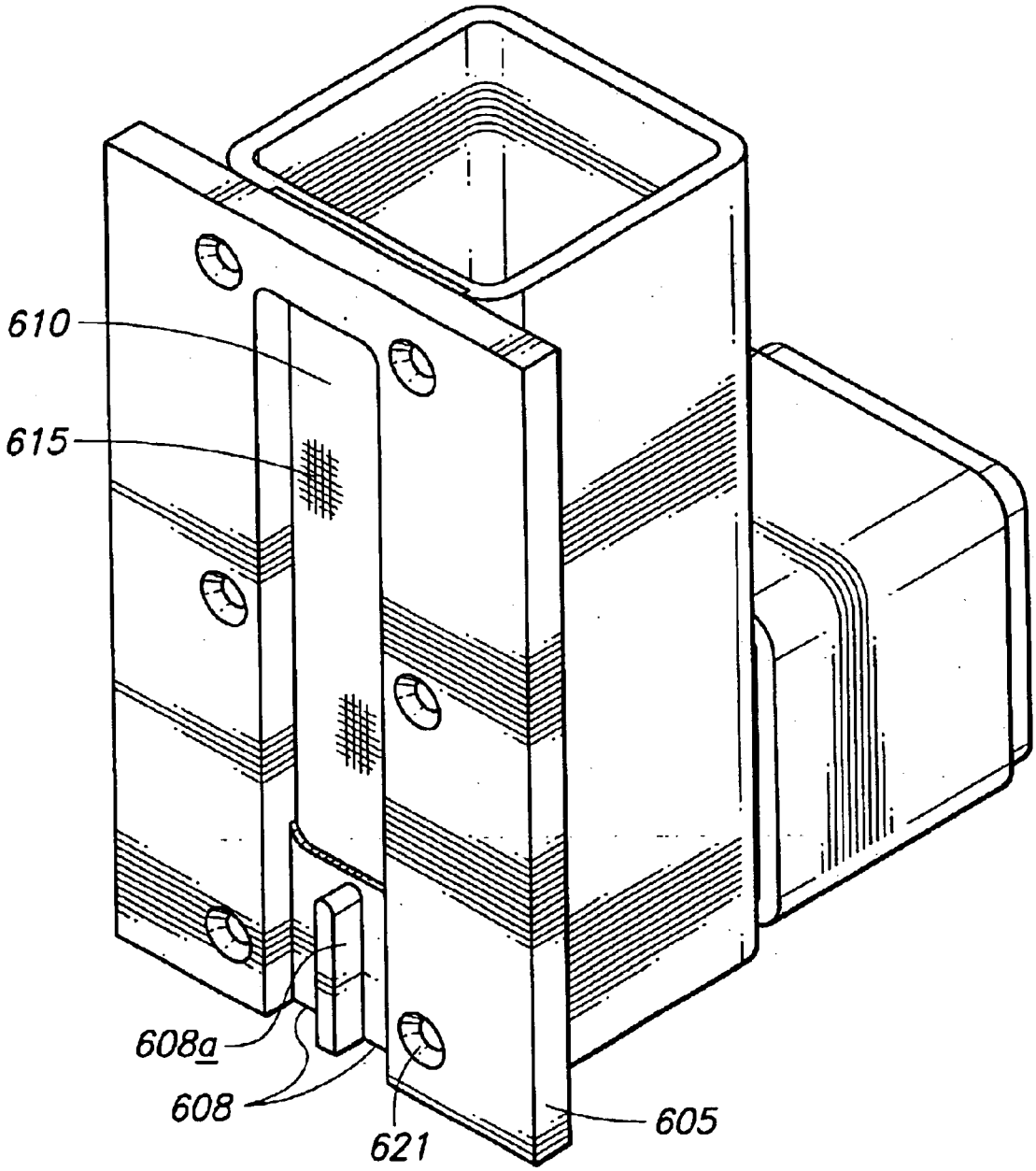
FIG. 27 is a perspective view showing a complementary vacuum head used with that shown in FIG. 26.

FIGS. 26 and 27 show two complementary vacuum heads similar to vacuum heads 567 and 568 except they have been fitted with face pads 604 and 605. The face pads are preferably made from a suitable elastomer, such as natural or synthetic rubber. They provide improved wear capabilities.

The face pads 604 and 605 have vents or vacuum relief ports 607 and 608 that help dissipate vacuum applied through the vacuum feed ports 609 and 610 which are in fluid communication with the internal vacuum chambers of each head. The vents may also include vent islands 607*a* and 608*a* to provide smaller vent opening space near the external vent opening to better position a flexible bag edge adjacent thereto.

The face pads 604 and 605 are also advantageously used to capture and support vacuum supply screens 614 and 615 which extend across the vacuum feed ports 609 and 610 respectively, and support bag portions from being sucked into the vacuum heads.

Face pads 604 and 605 are held in position on the vacuum heads using suitable fasteners (not shown) which extend through countersunk apertures 621.

The structures illustrated in FIGS. 26 and 27 can be used with any of the opposing pairs or on a single vacuum head as otherwise described herein.

Operation and Further Aspects of Methods of the Preferred Embodiments

The operation of the described embodiments of the present invention is believed to be readily apparent and is briefly summarized at this point. In one aspect, the present invention relates to a packaging insertion apparatus 1 for inserting flexible bags or other liners into packaging containers 41. The packaging insertion apparatus 1 includes, a bag dispenser 50 for dispensing flexible bags which are to be inserted into containers 41; an insertion assembly 230 which moves between a retracted position where the insertion assembly 230 is ready to insert a flexible bag into a container 42, and an extended position where the insertion assembly 230 is positioned within the container 42 having inserted the flexible bag into the container 42; and at least one movable vacuum head for engaging and positioning the flexible bags supplied by the bag dispenser 50 in preparation for insertion of the flexible bags into the containers 41, wherein the at least one movable vacuum head may engage a flexible bag supplied by the bag dispenser 50 while the insertion assembly 230 is in the extended position.

As disclosed above, in the preferred embodiment, the at least one movable vacuum head includes two movable vacuum heads 100 and 160, each of which may be controllably moved along separate paths on opposite sides of the insertion assembly 230 to engage a flexible bag held by the bag dispenser 50 while the insertion assembly 230 is in the extended position. Further, the preferred embodiment includes at least one rear vacuum head which may be controllably moved to assist the at least one movable vacuum head in engaging the flexible bag held by the bag dispenser 50. Still further, in other embodiments, the at least one movable vacuum head includes a plurality of movable vacuum heads.

In the preferred embodiment, the insertion assembly 230 includes a mandrel 330 for engaging or otherwise displacing the flexible bags which are to be inserted into the containers 41. The mandrel 330 travels with the insertion assembly 230 as it moves between the retracted position and the extended position.

In other embodiments, a bullet shaped mandrel (not shown) may be utilized, and may discharge air as it enters the flexible bag, to facilitate placement of the flexible bag within the container. Other mandrels including others that discharge air or other suitable fluids may also be used.

In the preferred embodiment, the packaging insertion apparatus 1 includes a cuffing assembly 270 adapted for use in cuffing an open end of the flexible bag over top edges of the container 42 into which the flexible bag was inserted. As disclosed above, the cuffing assembly 270 includes at least one actuating means 283 for raising and lowering the cuffing assembly 270, and further includes two pairs of cuffing fingers 315, 316 and 322, 326 positioned on two opposing sides of the container 42. Further, in the preferred embodiment, the cuffing assembly 270 includes two separate rotary actuators 312 and 322 operably coupled to the cuffing fingers. Still further, in the preferred embodiment, the cuffing fingers 315, 316 and 322, 326 are not mounted on the insertion assembly 230, and are operable to rotate inwardly and then cuff the open end of the flexible bag over the top edges of the container 42. This cuffing operation can be performed while the insertion assembly 230 is in the retracted position, while the insertion assembly 230 is in the extended position, and may also be performed simultaneously with the insertion of the flexible bag, while the insertion assembly 230 is moving between the retracted and extended positions.

In other embodiments, the cuffing assembly 270 may include at least one cuffing finger positioned on two opposing sides of the container; and at least one actuating means operably coupled to the cuffing fingers for selectively moving the cuffing fingers between a first position to facilitate initial insertion of the flexible bag into the container 42, and a second position in which the cuffing fingers are adapted to spread the open end of the flexible bag and invert the open end of the flexible bag over the top edges of the container 42.

In another aspect, the present invention relates to a packaging insertion apparatus 1 for inserting flexible bags into packaging containers 41, which includes, a container receiving area 40 for receiving containers 41 being supplied to the insertion apparatus 1; a bag dispenser 50 for dispensing flexible bags to the container receiving area 40 for insertion of the flexible bags into the containers 41; at least one movable vacuum head for engaging a flexible bag supplied by the bag dispenser to allow the flexible bag to be positioned for insertion into a container 42 held in the container receiving area 40; at least one vacuum head operator or actuator 171 for moving the at least one movable vacuum head into engagement with the flexible bag supplied by the bag dispenser 50 and for opening and/or positioning the flexible bag for insertion into the container 42 held in the container receiving area 40; at least one insertion assembly 230 having a mandrel for engaging the flexible bag which is to be inserted into the container 42 positioned in a working position in the container receiving area 40, wherein the insertion assembly 230 has a retracted position where the mandrel 330 is ready to engage and insert the flexible bag into the container 42 in the container receiving area 40, and an extended position where the mandrel 330 is positioned within the container 42 in the container receiving area 40 having inserted the flexible bag into the container 42; and the at least one movable vacuum head movable into engagement with a flexible bag supplied by the bag dispenser 50 while the mandrel 330 is in the extended position.

In the preferred embodiment each movable vacuum head 100 and 160 may be controllably moved along separate paths on opposite sides of the mandrel 330, to engage a flexible bag supplied by the bag dispenser 50, while the mandrel 330 is in the extended position. In other embodiments, the at least one movable vacuum head may be controllably moved along at least one path past the mandrel 330, to engage a flexible bag supplied by the bag dispenser, while the mandrel 330 is in the extended position.

In the preferred embodiment, the packaging insertion apparatus 1 includes two rear vacuum heads 210 and 211 which may be controllably moved to assist the at least one movable vacuum head in engaging the flexible bag held by the bag dispenser. In other embodiments, the at least one rear vacuum head may be controllably moved to assist the at least one movable vacuum head in engaging the flexible bag held by the bag dispenser.

In other embodiments, the present invention includes at least one cuffing finger positioned on two opposing sides of the container; and at least one actuating means operably coupled to the cuffing fingers for selectively moving the cuffing fingers between a first position to facilitate initial placement of the mandrel and the flexible bag into the container, and a second position in which the cuffing fingers are adapted to spread the open end of the flexible bag and invert the open end of the flexible bag over the top edges of the container.

In the preferred embodiment of the present invention, the cuffing fingers are not mounted on the insertion assembly 230. The cuffing fingers are operable to cuff the open end of the flexible bag over the top edges of the container 42 while the mandrel 330 is in the retracted position. Alternatively or additionally, the cuffing fingers are operable to cuff the open end of the flexible bag over the top edges of the container 42 while the mandrel 330 is in the extended position. Further, the cuffing fingers are also operable to cuff the open end of the flexible bag over the top edges of the container 42 while the mandrel 330 is moving between the retraced and extended positions.

The method of inserting flexible bags into packaging containers 41 of the present invention includes one or more of the following steps including, dispensing flexible bags from a bag dispenser 50 for insertion of the flexible bags into containers 41; engaging a flexible bag supplied by the bag dispenser 50 with at least one movable vacuum head; positioning the flexible bag for insertion into a container 42 by moving the at least one movable vacuum head; inserting the flexible bag into the container 42 with an insertion assembly 230, by moving the insertion assembly 230 to an extended position; and engaging a subsequent flexible bag held by the bag dispenser 50 with the at least one movable vacuum engagement head while the insertion assembly 230 is in the extended position having inserted the flexible bag into the container 42.

In methods according to the present invention the moving at least one moveable vacuum head to the bag dispenser 50 to engage a flexible bag may comprise moving two movable vacuum heads 100 and 160 along separate paths on opposite sides of the insertion assembly 230 toward the bag dispenser 50 to engage the flexible bag supplied by the bag dispenser 50. Further, engaging the flexible bag comprises bringing the at least one vacuum head into apposition with the flexible bag supplied by the bag dispenser 50 and developing sufficient vacuum pressure so that the flexible bag will substantially adhere to the at least one movable vacuum head. Still further, moving the vacuum head to position the flexible bag for insertion into the container 42 in the container receiving area 40 includes moving at least a portion of an open end of the flexible bag so that the open end of the flexible bag will accept the insertion assembly 230. Still further, the methods of the present invention may also include cuffing an open end of the flexible bag over top edges of the container 42 into which the flexible bag was inserted.

Methods of inserting flexible bags into packaging containers 41 of the present invention may also include the steps of, supplying containers 41 to a container receiving area 40; dispensing flexible bags from a bag dispenser 50 to the container receiving area 40 for insertion of the flexible bags into the containers 41; moving at least one moveable vacuum head to the bag dispenser 50 to engage a flexible bag; gripping the flexible bag with grippers that the flexible bag may be separated by separating the bag from an adjacent bag, such as along a perforation; engaging the flexible bag with the at least one vacuum head so that the flexible bag may be positioned for insertion into the container 42 positioned in the container receiving area 40; moving the vacuum head to effect opening or positioning of position the flexible bag for insertion in to the container 42 positioned in the container receiving area 40; inserting the flexible bag into the container 42 positioned in the container receiving area 40 using an insertion apparatus 230 having a mandrel 330; and moving the at least one movable vacuum head to the bag dispenser 50 and into engagement with a subsequent flexible bag supplied by the bag dispenser 50 while the mandrel 330 is in an extended position having inserted the flexible bag into the container 42 positioned within the container receiving area 40.

In a preferred embodiment, the packaging insertion apparatus 1 for inserting flexible bags 566 into packaging containers, includes a bag dispenser 50 for dispensing flexible bags 566 which are to be inserted into containers; at least one movable vacuum head 100, 160 for engaging and positioning a flexible bag 566 supplied by the bag dispenser 50 in preparation for insertion of the flexible bag 566 into a container; a clamping assembly 360 for controllably clamping an open end of the flexible bag 566 which has been engaged and positioned by the at least one movable vacuum head 100, 160 in preparation for insertion of the flexible bag 566 into the container; and an insertion assembly 230 for inserting the flexible bag 566 into the container. Also disclosed is an apparatus 1 wherein the clamping assembly 360 includes at least one clamping pad 398, 428 positioned on two opposing sides of the container; and at least one actuating means 380, 410 operably coupled to the clamping pads 398, 428 for controllably moving the clamping pads into a clamping position. Also disclosed is an apparatus 1 including a cuffing assembly 270 adapted for use in cuffing the open end of the flexible bag 566 over top edges of the container into which the flexible bag 566 was inserted.

As disclosed above, in a preferred embodiment, the clamping assembly 360 and the cuffing assembly 270*a* cooperate to controllably clamp the open end of the flexible bag 566. Also disclosed in a preferred embodiment wherein the cuffing assembly 270*a* includes at least one cuffing finger 325*a*, 326*a*, 315*a* and 316*a* positioned on two opposing sides of the container; and at least one actuating means 312, 322, 283 operably coupled to the cuffing fingers for controllably moving the cuffing fingers into a clamping position. Also disclosed is a preferred embodiment wherein the clamping assembly 360 includes at least one clamping pad 398, 399, 428 positioned on the two opposing sides of the container; and at least one actuating means 380, 410 operably coupled to the clamping pads for controllably moving the clamping pads into a clamping position.

A preferred method of inserting flexible bags into packaging containers is disclosed, which includes dispensing a flexible bag 566 from a bag dispenser 50 for insertion of the flexible bag 566 into a container; engaging the flexible bag 566 supplied by the bag dispenser 50 with at least one movable vacuum head 100, 160; positioning the flexible bag 566 for insertion into the container by moving the at least one movable vacuum head 100, 160; controllably clamping an open end of the flexible bag 566 which has been engaged and positioned by the at least one movable vacuum head 100, 160; and inserting the flexible bag into the container with an insertion assembly 230. Also disclosed is a method wherein the controllably clamping an open end of the flexible bag 566 includes providing at least one clamping pad 398, 399, 428 positioned on two opposing sides of the container; and controllably moving the clamping pads into a clamping position. As disclosed, the method may include cuffing the open end of the flexible bag 566 over top edges of the container into which the flexible bag 566 was inserted. As disclosed, the cuffing the open end of the flexible bag 566 over top edges of the container includes providing at least one cuffing finger 315*a*, 316*a*, 325*a* and 326*a* positioned on two opposing sides of the container; and moving the cuffing fingers into a clamping position. Further the controllably clamping an open end of the flexible bag 566 includes providing at least one clamping pad 398, 399, 428 positioned on the two opposing sides of the container; and moving the clamping pads into a clamping position. In a disclosed method the clamping assembly 360 and the cuffing assembly 270*a* cooperate to controllably clamp the open end of the flexible bag 566.

In one aspect, the present invention relates to a pair of vacuum heads 565 for engaging opposing sides of a flexible bag which is to be opened. The disclosed apparatus includes at least two vacuum heads 567 and 568 for engaging opposing sides of a flexible bag 566 which is to be opened, wherein the at least two vacuum heads 567 and 568 have an engagement face 502 for engaging the flexible bag 566, and wherein the engagement face 502 includes at least one slot 533*a*, 533*b* having at least one slot end 537, 538 which is open, and wherein vacuum pressure is communicated to the at least one slot 533*a*, 533*b*; and at least one actuator 171 for moving the at least two vacuum heads 567 and 568 towards each other and into engagement with the opposing sides of the flexible bag 566, and for moving the at least two vacuum heads 567 and 568 away from each other as the opposing sides of the flexible bag 566 are separated. As disclosed above, in a preferred embodiment the slots 533*a*, 533*b* are oriented in a substantially upstanding orientation. Further, the slots 533*a*, 533*b* are relatively offset as the at least two vacuum heads 567 and 568 engage the opposing sides of the flexible bag 566. Also disclosed is a preferred embodiment wherein at least one of the at least two vacuum heads include a gripper 575 for gripping the plastic film when positioned in between the vacuum heads to facilitate disconnection of adjacent bags along a perforation or other line of weakness.

In another aspect, the present invention relates to a method of opening flexible bags 566. The method includes the steps of providing a flexible bag 566 which is to be opened, the flexible bag 566 having opposing sides 596 and 597; providing at least two vacuum heads 591 and 592 for engaging the opposing sides 596 and 597 of the flexible bag 566, wherein the at least two vacuum heads 591 and 592 have an engagement face 502 for engaging the flexible bag 566, and wherein the engagement face 502 includes at least one slot 533*c*, 533*d* having at least one slot end 537 which is open, and wherein vacuum pressure is communicated to the at least one slot 533*c*, 533*d*; moving the at least two vacuum heads 591 and 592 towards each other and into engagement with the opposing sides 596 and 597 of the flexible bag 566; and moving the at least two vacuum heads 591 and 592 away from each other as the opposing sides 596 and 597 of the flexible bag 566 are separated to open the flexible bag 566.

Also disclosed is a method wherein the vacuum pressure causes the opposing sides 596 and 597 of the flexible bags 566 to be grasped within the at least one slot 533*c* and 533*d* on the engagement faces 502. Also disclosed is a method wherein a wrinkle 600 forms on the opposing sides 596 and 597 of the flexible bags 566 as the opposing sides 596 and 597 of the flexible bags 566 are grasped within the at least one slot 533*c*, 533*d* on the engagement faces 502. Also disclosed is a method wherein the step of providing the at least two vacuum heads 567 and 568 further comprises providing the at least two vacuum heads 567 and 568 wherein the slots 533*a* and 533*b* are oriented in a substantially upstanding orientation. Also disclosed is a method wherein the step of moving the at least two vacuum heads 567 and 568 towards each other and into engagement with the opposing sides of the flexible bag 566 further comprises moving the at least two vacuum heads 567 and 568 into a relatively offset position, wherein the slots 533*a* and 533*b* are relatively offset as the at least two vacuum heads 567 and 568 engage the opposing sides of the flexible bag 66.

Additional Explanations Concerning Aspects of Invention

A packaging insertion apparatus for inserting flexible bags into packaging containers, comprising: a container receiving area for receiving containers being supplied to the insertion apparatus; a bag dispenser for dispensing flexible bags to a position adjacent the container receiving area for insertion of the flexible bags into the containers; at least one movable vacuum head for engaging a flexible bag supplied by the bag dispenser to allow the flexible bag to be positioned for insertion into a container positioned in the container receiving area; at least one vacuum head operator for moving the at least one movable vacuum head into engagement with the flexible bag supplied by the bag dispenser and for positioning the flexible bag for insertion into the container held in the container receiving area; at least one insertion assembly having a mandrel for engaging the flexible bag which is to be inserted into the container held in the container receiving area, wherein the insertion assembly has a retracted position where the mandrel is ready to engage and insert the flexible bag into the container in the container receiving area, and an extended position where the mandrel is positioned within the container in the container receiving area having inserted the flexible bag into the container; wherein the at least one movable vacuum head is movable into engagement with a subsequent flexible bag held by the bag dispenser while the mandrel is in the extended position.

A packaging insertion apparatus for inserting flexible bags into packaging containers, comprising: a bag dispenser for dispensing flexible bags which are to be inserted into containers; an insertion assembly which moves between a retracted position where the insertion assembly is ready to insert a flexible bag into a container, and an extended position where the insertion assembly is positioned within the container having inserted the flexible bag into the container; and at least one movable vacuum head for engaging and positioning the flexible bags supplied by the bag dispenser in preparation for insertion of the flexible bags into the containers, wherein the at least one movable vacuum head may engage a flexible bag supplied by the bag dispenser while the insertion assembly is in the extended position.

A method of inserting flexible bags into packaging containers, comprising the steps of: dispensing flexible bags from a bag dispenser for insertion of the flexible bags into containers; engaging a flexible bag supplied by the bag dispenser with at least one movable vacuum head; positioning the flexible bag for insertion into a container by moving the at least one movable vacuum head; inserting the flexible bag into the container with an insertion assembly, by moving the insertion assembly to an extended position; and engaging a subsequent flexible bag held by the bag dispenser with the at least one movable vacuum head while the insertion assembly is in the extended position having inserted the flexible bag into the container.

A method of inserting flexible bags into packaging containers, comprising the steps of: supplying containers to a container receiving area; dispensing flexible bags from a bag dispenser to the container receiving area for insertion of the flexible bags into the containers; moving at least one moveable vacuum head to engage a flexible bag; engaging the flexible bag with the at least one vacuum head so that the flexible bag may be positioned for insertion into the container positioned in the container receiving area; moving the vacuum head to position the flexible bag for insertion into the container positioned in the container receiving area; inserting the flexible bag into the container positioned in the container receiving area using an insertion apparatus; and moving the at least one vacuum head to the bag dispenser and into engagement with a subsequent flexible bag supplied by the bag dispenser while the insertion apparatus is in an extended position having inserted the flexible bag into the container positioned within the container receiving area.

An apparatus for inserting a flexible liner into a packaging container, comprising: a liner supply for supplying a flexible liner to be inserted into a container; at least one liner engagement head for controllably engaging a flexible liner supplied by the liner supply and positioning the liner for insertion into a container positioned in a container receiving area; at least one insertion assembly which is movable between retracted and extended positions, said at least one insertion assembly being movable into an extended position to insert a liner into a container positioned in the container receiving area; wherein said at least one liner engagement head is movable into engagement with a liner held by the liner supply while the at least one insertion assembly is in an extended position inserting another liner into a container positioned in the container receiving area.

An apparatus for inserting a flexible liner into a packaging container, comprising: a frame; a liner supply for supplying a flexible liner to be inserted into a container; at least one liner engagement head mounted for movement relative to said frame for controllably engaging a flexible liner supplied by the liner supply and positioning the liner for insertion into a container positioned in a container receiving area; at least one engagement head operator for moving said at least one liner engagement head between an engagement position and a ready position in which a liner is ready for insertion of the liner into a container positioned in the container receiving area; at least one insertion assembly mounted for movement relative to said frame and which is movable between retracted and extended positions, said at least one insertion assembly being movable into an extended position to insert a liner into a container positioned in the container receiving area; at least one insertion assembly operator for moving the at least one insertion assembly between the retracted and extended positions relative to the frame; at least one cuffing assembly mounted for movement relative to the frame for cuffing a portion of a liner about a container in which the liner has been inserted by said at least one insertion assembly; at least one cuffing assembly operator for moving the at least one cuffing assembly relative to the frame.

An apparatus for inserting a flexible liner into a packaging container, comprising: a liner supply for supplying a flexible liner to be inserted into a container; at least one liner engagement head for controllably engaging a flexible liner supplied by the liner supply and positioning the liner for insertion into a container positioned in a container receiving area; at least one insertion assembly which is movable between retracted and extended positions, said at least one insertion assembly being movable into an extended position to insert a liner into a container positioned in the container receiving area; at least one cuffing assembly for cuffing a portion of the liner over edges of the container; wherein said at least one liner engagement head is movable into engagement with a liner held by the liner supply while the at least one insertion assembly is in an extended position inserting another liner into a container positioned in the container receiving area.

A method for inserting flexible liners into packaging containers, comprising: supplying a container to a container receiving area associated with a liner insertion apparatus; dispensing a first liner to a dispensed position of the liner insertion apparatus; engaging the first liner using at least one movable engagement head; positioning the first liner using said at least one movable engagement head to prepare the first liner for insertion; inserting the first liner into the container by extending at least one insertion assembly of the liner insertion apparatus against the first liner and into the container positioned in the container receiving area; dispensing a second liner to a dispensed position of the liner insertion apparatus; moving said at least one movable engagement head into engagement with the second liner while the at least one insertion assembly is in an extended position associated with said inserting step.

A method for inserting a flexible liners into packaging containers, comprising: supplying a first container to a container receiving area associated with a liner insertion apparatus; dispensing a first liner to a dispensed position of the liner insertion apparatus; engaging the first liner using at least one movable engagement head; opening the first liner using said at least one movable engagement head to open and position the first liner for insertion; inserting the first liner into the first container by extending at least one insertion assembly into the first liner and into the first container positioned in the container receiving area; dispensing a second liner to a dispensed position of the liner insertion apparatus; moving said at least one movable engagement head into engagement with the second liner while the insertion assembly is still in an extended position relative to said first liner; engaging the second liner using the at least one movable engagement head; retracting said at least one insertion assembly; removing said first container with first liner inserted therein from the container receiving area; supplying a second container in the container receiving area; opening the second liner using said at least one movable engagement head to open and position the second liner for insertion; inserting the second liner into the container by extending said at least one insertion assembly into the second liner and into the second container positioned in the container receiving area.

A method for inserting and cuffing flexible liners onto packaging containers, comprising: supplying a first container to a container receiving area associated with a liner insertion apparatus; dispensing a first liner to a dispensed position of the liner insertion apparatus; engaging the first liner using at least one movable engagement head; opening the first liner using said at least one movable engagement head to open and position the first liner for insertion; inserting the first liner into the first container by extending at least one insertion assembly into the first liner and into the first container positioned in the container receiving area; dispensing a second liner to a dispensed position of the liner insertion apparatus; moving said at least one movable engagement head into engagement with the second liner while the insertion assembly is still in an extended position associated with said inserting step; cuffing the first liner about portions of the first container by moving a cuffing assembly against the first liner as the first liner is in juxtaposition with the container; engaging the second liner using the at least one movable engagement head; retracting said at least one insertion assembly; removing said first container with first liner inserted therein from the container receiving area; positioning a second container in the container receiving area; opening the second liner using said at least one movable engagement head to open and position the second liner for insertion; inserting the second liner into the container by extending at least one insertion assembly into the second liner and into the second container positioned in the container receiving area; cuffing the second liner about portions of the second container by moving said cuffing assembly against the second liner as the second liner is in juxtaposition with the container.

A method for inserting and cuffing a flexible liner onto a packaging container, comprising: supplying a container to a container receiving area associated with a liner insertion apparatus; dispensing a liner to a dispensed position of the liner insertion apparatus; engaging the liner using at least one movable engagement head mounted for movement relative to a frame of the liner insertion apparatus; positioning the liner using said at least one movable engagement head to position the liner in preparation for insertion; inserting the liner into the container by extending at least one insertion assembly into the liner and into the container positioned in the container receiving area, said at least one insertion assembly being mounted for movement relative to the frame; cuffing the liner about portions of the container by moving a cuffing assembly against the liner as the liner is in juxtaposition with the container, said cuffing assembly moving relative to the frame independent from said at least one insertion assembly.

An apparatus for inserting and cuffing a flexible liner onto a packaging container, comprising: at least one movable engagement head for engaging a liner and moving the liner in preparation for insertion into a container positioned in a container receiving area of said apparatus; at least one insertion assembly mounted for movement to insert the liner positioned by said at least one movable engagement head; at least one cuffing assembly mounted for movement to cuff the liner over the packaging container; at least one cuffing clamp mounted upon said at least one cuffing assembly for controllably clamping the liner during at least a portion of an inserting and cuffing operation performed on the liner.

An apparatus for inserting and cuffing a flexible liner onto a packaging container, comprising: at least one dispenser for supplying a flexible liner to be inserted into a container; at least one movable engagement head for engaging a liner supplied by said at least one dispenser and moving the liner in preparation for insertion into a container positioned in a container receiving area of said apparatus; at least one insertion assembly mounted for movement to insert the liner positioned by said at least one movable engagement head; at least one cuffing assembly mounted for movement to cuff the liner over the packaging container; at least one cuffing clamp mounted upon said at least one cuffing assembly for controllably clamping the liner during at least a portion of the inserting and cuffing operation performed on the liner; wherein said at least one liner engagement head is movable into engagement with a liner held by the at least one dispenser while the at least one insertion assembly is in an extended position inserting another liner into a container positioned in the container receiving area.

An apparatus for inserting and cuffing a flexible liner onto a packaging container, comprising: at least one insertion assembly mounted for movement to insert a liner; at least one cuffing assembly mounted for movement to cuff the liner over the packaging container; at least one cuffing clamp mounted upon said at least one cuffing assembly for controllably clamping the liner during at least a portion of an inserting and cuffing operation performed on the liner.

An apparatus for inserting and cuffing a flexible liner onto a packaging container, comprising: at least one dispenser for supplying a flexible liner to be inserted into a container; at least one movable vacuum engagement head for engaging a liner supplied by said at least one dispenser and moving the liner in preparation for insertion into a container positioned in a container receiving area of said apparatus; at least one insertion assembly mounted for movement to insert the liner positioned by said at least one movable engagement head; at least one cuffing assembly mounted for movement to cuff the liner over the packaging container; at least one cuffing clamp mounted upon said at least one cuffing assembly for controllably clamping the liner during at least a portion of an inserting and cuffing operation performed on the liner; wherein said at least one movable vacuum engagement head is movable into engagement with a liner held by the at least one dispenser while the at least one insertion assembly is in an extended position inserting another liner into a container positioned in the container receiving area.

An apparatus for partitioning and inserting a flexible liner into a packaging container, comprising: at least one dispenser for supplying flexible liners to be inserted into a container; at least one movable engagement assembly for engaging a liner supplied by said at least one dispenser and moving the liner in preparation for insertion into a container positioned in a container receiving area of said apparatus; at least one insertion assembly mounted for movement to insert the liner positioned by said at least one movable engagement assembly into a container in said container receiving area; at least one gripper mounted upon said at least one movable engagement assembly for engaging and holding the liner to allow partition of the liner from said at least one dispenser.

An apparatus for partitioning and inserting a flexible liner into a packaging container, comprising: at least one movable engagement assembly for engaging a liner and moving the liner in preparation for insertion into a container positioned in a container receiving area of said apparatus; at least one insertion assembly mounted for movement to insert the liner positioned by said at least one movable engagement assembly into a container in said container receiving area; at least one gripper mounted upon said at least one movable engagement assembly for engaging and holding the liner to allow partition of the liner.

An apparatus for partitioning and inserting a flexible liner into a packaging container, comprising: at least one dispenser for supplying flexible liners to be inserted into a container; at least one movable engagement assembly for engaging a liner supplied by said at least one dispenser and moving the liner in preparation for insertion into a container positioned in a container receiving area of said apparatus; at least one insertion assembly mounted for movement to insert the liner positioned by said at least one movable engagement assembly into a container in said container receiving area; at least one gripper mounted upon said at least one movable engagement assembly for engaging and holding the liner to allow partition of the liner from said at least one dispenser; wherein said at least one liner engagement head is movable into engagement with a liner held by the at least one dispenser while the at least one insertion assembly is in an extended position inserting another liner into a container positioned in the container receiving area.

An apparatus for partitioning and inserting a flexible liner into a packaging container, comprising: at least one dispenser for supplying flexible liners to be inserted into a container; at least one movable engagement assembly having vacuum engagement heads for engaging a liner supplied by said at least one dispenser and moving the liner in preparation for insertion into a container positioned in a container receiving area of said apparatus; at least one insertion assembly mounted for movement to insert the liner positioned by said at least one movable engagement assembly into a container in said container receiving area; at least one gripper mounted upon said at least one movable engagement assembly for engaging and holding the liner to allow partition of the liner from said at least one dispenser; wherein said at least one liner engagement head is movable into engagement with a liner held by the at least one dispenser while the at least one insertion assembly is in an extended position inserting another liner into a container positioned in the container receiving area.

An apparatus for handling a flexible liner for a packaging container, comprising: at least one dispenser for supplying flexible liners; at least one movable engagement assembly having vacuum engagement heads for engaging a liner supplied by said at least one dispenser and moving the liner; at least one gripper mounted upon said at least one movable engagement assembly for engaging and holding the liner to allow partition of the liner from said at least one dispenser.

An apparatus for handling a flexible liner for a packaging container, comprising: at least one dispenser for supplying flexible liners; at least one movable engagement assembly having vacuum engagement heads for engaging a liner supplied by said at least one dispenser and moving the liner; at least one gripper mounted upon said at least one movable engagement assembly for engaging and holding the liner to allow partition of the liner from said at least one dispenser.

An apparatus for partitioning, inserting and cuffing a flexible liner onto a packaging container, comprising: at least one dispenser for supplying a flexible liner to be inserted into a container; at least one movable engagement head for engaging a liner supplied by said at least one dispenser and moving the liner in preparation for insertion into a container positioned in a container receiving area of said apparatus; at least one insertion assembly mounted for movement to insert the liner positioned by said at least one movable engagement head; at least one cuffing assembly mounted for movement to cuff the liner over the packaging container; at least one gripper mounted upon said at least one movable engagement assembly for engaging and holding the liner to allow partition of the liner from said at least one dispenser.

An apparatus for partitioning, inserting and cuffing a flexible liner onto a packaging container, comprising: at least one dispenser for supplying a flexible liner to be inserted into a container; at least one movable engagement head for engaging a liner supplied by said at least one dispenser and moving the liner in preparation for insertion into a container positioned in a container receiving area of said apparatus; at least one insertion assembly mounted for movement to insert the liner positioned by said at least one movable engagement head; at least one cuffing assembly mounted for movement to cuff the liner over the packaging container; at least one cuffing clamp mounted upon said at least one cuffing assembly for controllably clamping the liner during at least a portion of an inserting and cuffing operation performed on the liner; at least one gripper mounted upon said at least one movable engagement assembly for engaging and holding the liner to allow partition of the liner from said at least one dispenser.

A method for inserting and cuffing a flexible liner onto a packaging container, comprising: dispensing a liner to a dispensed position of the liner insertion apparatus; engaging the liner using at least one movable engagement head; positioning the liner using said at least one movable engagement head to position the liner in preparation for insertion; clamping the liner using at least one cuffing clamp mounted upon a cuffing assembly; inserting the liner into the container by extending at least one insertion assembly into the liner and into the container positioned in the container receiving area; cuffing the liner about portions of the container by moving said at least one cuffing assembly relative to the container with the at least one cuffing clamp in a clamped position during at least a portion thereof.

A method for inserting and cuffing a flexible liner onto a packaging container, comprising: dispensing a liner to a dispensed position of the liner insertion apparatus; engaging the liner using at least one movable engagement head that is independently movable relative to a frame; positioning the liner using said at least one movable engagement head to position the liner in preparation for insertion; clamping the liner using at least one cuffing clamp mounted upon a cuffing assembly that is independently movable relative to a frame; inserting the liner into the container by extending at least one insertion assembly into the liner and into the container positioned in the container receiving area, said insertion assembly being independently movable relative to the frame; cuffing the liner about portions of the container by moving said at least one cuffing assembly relative to the container with the at least one cuffing clamp in a clamped position.

A method for engaging and partitioning a liner used in a packaging container, comprising: supplying a liner to an engagement position using a liner supply; engaging the liner using a movable engagement head; gripping the liner using a gripper on the engagement head that bears against the liner; partitioning the liner by providing relative movement between the liner engaged by the gripper and said liner supply.

A method for engaging, partitioning and positioning a liner used in a packaging container, comprising: supplying a liner to an engagement position using a liner supply; engaging the liner using a movable engagement head; gripping the liner using a gripper on the engagement head that bears against the liner; partitioning the liner by providing relative movement between the liner engaged by the gripper and said liner supply; positioning the liner in preparation for insertion into the container.

A method for engaging, partitioning and inserting a liner used in a packaging container, comprising: supplying a liner to an engagement position using a liner supply; engaging the liner using a movable engagement head; gripping the liner using a gripper on the engagement head that bears against the liner; partitioning the liner by providing relative movement between the liner engaged by the gripper and said liner supply; positioning the liner for insertion into the container; inserting the liner into the container.

A method for engaging, partitioning, inserting and cuffing a liner used in a packaging container, comprising: supplying a liner to an engagement position using a liner supply; engaging the liner using a movable engagement head; gripping the liner using a gripper on the engagement head that bears against the liner; partitioning the liner by providing relative movement between the liner engaged by the gripper and said liner supply; positioning the liner for insertion into the container; inserting the liner into the container; cuffing the liner over the container.

A method for engaging, partitioning, inserting and cuffing a liner used in a packaging container, comprising: supplying a liner to an engagement position using a liner supply; engaging the liner using a movable engagement head; gripping the liner using a gripper on the engagement head that bears against the liner; partitioning the liner by providing relative movement between the liner engaged by the gripper and said liner supply; positioning the liner for insertion into the container; clamping the liner using at least one cuffing clamp mounted upon a cuffing assembly; inserting the liner into the container; cuffing the liner over the container.

A method for engaging, partitioning, inserting and cuffing a liner used in a packaging container, comprising: supplying a liner to an engagement position using a liner supply; engaging the liner using a movable engagement head which is mounted for independent movement relative to a frame; gripping the liner using a gripper on the engagement head that bears against the liner; partitioning the liner by providing relative movement between the liner engaged by the gripper and said liner supply; positioning the liner for insertion into the container; clamping the liner using at least one cuffing clamp mounted upon a cuffing assembly, said cuffing assembly being mounted for independent movement relative to said frame; inserting the liner into the container using an insertion assembly that is mounted for independent movement relative to said frame; cuffing the liner over the container.

A method for engaging, partitioning, inserting and cuffing a liner used in a packaging container, comprising: supplying a liner to an engagement position using a liner supply; engaging the liner using a movable engagement head; gripping the liner using a gripper on the engagement head that bears against the liner; partitioning the liner by providing relative movement between the liner engaged by the gripper and said liner supply; said movable engagement head having at least one vacuum engagement aperture which acts by wrinkling and separating opposing leaves of the liner; positioning the liner for insertion into the container; clamping the liner using at least one cuffing clamp mounted upon a cuffing assembly; inserting the liner into the container using an insertion assembly; cuffing the liner over the container.

A method for engaging, partitioning, inserting and cuffing a liner used in a packaging container, comprising: supplying a liner to an engagement position using a liner supply; engaging the liner using a movable engagement head which is mounted for independent movement relative to a frame; gripping the liner using a gripper on the engagement head that bears against the liner; partitioning the liner by providing relative movement between the liner engaged by the gripper and said liner supply; said movable engagement head having at least one vacuum engagement aperture which acts by wrinkling and separating opposing leaves of the liner; positioning the liner for insertion into the container; clamping the liner using at least one cuffing clamp mounted upon a cuffing assembly, said cuffing assembly being mounted for independent movement relative to said frame; inserting the liner into the container using an insertion assembly that is mounted for independent movement relative to said frame; cuffing the liner over the container.

An apparatus for opening flexible liners used in packaging containers, comprising: a first vacuum head having a first vacuum engagement aperture which engages against a first leaf of a flexible liner; a second vacuum head having a second vacuum engagement aperture which is mounted in opposition to said first vacuum head to engage against a second leaf of the flexible liner opposite said first leaf of the flexible liner; at least one vacuum head actuator for moving at least one of said vacuum heads relative to the other of said vacuum heads and relative to the flexible liner; at least one vacuum relief port adjacent to at least one of said first or second vacuum engagement apertures for alleviating vacuum developed within at least one of said vacuum engagement apertures.

An apparatus for opening flexible liners used in packaging containers, comprising: a first vacuum head having a first vacuum engagement aperture which engages against a first leaf of a flexible liner; a second vacuum head having a second vacuum engagement aperture which is mounted in opposition to said first vacuum head to engage against a second leaf of the flexible liner opposite said first leaf of the flexible liner; at least one vacuum head actuator for moving at least one of said vacuum heads relative to the other of said vacuum heads and relative to the flexible liner; wherein the first vacuum engagement aperture and second vacuum engagement aperture are misaligned.

An apparatus for partitioning and opening flexible liners used in packaging containers, comprising: a first vacuum head having a first vacuum engagement aperture which engages against a first leaf of a flexible liner; a second vacuum head having a second vacuum engagement aperture which is mounted in opposition to said first vacuum head to engage against a second leaf of the flexible liner opposite said first leaf of the flexible liner; wherein the first vacuum engagement aperture is misaligned relative to the second vacuum engagement aperture; at least one vacuum head actuator for moving at least one of said vacuum heads relative to the other of said vacuum heads and relative to the flexible liner; at least one vacuum relief port adjacent to at least one of said first or second vacuum engagement apertures for alleviating vacuum developed within at least one of said vacuum engagement apertures; at least one engagement gripper that controllably extends to bear upon at least one of said leaves of the flexible liner to allow partitioning of the flexible liner when the at least one engagement gripper is engaged.

An apparatus for partitioning and opening flexible liners used in packaging containers, comprising: a first vacuum head having a first vacuum engagement aperture which engages against a first leaf of a flexible liner; a second vacuum head having a second vacuum engagement aperture which is mounted in opposition to said first vacuum head to engage against a second leaf of the flexible liner opposite said first leaf of the flexible liner; at least one vacuum head actuator for moving at least one of said vacuum heads relative to the other of said vacuum heads and relative to the flexible liner; at least one engagement gripper that controllably extends to bear upon at least one of said leaves of the flexible liner.

An apparatus for partitioning and opening flexible liners used in packaging containers, comprising: a first vacuum head having a first vacuum engagement aperture which engages against a first leaf of a flexible liner; a second vacuum head having a second vacuum engagement aperture which is mounted in opposition to said first vacuum head to engage against a second leaf of the flexible liner opposite said first leaf of the flexible liner; at least one vacuum head actuator for moving at least one of said vacuum heads relative to the other of said vacuum heads and relative to the flexible liner; at least one engagement gripper that controllably extends to bear upon at least one of said leaves of the flexible liner; a liner supply which is controllable to partition an attached liner from the liner being engaged by said at least one engagement gripper.

An apparatus for engaging a flexible film, comprising: a vacuum head having a first vacuum engagement aperture which includes an elongated slot; at least one vacuum relief port adjacent to said elongated slot for alleviating vacuum developed within said vacuum engagement aperture.

A method for opening a flexible liner used in packaging containers, the flexible liner having two opposing leaves which are in juxtaposition prior to opening, comprising: positioning the flexible liner which is to be opened between two opposing vacuum heads; moving at least one of said vacuum heads into engagement with the flexible liner; establishing a vacuum within a vacuum engagement aperture forming a part of at least one of said vacuum heads; relieving vacuum established within said vacuum engagement aperture using at least one vacuum relief port; separating said vacuum heads to open the flexible liner.

A method for opening a flexible liner used in packaging containers, the flexible liner having two opposing leaves which are in juxtaposition prior to opening, comprising: positioning the flexible liner which is to be opened between two opposing vacuum heads; moving at least one of said vacuum heads into engagement with the flexible liner; establishing vacuums within opposing vacuum engagement apertures forming parts of said opposing vacuum heads; wherein the opposing vacuum engagement apertures are misaligned so as to engage against the flexible liner in a misaligned relationship; separating said opposing vacuum heads to open the flexible liner.

A method for partitioning and opening a flexible liner used in packaging containers, the flexible liner having two opposing leaves which are in juxtaposition prior to opening, comprising: positioning the flexible liner which is to be opened between two opposing vacuum heads; gripping the flexible liner using a gripper that bears against the flexible liner; moving at least one of said vacuum heads into engagement with the flexible liner; partitioning the flexible liner gripped by the gripping step from an adjacent flexible liner along a line of weakness; establishing a vacuum within a vacuum engagement aperture forming a part of at least one of said vacuum heads; separating said vacuum heads to open the flexible liner.

A method for engaging a flexible film of a liner, comprising: positioning the flexible film adjacent to a vacuum head; moving said vacuum head relative to the flexible film and into engagement therewith; establishing a vacuum within a vacuum engagement aperture forming a part of said vacuum head; relieving vacuum established within said vacuum engagement aperture using at least one vacuum relief port.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An apparatus for inserting and cuffing a flexible liner onto a packaging container, comprising:

at least one dispenser for supplying a flexible liner to be inserted into a container;

at least one movable engagement head for engaging a liner supplied by said at least one dispenser and moving the liner in preparation for insertion into a container positioned in a container receiving area of said apparatus;

at least one insertion assembly mounted for movement to insert the liner positioned by said at least one movable engagement head;

at least one cuffing assembly mounted for movement to cuff the liner over the packaging container;

at least one cuffing clamp mounted upon said at least one cuffing assembly for controllably clamping the liner during at least a portion of the inserting and cuffing operation performed on the liner;

wherein said at least one liner engagement head is movable into engagement with a liner held by the at least one dispenser while the at least one insertion assembly is in an extended position inserting another liner into a container positioned in the container receiving area.

2. An apparatus according to claim 1 and further comprising at least one cuffing clamp actuator for controllably moving the at least one cuffing clamp relative to portions of said at least one cuffing assembly.

3. An apparatus according to claim 1 and wherein the at least one cuffing clamp is mounted for adjustable positioning relative to the at least one cuffing assembly.

4. An apparatus according to claim 1 and further comprising at least one cuffing clamp spring which yields when the at least one cuffing clamp engages against portions of the at least one cuffing assembly.

5. An apparatus according to claim 1 and further comprising at least one cuffing clamp spring that biases at least one clamping pad to allow yielding of the at least one clamping pad when the at least one clamping pad engages against portions of the at least one cuffing assembly.

6. An apparatus according to claim 1 and further comprising:

at least one cuffing clamp actuator for controllably moving the at least one cuffing clamp relative to portions of said at least one cuffing assembly;

at least one cuffing clamp spring that biases at least one clamping pad to allow yielding of the at least one clamping pad when the at least one clamping pad engages against portions of the at least one cuffing assembly.

7. An apparatus according to claim 1 and wherein the at least one cuffing assembly is mounted for movement independent from said at least one insertion assembly.

8. An apparatus according to claim 1 and wherein the at least one cuffing clamp further comprises:

at least one clamping pad positioned on the two opposing sides of the container; and at least one cuffing clamp actuator operably coupled to the at least one clamping pad for controllably moving into a clamping position.

9. An apparatus for inserting and cuffing a flexible liner onto a packaging container, comprising:

at least one dispenser for supplying a flexible liner to be inserted into a container;

at least one movable vacuum engagement head for engaging a liner supplied by said at least one dispenser and moving the liner in preparation for insertion into a container positioned in a container receiving area of said apparatus;

at least one insertion assembly mounted for movement to insert the liner positioned by said at least one movable engagement head;

at least one cuffing assembly mounted for movement to cuff the liner over the packaging container;

at least one cuffing clamp mounted upon said at least one cuffing assembly for controllably clamping the liner during at least a portion of an inserting and cuffing operation performed on the liner;

wherein said at least one movable vacuum engagement head is movable into engagement with a liner held by the at least one dispenser while the at least one insertion assembly is in an extended position inserting another liner into a container, positioned in the container receiving area.

10. An apparatus according to claim 9 and further comprising at least one cuffing clamp actuator for controllably moving the at least one cuffing clamp relative to portions of said at least one cuffing assembly.

11. An apparatus according to claim 9 and wherein the at least one cuffing clamp is mounted for adjustable positioning relative to the at least one cuffing assembly.

12. An apparatus according to claim 9 and further comprising at least one cuffing clamp spring which yields when the at least one cuffing clamp engages against portions of the at least one cuffing assembly.

13. An apparatus according to claim 9 and further comprising at least one cuffing clamp spring that biases at least one clamping pad to allow yielding of the at least one clamping pad when the at least one clamping pad engages against portions of the at least one cuffing assembly.

14. An apparatus according to claim 9 and further comprising:

at least one cuffing clamp actuator for controllably moving the at least one cuffing clamp relative to portions of said at least one cuffing assembly;

at least one cuffing clamp spring that biases at least one clamping pad to allow yielding of the at least one clamping pad when the at least one clamping pad engages against portions of the at least one cuffing assembly.

15. An apparatus according to claim 9 and wherein the at least one cuffing assembly is mounted for movement independent from said at least one insertion assembly.

16. An apparatus according to claim 9 and wherein the at least one cuffing clamp further comprises:

at least one clamping pad positioned on the two opposing sides of the container; and at least one cuffing clamp actuator operably coupled to the at least one clamping pad for controllably moving into a clamping position.

* * * * *

UNITED STATES PATENT AND TRADEMARK OFFICE

CERTIFICATE OF CORRECTION

PATENT NO. : 6,773,385 B2
DATED : August 10, 2004
INVENTOR(S) : Johnson et al.

It is certified that error appears in the above-identified patent and that said Letters Patent is hereby corrected as shown below:

Column 6,
Line 65, please delete "50" before "that" and insert -- so --.

Column 19,
Line 67, please delete "at" after "includes" and insert -- a --.

Column 22,
Line 9, please delete "is" after "that" and insert -- it --.
Line 21, please insert -- is -- after "which".

Column 23,
Line 10, please delete "is" after "that" and insert -- it --.
Line 15, please insert -- as -- after "used".
Line 31, please delete "**579*b*" after "that" and insert -- 579*d*** --.

Column 27,
Line 33, please insert -- of -- after "position".
Line 34, please delete "in to" after "insertion" and insert -- into --.

Column 31,
Line 50, please delete "a" after "flexible".

Signed and Sealed this

Eighth Day of March, 2005

JON W. DUDAS
*Director of the United States Patent and Trademark Office*